US008693902B2

(12) United States Patent
Watanabe et al.

(10) Patent No.: US 8,693,902 B2
(45) Date of Patent: Apr. 8, 2014

(54) IMAGE FORMING APPARATUS

(75) Inventors: Naoto Watanabe, Kanagawa (JP); Tetsuya Muto, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 213 days.

(21) Appl. No.: 13/327,208

(22) Filed: Dec. 15, 2011

(65) Prior Publication Data

US 2012/0155899 A1 Jun. 21, 2012

(30) Foreign Application Priority Data

Dec. 16, 2010 (JP) ..... 2010-280120

(51) Int. Cl.
*G03G 15/00* (2006.01)

(52) U.S. Cl.
USPC ..... 399/49; 399/51

(58) Field of Classification Search
USPC ..... 399/49, 51, 74
See application file for complete search history.

(56) References Cited

U.S. PATENT DOCUMENTS

| | | | | |
|---|---|---|---|---|
| 5,446,550 | A * | 8/1995 | Maekawa et al. | 358/3.19 |
| 7,146,122 | B2 | 12/2006 | Hatori et al. | |
| 7,228,081 | B2 | 6/2007 | Hasegawa et al. | |
| 7,251,420 | B2 | 7/2007 | Fujimori et al. | |
| 7,260,335 | B2 | 8/2007 | Kato et al. | |
| 7,486,916 | B2 | 2/2009 | Tsuda et al. | |
| 7,493,058 | B2 | 2/2009 | Takeuchi et al. | |
| 7,496,305 | B2 | 2/2009 | Watanabe | |
| 7,548,704 | B2 | 6/2009 | Hasegawa et al. | |
| 7,551,866 | B2 | 6/2009 | Watanabe et al. | |
| 7,616,909 | B2 | 11/2009 | Kato et al. | |
| 7,672,602 | B2 | 3/2010 | Ariizumi et al. | |
| 7,720,402 | B2 | 5/2010 | Watanabe | |
| 7,778,560 | B2 | 8/2010 | Ishibashi et al. | |
| 7,796,902 | B2 | 9/2010 | Watanabe et al. | |
| 7,821,677 | B2 | 10/2010 | Tanaka et al. | |
| 7,881,629 | B2 | 2/2011 | Takeuchi et al. | |
| 7,885,556 | B2 | 2/2011 | Fujimori et al. | |
| 8,045,874 | B2 | 10/2011 | Yoshida et al. | |
| 2007/0025748 | A1 | 2/2007 | Ishibashi et al. | |
| 2009/0324267 | A1 | 12/2009 | Yoshida et al. | |
| 2010/0092188 | A1 | 4/2010 | Hirayama et al. | |
| 2010/0278549 | A1 | 11/2010 | Ishibashi et al. | |

FOREIGN PATENT DOCUMENTS

| | | |
|---|---|---|
| JP | 7-253694 | 10/1995 |
| JP | 10-13675 | 1/1998 |

* cited by examiner

*Primary Examiner* — Walter L Lindsay, Jr.
*Assistant Examiner* — Barnabas Fekete
(74) *Attorney, Agent, or Firm* — Oblon, Spivak, McClelland, Maier & Neustadt, L.L.P.

(57) ABSTRACT

An image forming apparatus includes: a charging unit that uniformly charges a surface of a latent image carrier; a latent-image forming unit; a developing unit that performs development by causing toner to electrostatically adhere on the surface of the carrier; a transfer unit that transfers a toner image onto a recording medium; and an image-density adjusting unit that causes to form a multi-gradation patch pattern on the surface of the carrier, that causes to detect potentials of latent image patches in the multi-gradation patch pattern, that causes to detect a toner adhesion amount on each toner patch, and that performs control of an image density. One of part and all of the low-density latent image patches is a dot-dispersed latent image patch in which the arrangement of unit dot latent images in the basic dot matrix is determined so that a minimum center-to-center distance having a smallest value is maximized.

4 Claims, 40 Drawing Sheets

Θ = 30°

Θ = 15°

Θ = 60°

Θ = 75°

NUMBERS IN PARENTHESES ARE MINIMUM CENTER-TO-CENTER DISTANCE [dot]

NUMBERS IN PARENTHESES ARE MINIMUM CENTER-TO-CENTER DISTANCE [dot]

PATTERN 1 (8)

PATTERN 2 (5.7)

PATTERN 3 (4)

PATTERN 4 (2)

NUMBERS IN PARENTHESES ARE MINIMUM CENTER-TO-CENTER DISTANCE [dot]

PATTERN 1 (8)

PATTERN 2 (5.7)

PATTERN 3 (4)

PATTERN 4 (2.8)

IMAGE FORMING APPARATUS

CROSS-REFERENCE TO RELATED APPLICATIONS

The present application claims priority to and incorporates by reference the entire contents of Japanese Patent Application No. 2010-280120 filed in Japan on Dec. 16, 2010.

BACKGROUND OF THE INVENTION

1. Field of the Invention

The present invention relates to an image forming apparatus such as a printer, a copying machine, or a facsimile, which performs image formation by forming a dot latent image, that is a dotted electrostatic latent image, on a surface of a latent image carrier, by developing the dot latent image into a toner image, and finally by transferring the toner image onto a recording medium.

2. Description of the Related Art

In an electrophotographic digital image forming apparatus, a dot latent image is formed on a surface of a latent image carrier, and a toner image is formed, for example, by attaching toner to an electrostatic latent image portion that is an irradiated portion for negative development, or to a non-electrostatic latent image portion that is a non-irradiated portion for positive development. In the following description, negative development is described as an example. An amount of toner adhering to the electrostatic latent image portion of the latent image carrier by the development is determined on the basis of the area of an electrostatic latent image, a development potential (a potential difference between the surface of the developer carrier and the electrostatic latent image on the latent image carrier), a charge amount of toner, and the like. Moreover, the gradation or image density in an output image is realized by controlling the number of dot latent images in a basic dot matrix (for example, 9 by 9 dots) (hereinafter, this control method is referred to as "area gradation control"), by controlling the adhesion amount of toner adhering to one dot latent image (hereinafter, this control method is referred to as "density gradation control"), or by performing a combination of these control methods. Specifically, a high density portion can be realized in the output image by increasing the number of dot latent images in each basic dot matrix for the area gradation control or by increasing the exposure time for the density gradation control. Conversely, a low density portion can be realized in the output image by decreasing the number of dot latent images in each basic dot matrix for the area gradation control or by decreasing the exposure time for the density gradation control.

In recent years, an optical writing time per dot has been decreased with an improvement in writing density (dot latent image density) of a dot latent image to realize a higher image quality and with improvement in image forming speed. Accordingly, in the case of employing density gradation control in which the gradation of an image is expressed by changing the optical writing time per dot, it is difficult to increase the resolution, and the number of gradation levels per dot controllable by density gradation control decreases. For example, in a high-speed image forming apparatus that forms a high-density dot latent image as high as 1200 dpi to 4800 dpi, the number of gradation levels per dot that can be realized by the density gradation control is about 4 gradation levels. Thus, it is desirable to adopt area gradation control in reproducing multi-level gradation.

On the other hand, in many image forming apparatuses, each of various kinds of density adjusting control schemes is executed at predetermined timing so as to maintain image quality (see Japanese Patent Application Laid-open No. 07-253694 and Japanese Patent Application Laid-open No. 10-013675). Specifically, for example, a patch pattern for adjusting an image density formed by a plurality of latent image patches (electrostatic latent images) that have mutually different image densities is written onto the latent image carrier, and the potentials of the respective latent image patches of the patch pattern are detected. Thereafter, the patch pattern is developed, and the adhesion amounts of toner adhering to the respective patches (toner patches) of the patch pattern are detected after the development. Then, based on the relation between the development potential obtained from the detected latent image potential and the toner adhesion amount, a predetermined value of a density index (such as a development potential for obtaining a predetermined toner adhesion amount corresponding to a reference image density (for example, a target density of a solid image)) is calculated. Then, various image forming conditions are adjusted based on the value of the density index, and control is performed so as to stabilize the image density.

When performing the density adjusting control, it is important to detect the relation between the development potential and the toner adhesion amount with high accuracy. Moreover, in order to obtain the relation with high accuracy, it is desirable to form a multi-gradation patch pattern in which a number of latent image patches of different densities over a wide density range are dispersed. However, with a decrease in the time for performing the density adjusting control, there is a limitation in the number of latent image patches that can be formed. Thus, it is required to detect the above relation with high accuracy using a multi-gradation patch pattern including as few latent image patches as possible. In order to satisfy this requirement, it is desirable to provide a multi-gradation patch pattern in which as few latent image patches as possible are dispersed in as wide a density range as possible.

However, in the image forming apparatus of the related art, the adhesion amount of toner adhering to a latent image patch of a low density portion (highlighted portion) is larger than an intended toner adhesion amount. Thus, in a case where the relation between the development potential and the toner adhesion amount is detected using the toner adhesion amount of a low-density latent image patch, the detection accuracy of the relation decreases. Moreover, when the relation between the development potential and the toner adhesion amount is detected without using the toner adhesion amount of a low-density latent image patch, the density distribution range of the patches used for detecting the relation becomes narrow. Thus, it is difficult to detect the relation with high accuracy.

FIG. 65 is a graph plotting a number of relations between the development potential and the toner adhesion amount detected in an image forming apparatus of the related art.

The relation between the development potential and the toner adhesion amount is linear and the relation can be identified by a slope and an intercept of a straight line obtained by a linear approximation of the plotted points. The approximated straight line illustrated in FIG. 65 is obtained with respect to a plurality of latent image patches in the high density portion. As illustrated in FIG. 65, all plotted points of the latent image patches in the high density portion are in the vicinity of the approximated straight line, and it can be said that the accuracy of the approximated straight line is high. On the other hand, in viewing the plotted points of the latent image patches in the low density portion, the plotted points deviate greatly from the approximated straight line toward the large toner adhesion amount side. From the above, it can be understood that the adhesion amount of the toner adhering to the latent image patches in the low density portion is larger than the intended toner adhesion amount.

In the example of the graph illustrated in FIG. 65, the number of latent image patches in the high density portion is increased and thus an approximated straight line with high accuracy can be obtained by using only the latent image patches in the high density portion. However, as described above, with a decrease in time for the density adjusting control in recent years, the number of latent image patches that can be formed is limited. Thus, it is difficult to obtain a straight line with high-accuracy of approximation using fewer latent image patches within a narrow density range only in the high density portion.

FIG. 66 is a view illustrating an example of creating a low-density latent image patch through density gradation control.

In the low-density latent image patch according to density gradation control illustrated in FIG. 66, all dots of a basic dot matrix (9 by 9 dots) are irradiated with light, and thus the potential of the entire basic dot matrix decreases uniformly in accordance with density. Moreover, an amount of toner that adheres to the low-density latent image patch is determined such that a total charge amount of the entire adhering toner is equal to the difference (development potential) between a developing bias Vb and a total latent image potential of the entire basic dot matrix. An image of the adhesion amount of toner adhering to the low-density latent image patch is illustrated in a lower part of FIG. 66. In this case, the toner adhesion amount of the low-density latent image patch becomes nearly a target amount, and a target image density is obtained.

FIG. 67 is an explanatory diagram illustrating an example in which a latent image patch, that has a latent image potential, to be detected by an electrometer, with the same level as the latent image potential of the latent image patch illustrated in FIG. 66, is formed by the area gradation control in an image forming apparatus of the related art.

In the low-density latent image patch formed by area gradation control illustrated in FIG. 67, dot latent images are written in areas, each corresponding to 3 by 3 dots, at the top-left corner and the bottom-right corner within a basic dot matrix (9 by 9 dots), so that the dot latent images are concentrated in the top-left corner and the bottom-right corner. Because a spot diameter of a beam irradiated to write one latent image is generally larger than a size of one dot latent image, light is also irradiated to adjacent dots when one latent image is written. Therefore, when a concentrated dot latent image portion is present as in the case of the low-density latent image patch illustrated in FIG. 67, a dot latent image (in particular, the dot latent image located at the center of 3 by 3 dots) is irradiated with a writing beam repeatedly. Thus, it has a latent image potential greatly less than the intended potential, and the development potential becomes much larger than the intended potential. However, when the potential of such a low-density latent image patch is detected with a general electrometer, the detection result produces a value similar to a value obtained by taking an average of the greatly decreased potential and the potentials over the entire basic dot matrix. That is, the detection result produces a similar value as that of the low-density latent image patch of the density gradation control illustrated in FIG. 66. However, the toner adhesion amount of the image adhering to a small portion which has a greatly decreased potential becomes like the one illustrated in the lower part of FIG. 67. The toner adhesion amount in that portion becomes large as compared to the toner adhesion amount in the low-density latent image patch of the density gradation control illustrated in FIG. 66. A problem associated with an increase of the toner adhesion amount is more prominent in the lower density portion where the ratio of the number of dot latent images to the total number of dots in the basic dot matrix is low.

The present invention has been made in view of the above circumstances, i.e., there is a need to provide an image forming apparatus capable of performing, with high accuracy, density adjustment using a multi-gradation patch pattern with fewer patches.

SUMMARY OF THE INVENTION

It is an object of the present invention to at least partially solve the problems in the conventional technology.

An image forming apparatus includes: a charging unit that uniformly charges a surface of a latent image carrier so as to cause a surface potential of the latent image carrier to be a target charging potential; a latent-image forming unit that exposes, based on image data, the surface of the latent image carrier having been charged by the charging unit with light so as to form a dot latent image that is a dotted electrostatic latent image; a developing unit that performs development by causing toner to electrostatically adhere to one of an electrostatic latent image portion and a non-electrostatic latent image portion on the surface of the latent image carrier; a transfer unit that eventually transfers a toner image formed on the surface of the latent image carrier through the development by the developing unit onto a recording medium; and an image-density adjusting unit that causes the latent-image forming unit to form a multi-gradation patch pattern on the surface of the latent image carrier, that causes a potential detecting unit to detect potentials of respective latent image patches in the multi-gradation patch pattern, that causes a toner adhesion amount detecting unit to detect a toner adhesion amount on each toner patch that is formed through the development of the respective latent images by the developing unit, and that performs control of an image density based on the detection results. One of a low-density latent image patch and a plurality of low-density latent image patches belonging to a predetermined low-density range among the latent image patches that form the multi-gradation patch pattern has a configuration in which a basic dot matrix that is a minimum pixel unit for area gradation control is periodically arranged, and in which number and arrangement of dot latent images in the basic dot matrix are determined in accordance with a corresponding density in units of a unit dot latent image that is formed with one of a dot latent image and a plurality of groups of dot latent images, and one of part and all of the one of the low-density latent image patch and the plurality of the low-density latent image patches is a dot-dispersed latent image patch in which the arrangement of unit dot latent images in the basic dot matrix is determined so that a minimum center-to-center distance having a smallest value among center-to-center distances of the unit dot latent images is maximized.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

An embodiment of the invention is described with reference to the drawings.

The present embodiment is an example of application to a full-color electrophotographic copying machine of a tandem type (hereinafter simply referred to as a "copying machine 600") as an image forming apparatus.

First, an overall configuration of the copying machine 600 according to the present embodiment is described.

Figure 1:
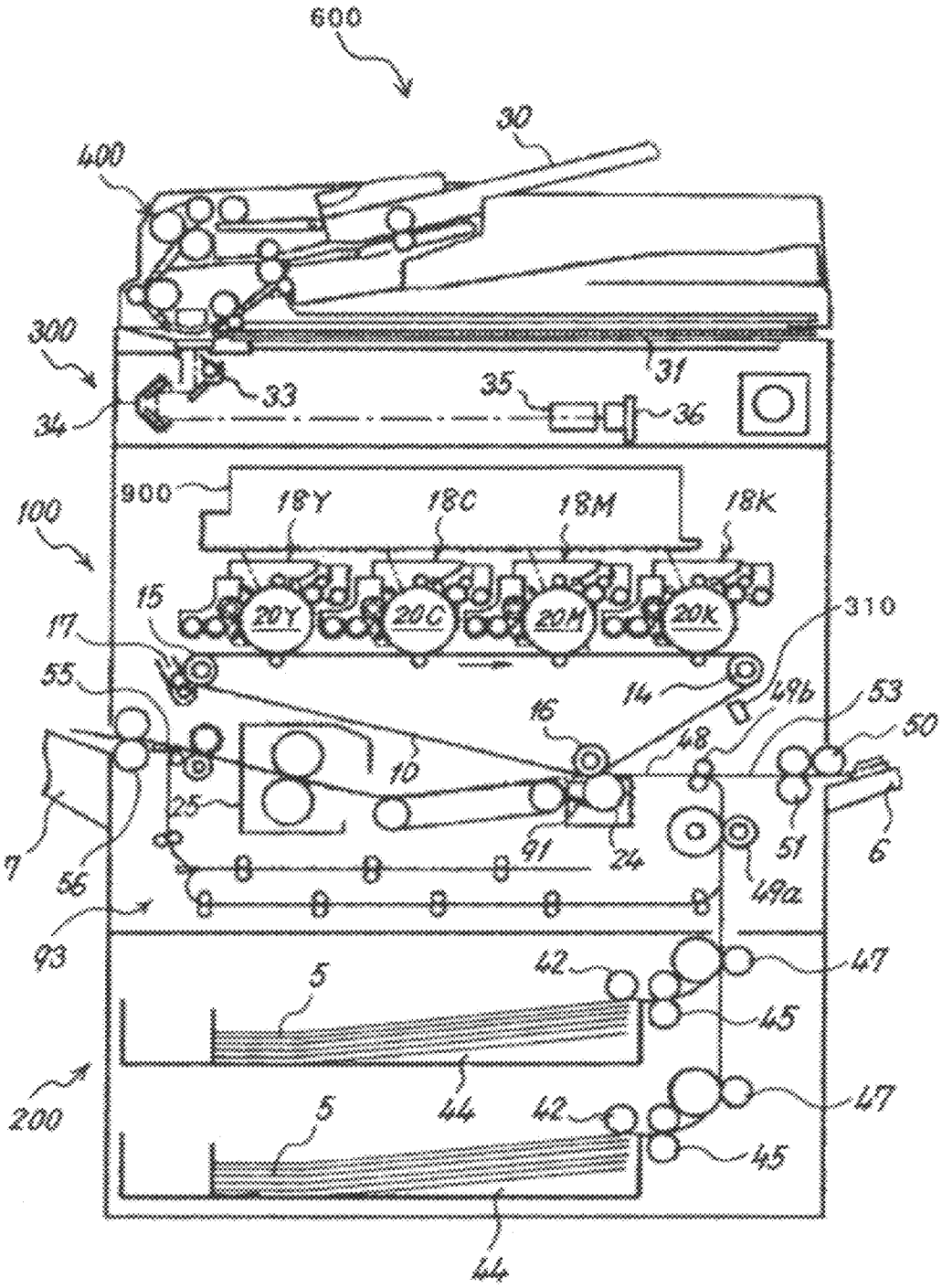
FIG. 1 is a view illustrating a simplified configuration of a copying machine according to an embodiment.

FIG. 1 is a schematic configuration diagram illustrating the whole of the copying machine 600 according to the present embodiment.

The copying machine 600 includes a copying machine body 100 in which image formation is performed and a feeding device 200 above which he copying machine body 100 is provided; the feeding device 200 supplies a transfer sheet 5 which is a recording medium to the copying machine body 100. The copying machine 600 further includes a scanner 300 which is attached above the copying machine body 100 so as to read a document image, and an automatic document feeder (ADF) 400 which is attached to an upper portion of the scanner 300. The copying machine body 100 includes a manual feeding tray 6 for feeding the transfer sheet 5 manually and a discharge tray 7 onto which the transfer sheet 5 having been subjected to image formation is discharged.

Figure 2:
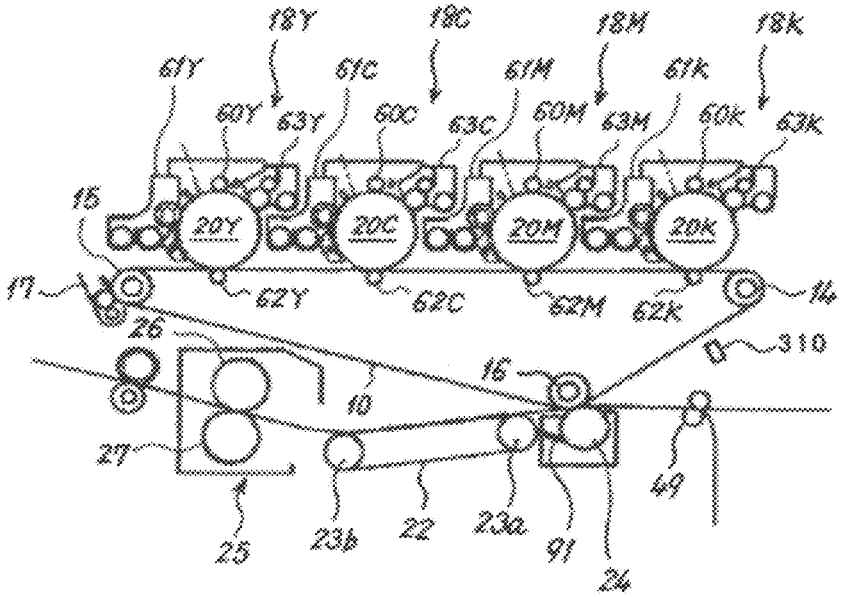
FIG. 2 is an enlarged view illustrating a configuration of an intermediate transfer unit of the copying machine and a peripheral configuration thereof.

FIG. 2 is an enlarged view illustrating a configuration of the copying machine body 100.

The copying machine body 100 includes an intermediate transfer belt 10 that is an endless belt serving as an intermediate transfer member. The intermediate transfer belt 10 is made from polyimide that is a material having an excellent mechanical property for preventing a positional deviation caused by elongation of the belt. Moreover, carbon is dispersed in the belt as a resistance adjuster so that the intermediate transfer belt 10 can operate stably, which results in a high image quality. That is, stable transfer performance can be obtained regardless of temperature and humidity environments. Thus, the belt looks black in color due to carbon. The intermediate transfer belt 10 is wound around three support rollers: a first support roller 14, a second support roller 15, and a third support roller 16. When a motor (not illustrated) serving as a driving source drives to rotate, in a state where the intermediate transfer belt 10 is wound, at least one of the three support rollers as a driving roller, the intermediate transfer belt 10 is rotated in the clockwise direction in FIG. 2.

As illustrated in FIG. 2, four image forming units 18Y, 18C, 18M, and 18K corresponding to respective colors of yellow, cyan, magenta, and black are arranged in series in a belt wound portion between the first support roller 14 and the second support roller 15 among the three support rollers 14 to 16. Moreover, a density sensor 310 serving as a toner adhesion amount detecting unit that detects a density (toner adhesion amount) of respective toner patches of a multi-gradation patch pattern formed on the intermediate transfer belt 10 is attached to a belt wound portion between the first support roller 14 and the third support roller 16.

Figure 3:
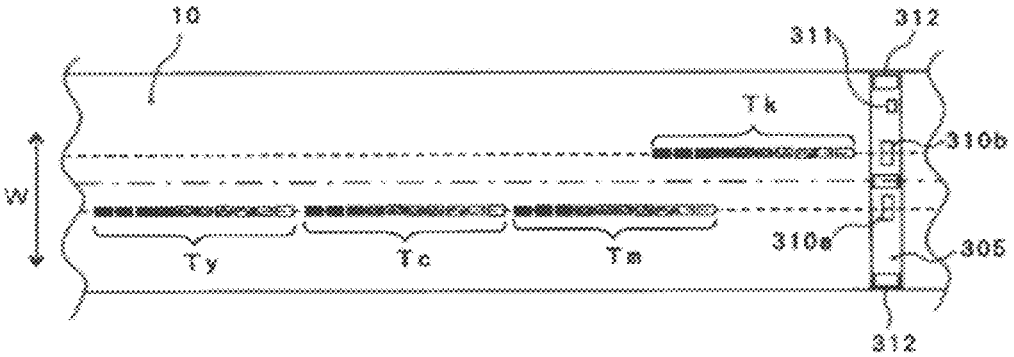
FIG. 3 is a schematic view illustrating an intermediate transfer belt of the copying machine and a gradation pattern image formed on a surface thereof.

FIG. 3 is a schematic diagram illustrating a sensor unit 305 including the density sensor 310, and the intermediate transfer belt 10 provided near the sensor unit 305.

The sensor unit 305 includes two density sensors 310*a* and 310*b*. As illustrated in FIG. 3, the two density sensors 310*a* and 310*b* are provided at two locations in a direction (hereinafter referred to as a "belt width direction W") parallel to the longitudinal direction of a photosensitive element 20 as indicated by an arrow W in the drawing. Moreover, toner patches of respective colors, to be described later in detail, are formed on the intermediate transfer belt 10. In FIG. 3, although a toner pattern formed with ten toner patches for each color is illustrated, the number of toner patches is not limited to a particular value. Moreover, as illustrated in FIG. 3, toner patterns are formed at two positions to correspond to the two density sensors 310 in the belt width direction W on the intermediate transfer belt 10.

A black toner pattern Tk is formed at a rear-side position of the intermediate transfer belt 10. On the other hand, a magenta toner pattern Tm, a cyan toner pattern Tc, and a yellow toner pattern Ty are sequentially formed at a front-side position of the intermediate transfer belt 10. Moreover, the first density sensor 310*a* of the sensor unit 305 provided on the front side is used to detect a color toner pattern, and the second density sensor 310*b* on the rear side is used to detect a black toner pattern.

Figure 4:
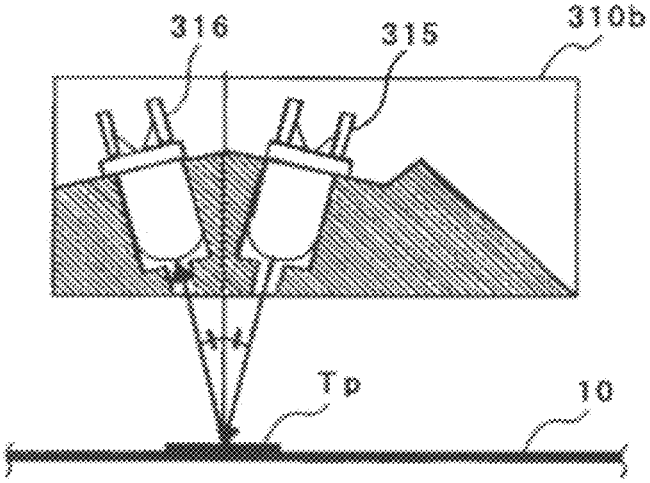
FIG. 4 is an enlarged view illustrating the configuration of a second sensor of a sensor unit in the copying machine.
Figure 5:
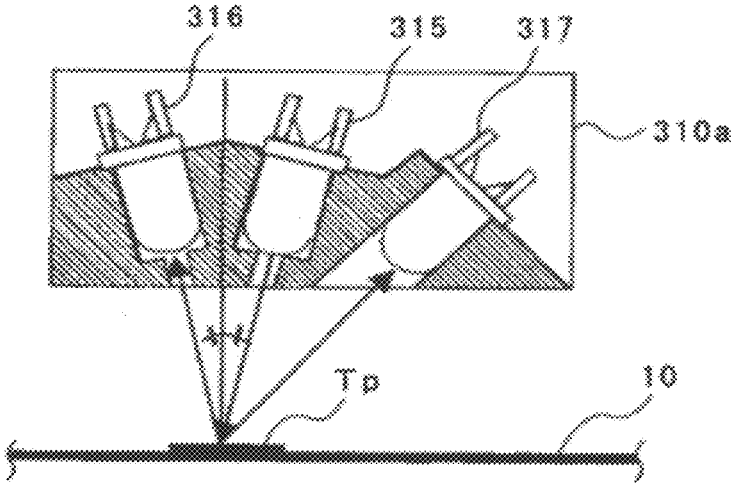
FIG. 5 is an enlarged view illustrating a first sensor in the sensor unit.

FIG. 4 is a schematic diagram illustrating the second density sensor 310*b*, and FIG. 5 is a schematic diagram illustrating the first density sensor 310*a*. In FIGS. 4 and 5, a toner pattern is denoted by reference numeral "Tp".

Figure 6:
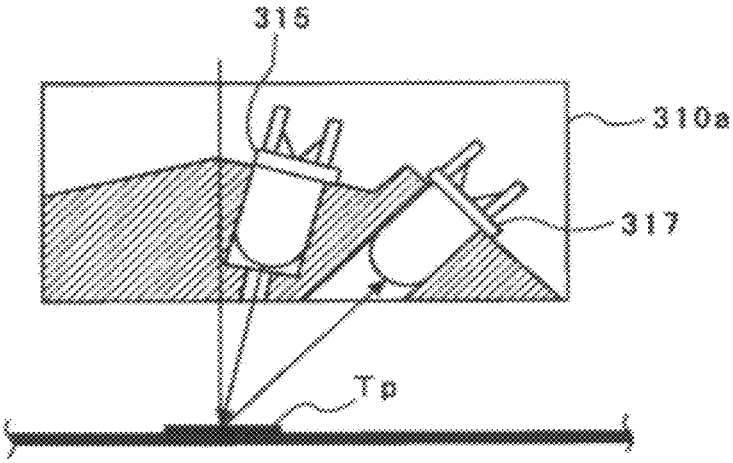
FIG. 6 is a view illustrating a configuration of a sensor of a diffuse-reflection type applicable to the first sensor.

The second sensor 310*b* that detects a black toner pattern is a sensor of a regular-reflection type which includes an LED 315 and a regularly reflected light receiving element 316 as illustrated in FIG. 4. On the other hand, the first density sensor 310*a* that detects a color toner pattern is a sensor of a regular reflection plus diffuse-reflection type which includes an LED 315, a regularly reflected light receiving element 316, and a diffuse reflection light receiving element 317 as illustrated in FIG. 5. A sensor, which detects a color toner pattern, may use a sensor of a diffuse-reflection type that includes the LED 315 and the diffuse reflection light receiving element 317 as illustrated in FIG. 6. In these sensors, a GaAs infrared emitting diode having a peak-emission wavelength $\lambda p$ of 950 nm is used as the LED 315 which is a light emitting element, and a Si phototransistor having a peak sensitivity wavelength of 800 nm is used as the light receiving element. Moreover, the distance (detection distance) between each sensor and a detection target surface of the intermediate transfer belt 10 is set to 5 mm.

As illustrated in FIG. 1, an exposing unit 900 serving as an electrostatic latent image forming unit is provided above the image forming units 18Y, 18C, 18M, and 18K illustrated in FIGS. 1 and 2. The exposing unit 900 causes a laser control unit (not illustrated) to drive a surface-emitting laser (not illustrated) which is a light source to emit a writing beam based on image information of a document read by the scanner 300 so as to form an electrostatic latent image on photosensitive elements 20Y, 20C, 20M, and 20K used as image carriers, which are provided in the image forming units 18Y, 18C, 18M, and 18K, respectively. The laser that emits the writing beam is not limited to the surface-emitting laser, but may be an end-emitting laser or an LED array.

The configuration of the image forming units 18Y, 18C, 18M, and 18K is described. Because the image forming units 18Y, 18C, 18M, and 18K have the same configuration, in the following description, the reference characters for distinguishing the colors are not to be provided.

Figure 7:
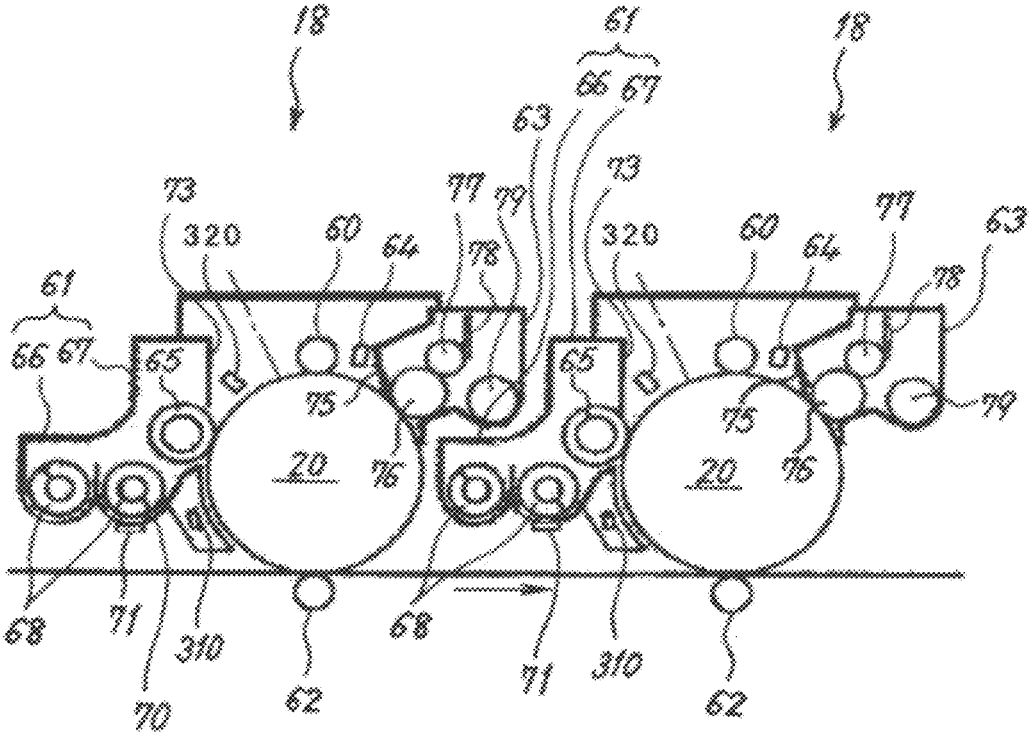
FIG. 7 is an enlarged view illustrating two of four image forming units in the copying machine.

FIG. 7 is an enlarged view illustrating the configuration of two adjacent image forming units 18.

The image forming unit 18 includes a charging unit 60 serving as a charging means, a developing unit 61 serving as a developing means, a photosensitive element cleaning unit 63 serving as a cleaning means, and a neutralizing unit 64 serving as a neutralizing means, which are all provided around the photosensitive element 20. Moreover, a primary transfer unit 62 that forms a transfer means is provided at a position to face the photosensitive element 20 with the intermediate transfer belt 10 interposed therebetween.

The charging unit 60 is a contact-type charging unit which uses a charging roller, and the charging unit is configured to uniformly charge a surface of the photosensitive element 20 by contacting with the photosensitive element 20 to apply voltage thereto. A non-contact charging unit which uses a non-contact scorotron charger may be used as the charging unit 60 as well.

Moreover, the developing unit 61 uses a two-component developer including magnetic carrier and non-magnetic toner. One-component developer may be used as the developer. The developing unit 61 can be roughly divided into a stirring section 66 and a developing section 67 which are provided inside a developing case 70. In the stirring section 66, two-component developer (hereinafter simply referred to as "developer") is stirred and transported, and supplied to a developing sleeve 65 used as a developer carrier described later. The stirring section 66 includes two screws 68 being parallel to each other. Moreover, a partition wall is provided between two screws 68 in such a way that two spaces that are created by the partition wall are spatially connected with each other at both ends of the two screws 68 in the axial direction of the screws 68. Moreover, a toner density sensor 71 for detecting a toner density of the developer in the developing unit 61 is attached to the developing case 70. In the developing section 67, toner in the developer carried by the developing sleeve 65 is transferred onto the photosensitive element 20. The developing section 67 includes the developing sleeve 65 facing the photosensitive element 20 through an opening of the developing case 70. A magnet (not illustrated) is fixed and disposed inside the developing sleeve 65. Moreover, a doctor blade 73 is disposed so that a distal end approaches the developing sleeve 65. In the present embodiment, the shortest distance between the doctor blade 73 and the developing sleeve 65 is set to 0.35 mm.

In the developing unit 61, the developer is transported by the two screws 68 by being stirred and circulated, and supplied to the developing sleeve 65. The developer having been supplied to the developing sleeve 65 is pumped up by the magnet and held by the developing sleeve 65. The developer pumped to the developing sleeve 65 is further transported with rotation of the developing sleeve 65, and an amount of the developer can be appropriately regulated by the doctor blade 73. The developer removed by the doctor blade 73 is returned to the stirring section 66. In this way, the developer having been transported to a developing area facing the photosensitive element 20 is caused to be in a standing-ear state by the magnet to form a magnetic brush. In the developing area, a developing electric field that moves toner in the developer to an electrostatic latent image portion on the photosensitive element 20 is formed by a developing bias applied to the developing sleeve 65. As a result, the toner in the developer is transported to the electrostatic latent image portion on the photosensitive element 20, and the electrostatic latent image on the photosensitive element 20 is turned into a visible image, and a toner image is formed. The developer having passed through the developing area is transported to a portion where a magnetic force of the magnet is weak, so that the developer is separated from the developing sleeve 65 and returned to the stirring section 66. When a toner density in the stirring section 66 is decreased with repetition of the operations as above, the toner density sensor 71 detects a decrease in the toner density, and new toner is supplied to the stirring section 66 based on the detection result.

The primary transfer unit 62 uses a primary transfer roller, and is disposed in such a manner that the primary transfer roller abuts on the photosensitive element 20 with the intermediate transfer belt 10 interposed therebetween. The primary transfer unit 62 may have a shape other than a roller shape, and may adopt a conductive brush-shaped transfer unit or a non-contact corona charger.

The photosensitive element cleaning unit 63 includes a cleaning blade 75 which is formed by, for example, polyurethane rubber and is disposed so that the distal end thereof presses the photosensitive element 20. Moreover, in the present embodiment, in order to enhance a cleaning performance, the photosensitive element cleaning unit 63 also includes a conductive fur brush 76 which comes into contact with the photosensitive element 20. The toner removed from the photosensitive element 20 by the cleaning blade 75 or the fur brush 76 is stored inside the photosensitive element cleaning unit 63.

The neutralizing unit 64 is formed by a neutralizing lamp, which emits light to the photosensitive element 20 to initialize the surface potential of the photosensitive element 20.

Moreover, the image forming unit 18 includes potential sensors 320 serving as a potential detecting means, which are provided so as to correspond to the respective photosensitive elements 20. The potential sensors 320 are provided to face the surfaces of the photosensitive elements 20 and positions where the potential sensors 320 are provided, in the longitudinal direction, are arranged to coincide with the positions of the density sensors 310*a* and 310*b* illustrated in FIG. 3 in the longitudinal direction (the belt width direction W in FIG. 3). These potential sensors 320 detect surface potentials of the photosensitive elements 20.

A specific configuration of the image forming unit 18 is described.

The photosensitive element 20 has a diameter of 60 mm, and the photosensitive element 20 rotates at a linear velocity of 380 mm/s. Moreover, the developing sleeve 65 has a diameter of 25 mm, and the developing sleeve 65 rotates at a linear velocity of 570 mm/s. Moreover, a charged amount of toner in the developer that is to be supplied to the developing area is preferably set to be in the range from −10 μC/g to −30 μC/g. Moreover, a developing gap that is a gap between the photosensitive element 20 and the developing sleeve 65 can be set to be in the range of 0.5 to 0.3 mm. Developing efficiency can be improved by decreasing the value of the developing gap. Moreover, a photoconductive layer of the photosensitive element 20 has a thickness of 30 μm. The exposing unit 900 includes an optical system of which the diameter of a beam spot is 52×55 μm, and a light amount is about 0.101 mW. As an example, the surface of the photosensitive element 20 is uniformly charged to −700 V by the charging unit 60, and a potential of the electrostatic latent image portion irradiated by a laser beam by the exposing unit 900 becomes −250 V. In addition, voltage of a developing bias is set to −550 V to obtain a development potential of 300 V. Such image forming conditions are changed appropriately from time to time based on the result of image density adjusting control and the like.

In the image forming unit 18 having the above configuration, first, when the photosensitive element 20 rotates, the surface of the photosensitive element 20 is uniformly charged by the charging unit 60. Subsequently, the exposing unit 900 emits a laser writing beam to the photosensitive element 20 based on the image information read by the scanner 300, so that an electrostatic latent image is formed on the photosensitive element 20. Thereafter, the electrostatic latent image is changed into a visible image by the developing unit 61, so that a toner image is formed. The toner image is primarily transferred onto the intermediate transfer belt 10 by the primary transfer unit 62. Residual toner remaining on the surface of the photosensitive element 20 after the primary transfer is removed by the photosensitive element cleaning unit 63. Thereafter, the surface of the photosensitive element 20 is neutralized by the neutralizing unit 64 and is used in the next image forming operation.

Subsequently, as illustrated in FIG. 2, a secondary transfer roller 24 which is a secondary transfer unit is disposed at a position to face the third support roller 16 of the three support rollers. When the toner image on the intermediate transfer belt 10 is secondarily transferred onto the transfer sheet 5, the secondary transfer roller 24 is pressed against a portion of the intermediate transfer belt 10 wound around the third support roller 16, and the secondary transfer is realized. In the meantime, the secondary transfer unit may not have the configuration to use the secondary transfer roller 24, and a transfer belt, or a non-contact transfer charger, for example, may be used. A roller cleaning unit 91 that removes the toner adhering to the secondary transfer roller 24 is in contact with the secondary transfer roller 24.

Moreover, an endless belt-shaped conveying belt 22 wound between two rollers 23*a* and 23*b* is disposed on the downstream side of the secondary transfer roller 24 in the conveying direction of the transfer sheet 5. Furthermore, a fixing unit 25 for fixing the toner image transferred onto the transfer sheet 5 is provided on the downstream side in the conveying direction. The fixing unit 25 has a configuration in which a pressing roller 27 is pressed against a heat roller 26. Moreover, a belt cleaning unit 17 is disposed at a position to face the second support roller 15 among the support rollers of the intermediate transfer belt 10. The belt cleaning unit 17 is configured to remove the toner remaining on the intermediate transfer belt 10 after the toner image on the intermediate transfer belt 10 is transferred onto the transfer sheet 5.

Moreover, as illustrated in FIG. 1, the copying machine body 100 includes a conveying path 48 along which the transfer sheet 5, that has been fed from the feeding device 200, is guided to the discharge tray 7 via the secondary transfer roller 24. Moreover, a carriage roller 49*a*, a registration roller 49*b*, a discharge roller 56, and the like are provided along the conveying path 48. Moreover, a switching claw 55 is provided on the downstream side of the conveying path 48 so as to change the conveying direction of the transfer sheet 5 after the transfer of images so that the transfer sheet 5 is conveyed to the discharge tray 7 or a sheet reversing unit 93. The sheet reversing unit 93 reverses the faces of the transfer sheet 5, and then feeds the transfer sheet 5 to the secondary transfer roller 24 again. Moreover, the copying machine body 100 includes a manual feed path 53 which connects the manual feeding tray 6 and the conveying path 48. A manual feed roller 50 and a manual separation roller 51 are provided on the upstream side of the manual feed path 53 so as to feed the transfer sheet 5 loaded in the manual feeding tray 6 one by one.

The feeding device 200 includes a plurality of sheet cassettes 44 for storing the transfer sheet 5, a feed roller 42 and a separation roller 45 for feeding the transfer sheet stored in these sheet cassettes 44 one by one, and a carriage roller 47 that transports the fed transfer sheet along a sheet feed path 46. The sheet feed path 46 is connected to the conveying path 48 of the copying machine body 100.

Figure 8:
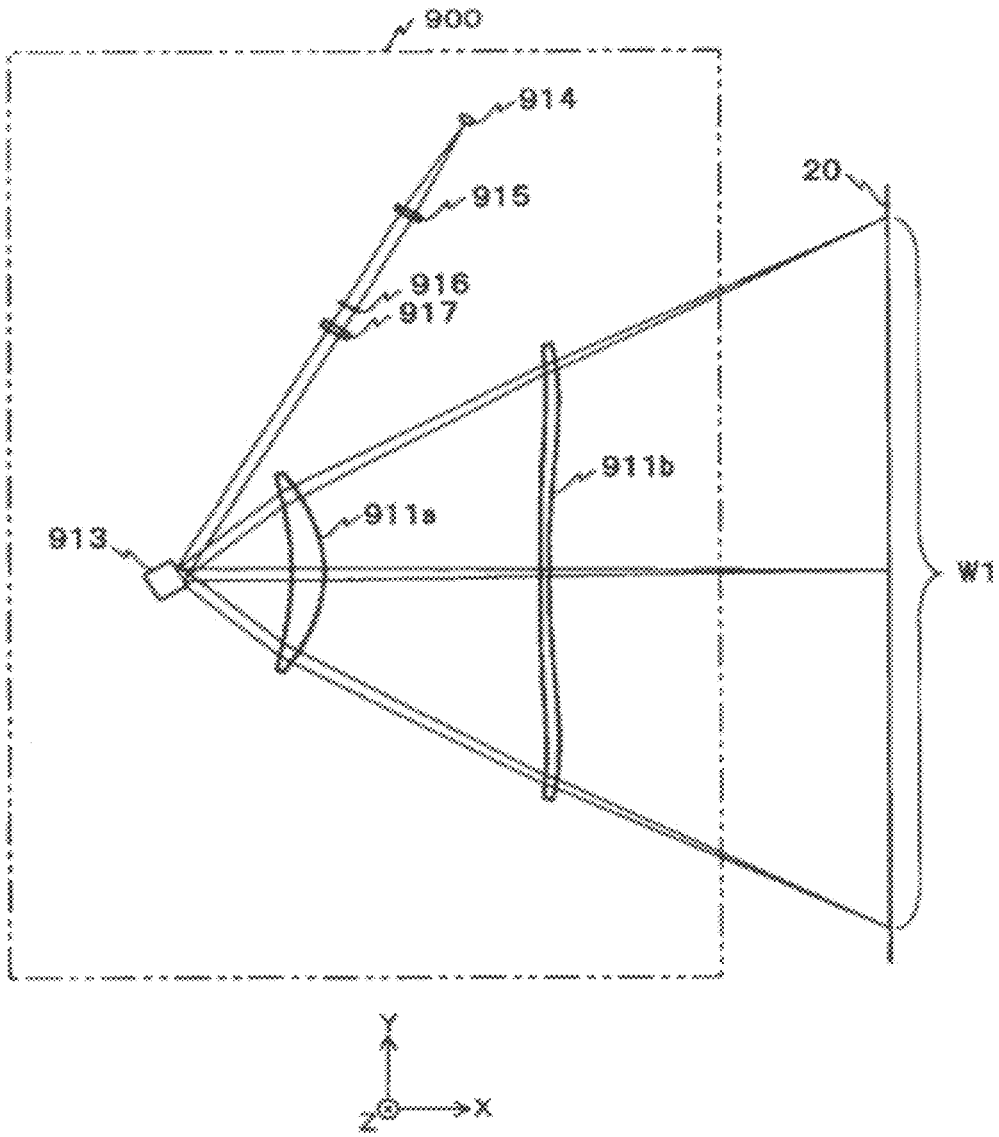
FIG. 8 is an illustrative view of a simplified configuration of an optical system of an exposing unit.
Figure 9:
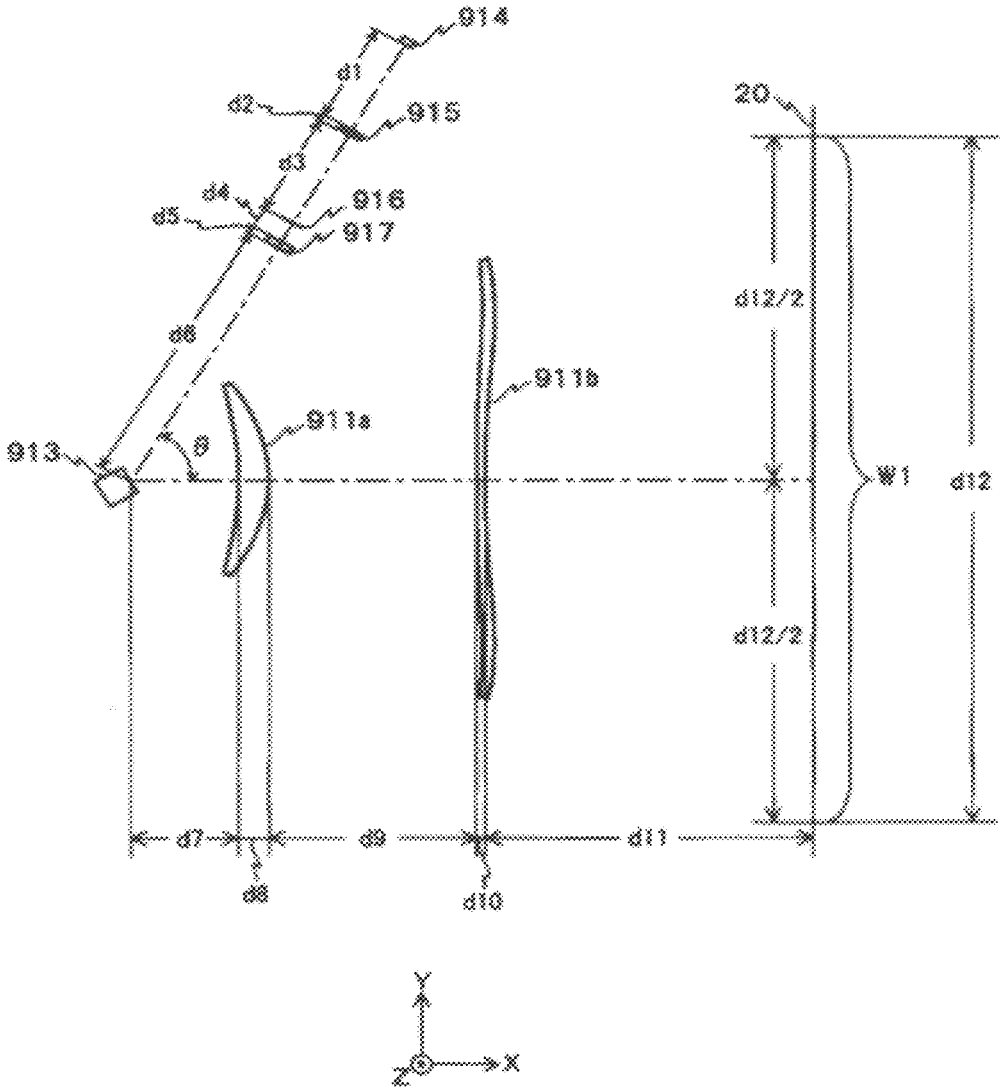
FIG. 9 is an explanatory diagram illustrating the distance between respective members of the optical system of the exposing unit.

Next, a configuration of the exposing unit 900 that is an optical scanner unit is described with reference to FIGS. 8 and 9.

The exposing unit 900 includes a light source 914, a coupling lens 915, an aperture member 916, a cylindrical lens 917, a polygon mirror 913 serving as an optical deflector, a polygon motor (not illustrated) that rotates the polygon mirror 913, two scanning lenses 911*a* and 911*b*, and the like.

The coupling lens 915 is a lens formed by glass having a focal length of 46.5 mm and a thickness (d2 in FIG. 9) of 3.0 mm, for example. The coupling lens 915 converts light beams emitted from the light source 914 into approximately parallel light. The aperture member 916 has an opening portion of an elliptical shape or a rectangular shape having a width of 5.8 mm in the direction corresponding to the main-scanning direction and a width of 1.22 mm in the direction corresponding to the sub-scanning direction, for example. The aperture member 916 regulates a beam diameter of light beam coming through the coupling lens 915. The opening portion will be described in detail later in conjunction with a light amount monitor that will be described later. The cylindrical lens 917 is a lens formed by glass having a focal length of 106.9 mm and a thickness (d5 in FIG. 9) of 3.0 mm, for example. The cylindrical lens 917 focuses the light beam having passed through the opening portion of the aperture member 916 on a position near a deflection reflective surface of the polygon mirror 913 with respect to the sub-scanning direction. The polygon mirror 913 is a four-faced mirror having an inscribed circle radius of 7 mm, for example, and rotates about an axis parallel to the sub-scanning direction at a constant velocity. The scanning lens 911*a* is a lens formed by a resin having a thickness (d8 in FIG. 9) of 13.50 mm at the center (on the optical axis), for example. The scanning lens 911*b* is a lens formed by a resin having a thickness (d10 in FIG. 9) of 3.50 mm at the center (on the optical axis), for example.

The optical system disposed on the optical path between the light source 914 and the polygon mirror 913 is also referred to as a coupling optical system. In the present embodiment, for example, the coupling optical system includes the coupling lens 915, the aperture member 916, and the cylindrical lens 917. The optical system disposed in the optical path between the polygon mirror 913 and the photosensitive element 20 is also referred to as a scanning optical system. In the embodiment, for example, the scanning optical system includes the scanning lenses 911*a* and 911*b*. A lateral magnification of the scanning optical system in the sub-scanning direction is 0.97, for example. Moreover, the lateral magnification of the entire optical system of the exposing unit 900 in the sub-scanning direction is 2.2, for example.

In the present embodiment, the diameter of a target beam spot formed on the surface of the photosensitive element 20, for example, is 52 μm in the main-scanning direction and 55 μm in the sub-scanning direction. Moreover, the distance (d1 in FIG. 9) between the light source 914 and the coupling lens 915, for example, is 46.06 mm, the distance (d3 in FIG. 9) between the coupling lens 915 and the aperture member 916 is 47.69 mm, the distance (d4 in FIG. 9) between the aperture member 916 and the cylindrical lens 917 is 10.32 mm, and the distance (d6 in FIG. 9) between the cylindrical lens 917 and the polygon mirror 913 is 128.16 mm. Moreover, the distance (d7 in FIG. 9) between the polygon mirror 913 and a first face (light-entering surface) of the scanning lens 911*a* is 46.31 mm, the distance (d9 in FIG. 9) between a second surface (light-exiting surface) of the scanning lens 911*a* and a first face (light-entering surface) of the scanning lens 911*b* is 89.73 mm, and the distance (d11 in FIG. 9) between a second surface (light-exiting surface) of the scanning lens 911*b* and the surface of the photosensitive element 20 which is a surface to be scanned is 141.36 mm, for example. Furthermore, a length (d12 in FIG. 9) of an effective scanning area W1 on the photosensitive element 20 is 323 mm. In addition, an angle θ in FIG. 9 is 60°.

Figure 10:
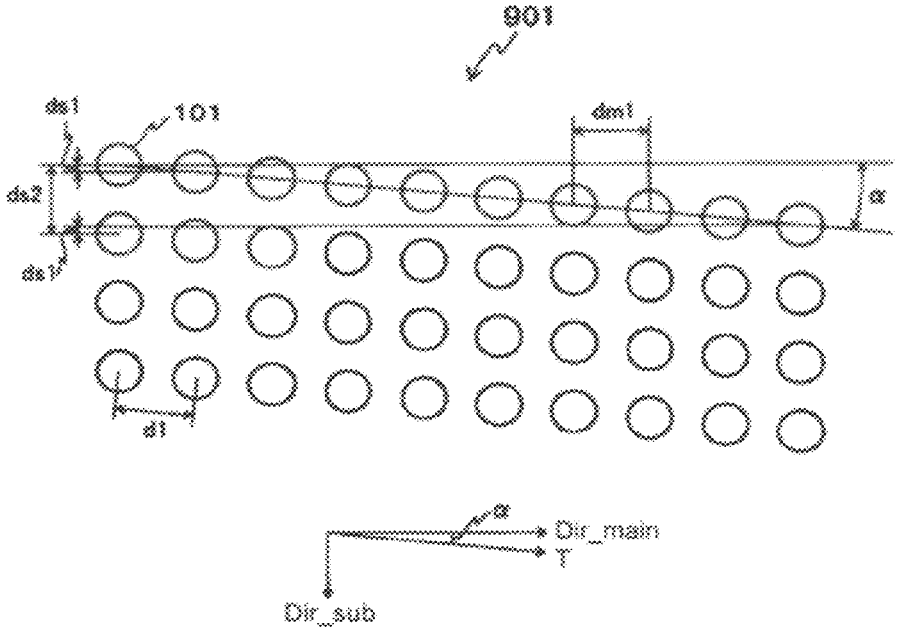
FIG. 10 is an explanatory diagram illustrating a two-dimensional array used as a light source.

As illustrated in FIG. 10, the light source 914 may include a two-dimensional array 901 in which forty light-emitting portions 101 are formed on a substrate, for example. The two-dimensional array 901 includes four rows of ten light-emitting portions 101 arranged at regular intervals along a direction (third direction, hereinafter appropriately referred to as a "T direction") which is tilted at an angle of α from a direction (first direction, hereinafter appropriately referred to as a "Dir_main direction") corresponding to the main-scanning direction toward a direction (second direction, hereinafter referred to as a "Dir_sub direction") corresponding to the sub-scanning direction. Moreover, these four rows of light-emitting portions are arranged at regular intervals in the Dir_sub direction. That is, forty light-emitting portions 101 are arranged two-dimensionally in a plane spanned by two axes respectively along the T direction and Dir_sub direction.

Moreover, for example, spacing (ds2 in FIG. 10) between adjacent rows of light-emitting portions in the Dir_sub direction is 48.0 μm, and spacing (d1 in FIG. 10) of light-emitting portions in the T direction in each row of light-emitting portions is 48.0 μm. Moreover, when each of the light-emitting portions 101 is orthogonally projected onto an imaginary line extending in the Dir_sub direction, spacing (ds1 in FIG. 10) between the light-emitting portions 101 is 4.8 μm. That is, a relation of ds2=d1 and a relation of ds2=ds1×M (M is an integer) are satisfied.

Next, details of a light amount monitor that detects an amount of light emitted from the light source 914 are described.

Figure 11:
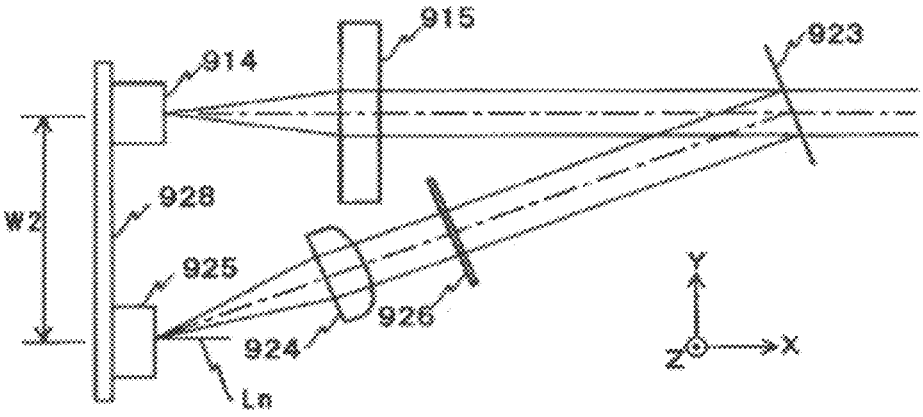
FIG. 11 is an explanatory diagram illustrating a light amount monitoring unit.

FIG. 11 is an explanatory diagram illustrating the light amount monitoring unit. A light amount monitoring optical system includes the light source 914, the coupling lens 915, a first opening plate 923, a second opening plate 926, a focus lens 924, a photodiode 925, and a substrate 928.

Figure 12A:
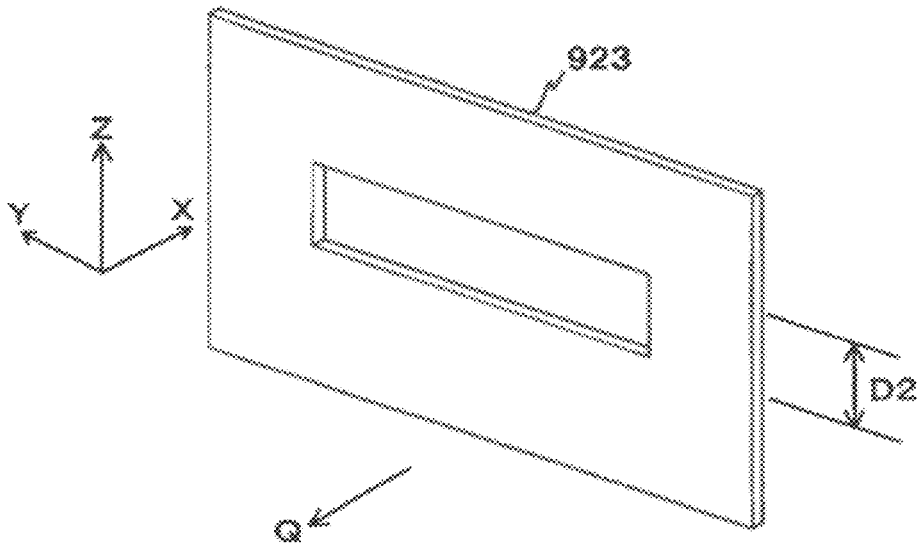
FIG. 12A is a perspective view illustrating a first opening plate.
Figure 12B:
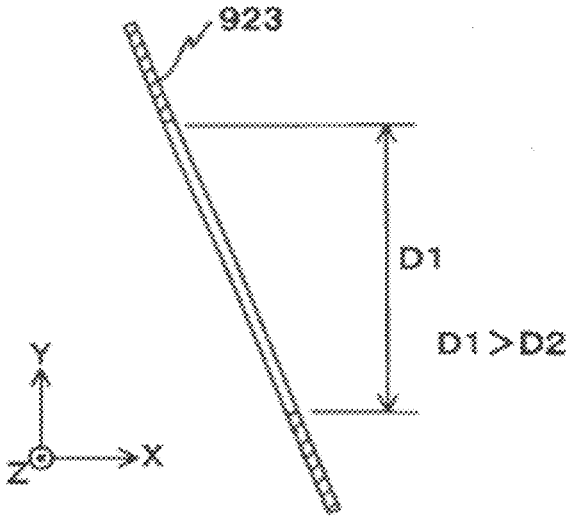
FIG. 12B is a cross-sectional view taken along the X-Y plane in FIG. 12A.

As illustrated in FIG. 12A, the first opening plate 923 has an opening portion, and regulates a beam diameter of the light beam coming through the coupling lens 915. The first opening plate 923 is disposed so that a light beam having the maximum light intensity passes substantially through the center of the opening portion. Moreover, a reflection member is disposed around the opening portion of the first opening plate 923. The first opening plate 923 is tilted from a imaginary plane, which is perpendicular to the travelling direction of the light beam coming through the coupling lens 915 so that the light beam reflected by the reflection member disposed around the opening portion can be used as a monitoring light beam. That is, the first opening plate 923 allows a central light beam having a higher light intensity among the light beams emitted from the light source 914 to pass through the opening portion and reflects (splits) a peripheral light beam having a lower light intensity as a monitoring light beam. In the following description, for the sake of convenience, the travelling direction of the monitoring light beam reflected by the first opening plate 923 is referred to as a "Q direction." In this example, as illustrated in FIGS. 12A and 12B, a length D2 of the opening portion of the first opening plate 923 in the direction (in this example, the Z-axis direction) corresponding to the sub-scanning direction is 1.28 mm, and a length D1 in the direction (in this example, the Y-axis direction) corresponding to the main-scanning direction is 5.8 mm. That is, D1>D2. FIG. 12B is a cross-sectional view taken along the X-Y plane that passes through the center of the opening portion.

Figure 13:
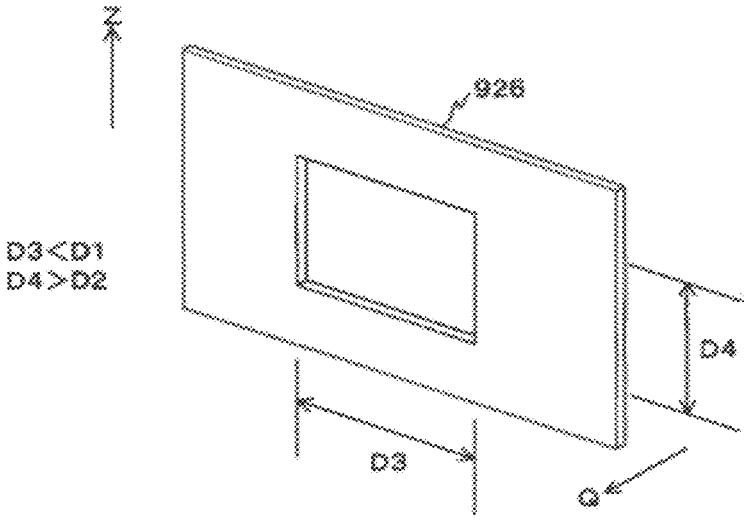
FIG. 13 is a perspective view illustrating a second opening plate.

The second opening plate 926 is disposed on an optical path of the monitoring light beam reflected by the first opening plate 923. The second opening plate 926 has an opening portion that regulates a beam diameter of the monitoring light beam as illustrated in FIG. 13. Moreover, the second opening plate 926 is disposed at an optical position near a focal position of the coupling lens 915. Accordingly, if the monitoring light beam includes multiple beams, the main light beams of the respective light beams are guided to the opening portion of the second opening plate 926, and the respective light beams are shaped into the same shape. A length D4 of the opening portion of the second opening plate 926 in the direction (in this example, the Z-axis direction) corresponding to the sub-scanning direction is 3.25 mm and a length D3 in the direction perpendicular to the Z-axis direction is 3.8 mm. That is, D3<D1 and D4>D2.

Figure 14A:
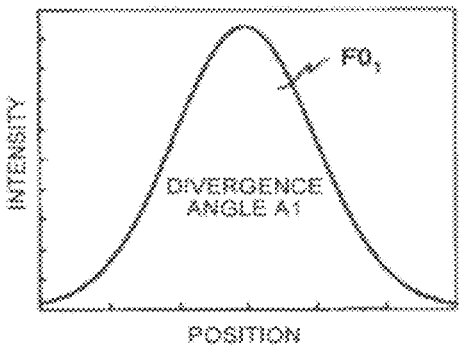
FIG. 14A is an explanatory diagram illustrating a light intensity distribution of a light beam $F0_1$.
Figure 14B:
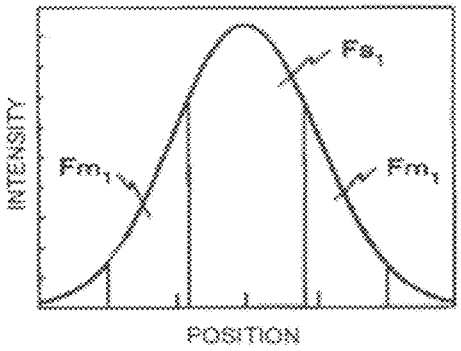
FIG. 14B is an explanatory diagram illustrating the distribution of light beams passing through the respective opening plates.

For example, when the light source 914 outputs a light beam $F0_1$ having a divergence angle of A1 as illustrated in FIG. 14A, a portion of the light beam $F0_1$ belonging to a region $Fs_1$ passes through the opening portion of the first opening plate 923, and another portion of the light beam $F0_1$ belonging to one of regions $Fm_1$ passes through the opening portion of the second opening plate 926 as illustrated in FIG. 14B.

Figure 15A:
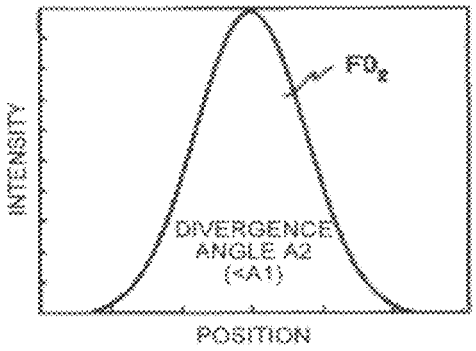
FIG. 15A is an explanatory diagram illustrating a light intensity distribution of a light beam $F0_2$.
Figure 15B:
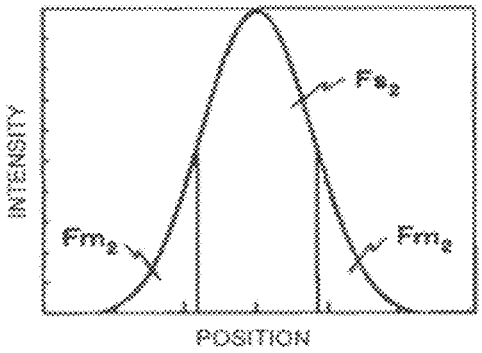
FIG. 15B is an explanatory diagram illustrating the distribution of light beams passing through the respective opening plates.

Moreover, for example, when the light source 914 outputs a light beam $F0_2$, which has a light intensity distribution having a higher peak at the center than the light beam $F0_1$ and a divergence angle A2 (A2<A1) as illustrated in FIG. 15A, a portion of the light beam $F0_2$ belonging to a region $Fs_2$ passes through the opening portion of the first opening plate 923, and another portion of the light beam $F0_2$ belonging to one of regions $Fm_2$ passes through the opening portion of the second opening plate 926 as illustrated in FIG. 15B.

Figure 16A:
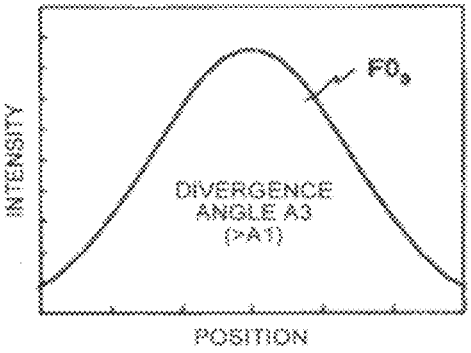
FIG. 16A is an explanatory diagram illustrating a light intensity distribution of a light beam $F0_3$.
Figure 16B:
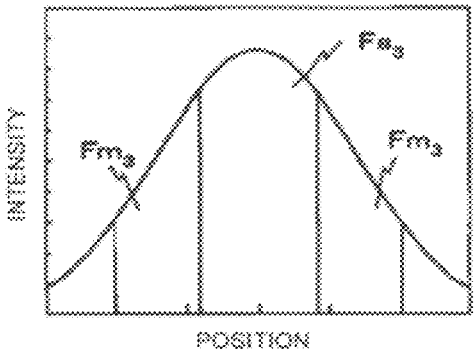
FIG. 16B is an explanatory diagram illustrating the distribution of light beams passing through the respective opening plates.

Moreover, when the light source 914 outputs a light beam $F0_3$, which has a light intensity distribution having a lower peak at the center than the light beam $F0_1$ and a divergence angle A3 (A3>A1) as illustrated in FIG. 16A, a light beam portion $Fs_3$ of the light beam $F0_3$ passes through the opening portion of the first opening plate 923, and a light beam portion $Fm_3$ passes through the opening portion of the second opening plate 926 as illustrated in FIG. 16B.

Figure 17:
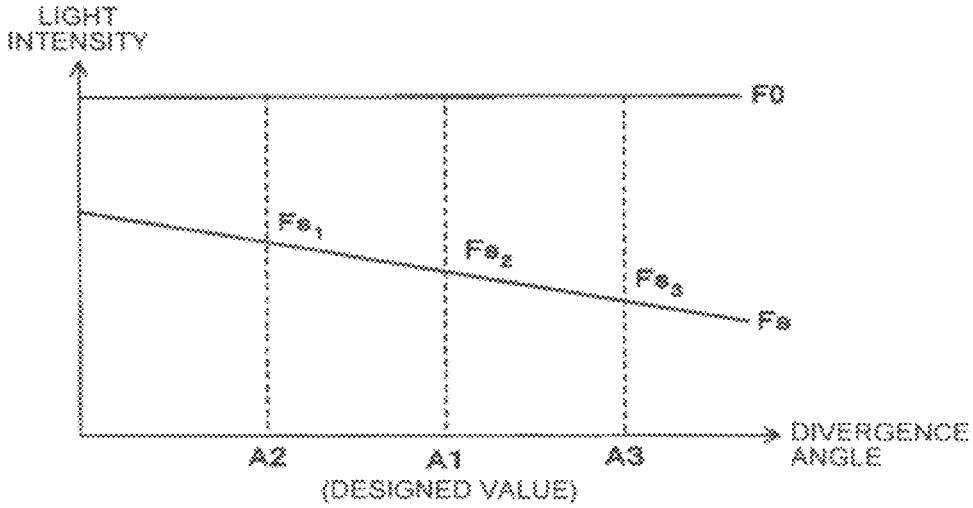
FIG. 17 is a graph illustrating the relation between divergence angles and light intensities of the light beams F0 and Fs when the light amount of the light beam F0 is assumed to be constant.

If the divergence angle of a light beam (light beam F0) output from the light source 914 increases, a light intensity of a light beam (light beam Fs) passing through the opening portion of the first opening plate 923 decreases as illustrated in FIG. 17, for example. In this example, it is assumed that the light intensity of the light beam F0 remains constant even when the divergence angle changes.

Figure 18:
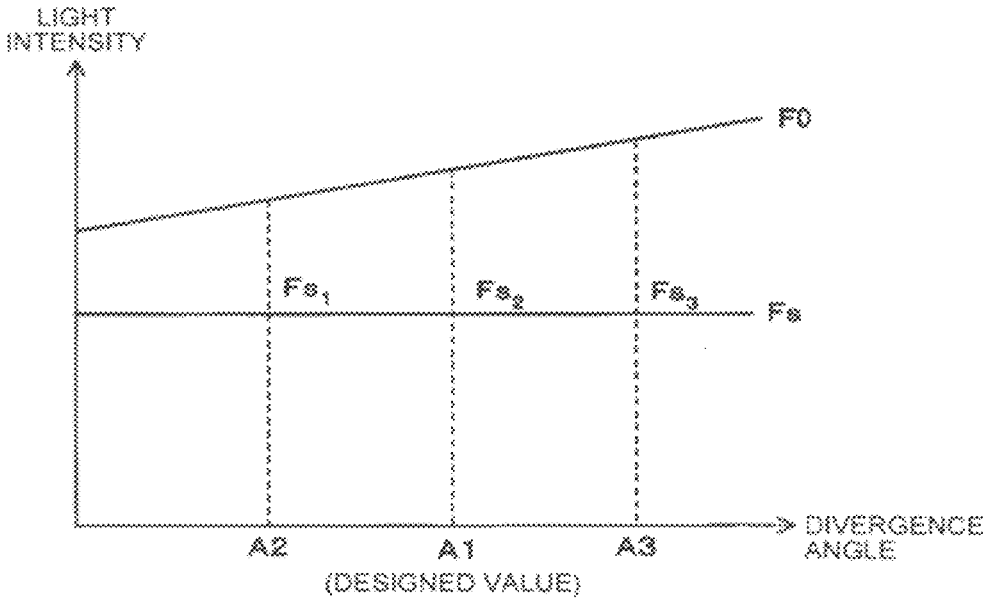
FIG. 18 is a graph illustrating the relation between the divergence angles and the light intensities of the light beams F0 and Fs when the light amount of the light beam Fs is adjusted to be constant.
Figure 19:
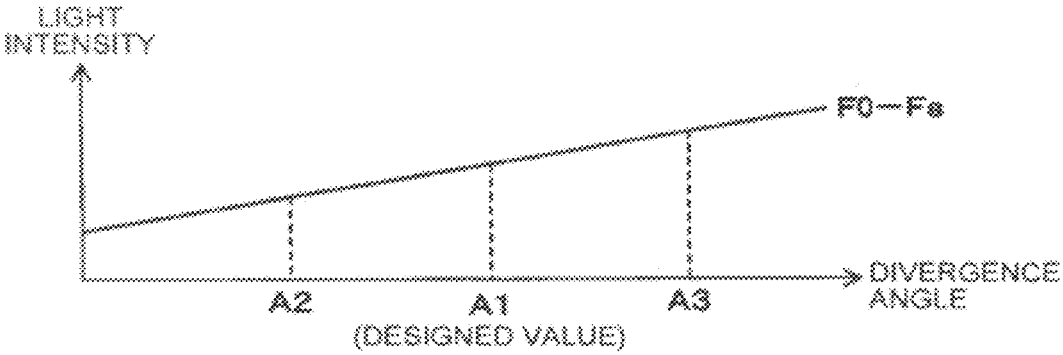
FIG. 19 is a graph illustrating the relation between the divergence angle of the light beam F0 and the light amount of the light beam reflected by the first opening plate.

Therefore, in order to keep the light amount of the light beam Fs constant, the light amount of the light beam F0 needs to be increased when the divergence angle of the light beam F0 is larger than a designed value (denoted by A1 in this example), whereas the light amount of the light beam F0 needs to be decreased when the divergence angle of the light beam F0 is smaller than the designed value as illustrated in FIG. 18, for example. In this case, the light amount of a light beam (hereinafter, referred to as "light beam (F0-Fs)") reflected by the first opening plate 923 increases as the divergence angle of the light beam F0 increases as illustrated in FIG. 19, for example. If the second opening plate 926 is not present, the light beam (F0-Fs) is received by the photodiode 925. In this case, when automatic exposure power control (Auto Power Control, hereinafter referred to APC) is performed in a manner similar to the related art, the light amount of the light beam F0 is controlled to be further decreased when the divergence angle of the light beam F0 is A3, for example, and the light amount of the light beam F0 is controlled to be further increased when the divergence angle of the light beam F0 is A2, for example. As a result, the light amount of the light beam Fs may deviate from the above-mentioned constant value. That is, the accuracy of APC decreases.

Figure 20:
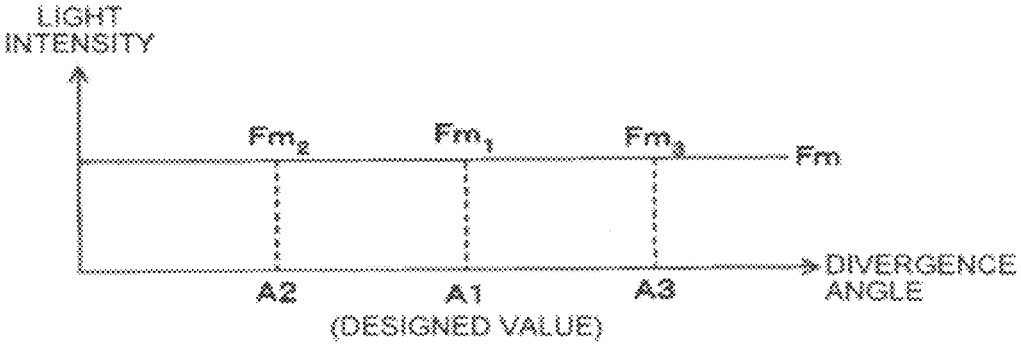
FIG. 20 is a graph illustrating the relation between the divergence angle of the light beam F0 and light amount of light beam received by a photodiode.

In the present embodiment, the second opening plate 926 is disposed on the optical path of the monitoring light beam reflected by the first opening plate 923 so as to shape the monitoring light beam reflected by the first opening plate 923. As a result, for example, as illustrated in FIG. 20, the light amount of a light beam (light beam Fm) received by the photodiode 925 can be kept constant, similarly to the light amount of the light beam Fs, even when a divergence angle of the light beam F0 changes.

Moreover, the opening portion of the first opening plate 923 and the opening portion of the second opening plate 926 satisfy the relations of "D3<D1" and "D4>D2." As a result, even if the divergence angle of the light beam F0 changes greatly, a ratio of "the light amount of the light beam Fs" to "the light amount of the light beam Fm" can be kept substantially constant.

Meanwhile, a reception light amount (the light amount of the light beam Fm) of the photodiode 925 can be increased with an increase in the opening diameter D4 of the opening portion of the second opening plate 926 in the direction corresponding to the sub-scanning direction.

Figure 21:
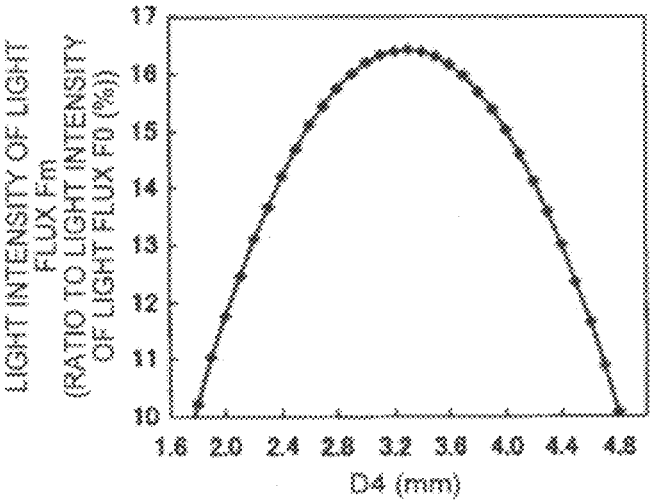
FIG. 21 is a graph illustrating the relation between D4 and the light amount of a light beam Fm when a ratio of the light amount of the light beam Fs to the light amount of the light beam Fm is set to be constant.

FIG. 21 illustrates the relation between D4 and the light amount of the light beam Fm when the ratio of "the light amount of the light beam Fs" to "the light amount of the light beam Fm" is constant. As illustrated in FIG. 21, the light amount of the light beam Fm increases when D4 increases, whereas the light amount of the light beam Fm decreases when D4 exceeds a certain value. This is because if D4 is increased too much, D3 needs to be decreased so as to maintain the ratio of "the light amount of the light beam Fs" to "the light amount of the light beam Fm."

When D4 is 1.4 to 3.7 times as large as D2, the light amount of the light beam Fm exceeds 10% of the light amount of the light beam F0. For example, when the amount of luminescence of the light source 914 is 1 mW, the reception light amount of the photodiode 925 becomes equal to or greater than 0.1 mW. Thus, the light amount with favorable accuracy may be detected without causing a decrease in an S/N ratio of the output signal of the photodiode 925 or a delay in a response time. In the present embodiment, D3=3.8 mm and D4=3.25 mm are used so that the light amount of the light beam Fm illustrated in FIG. 21 can be maximized.

Figure 22:
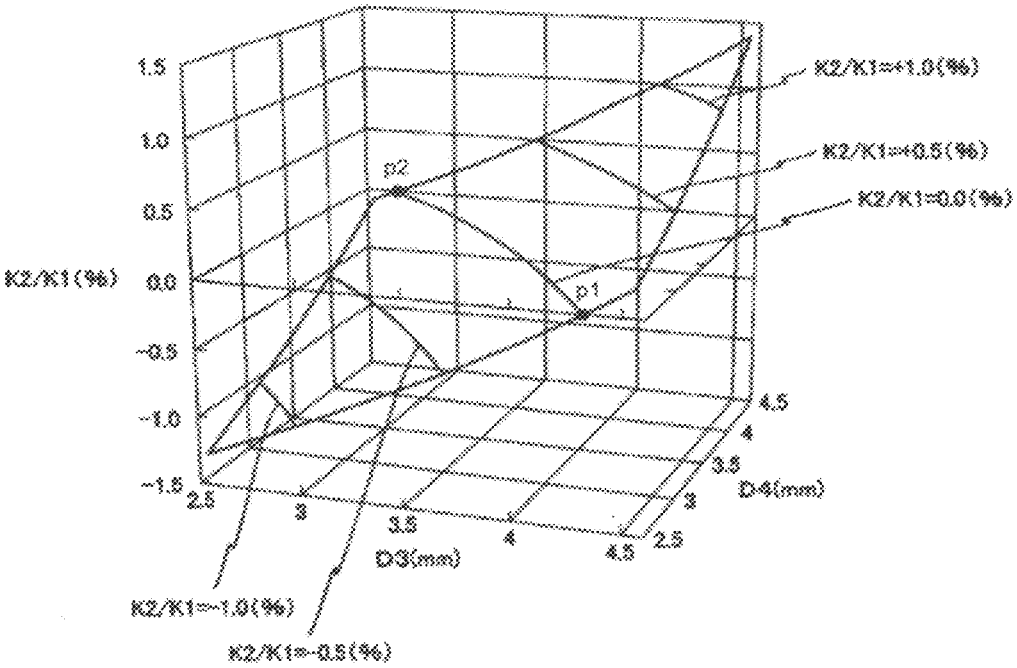
FIG. 22 is a graph illustrating the relations among D3, D4, and K2/K1.

Moreover, FIG. 22 illustrates the relation among D3, D4, and a ratio K2/K1. Here, K1 is the ratio of "the light amount of the light beam Fs" to "the light amount of the light beam Fm" when the divergence angle of the light beam F0 is a predetermined divergence angle (for example, A1), and K2 is the ratio of "the light amount of the light beam Fs" to "the light amount of the light beam Fm" when the divergence angle of the light beam F0 is changed isotropically from the predetermined divergence angle in the direction corresponding to the main-scanning direction and the direction corresponding to the sub-scanning direction.

As is clear from FIG. 22, when D3 is kept constant and D4 is increased, the ratio K2/K1 increases. Moreover, when D4 is kept constant and D3 is decreased, the ratio K2/K1 decreases. By using this relation, a combination of D3 and D4 which satisfies the relation of K2/K1=0.0% is obtained, that is, the combination that keeps the ratio of "the light amount of the light beam Fs" to "the light amount of the light beam Fm" constant even if the divergence angle of the light beam F0 changes. As illustrated in FIG. 22, a curve of K2/K1=0.0%, connecting p1 (D3=4.3 mm, D4=2.5 mm) and p2 (D3=2.7 mm, D4=4.5 mm), can be obtained. In general, because a change in the light amount by 3% or more is recognizable as density unevenness on an image, it is preferable that a change of K2/K1 is within 3%. In this way, a variation in the detected light amount due to a change in the divergence angle of the light beam F0 can be kept within ±3%. That is, when the divergence angle of a light beam emitted from a light source changes isotropically, the light amount of the light beam Fs changes from Ps to Ps+ΔPs, and the light amount of the light beam Fm changes from Pm to Pm+ΔPm, the value of {(Ps+ΔPs)/(Pm+ΔPm)}/(Ps/Pm) is preferably in a range between 0.97 and 1.03.

When D4 is 1.4 to 3.7 times as large as D2, a sufficient reception light amount of the photodiode 925 may be secured. Moreover, the ratio of "the light amount of the light beam Fs" to "the light amount of the light beam Fm" can be kept substantially constant even if the divergence angle changes. That is, even if the divergence angle changes greatly, the light amount of the light beam Fm rarely changes if the light amount of the light beam Fs is kept constant. Therefore, when the light amount of the light beam F0 is controlled so that the output level of the photodiode 925 is constant (at a predetermined level), the light amount of the light beam Fs can always be kept constant.

The focus lens 924 is disposed at a position separated by 20 mm from the second opening plate 926 with respect to the Q direction and focuses the monitoring light beam having passed through the opening portion of the second opening plate 926. The focus lens 924 has a focal length of 27 mm, for example.

The photodiode 925 is disposed at a position separated by 10.6 mm from the focus lens 924 with respect to the Q direction and receives the monitoring light beam coming through the focus lens 924. The photodiode 925 outputs a signal (photoelectrically converted signal) corresponding to the reception light amount. In this example, the light receiving surface of the photodiode 925 has a square shape with a side length of 1.1 mm, and is set so as to receive light at the center of the light receiving surface.

For example, when an accreted material or a scratch is present on the light receiving surface of the photodiode 925 and light focuses on that portion, the reception light amount decreases greatly, and a correct signal is not output. Therefore, when the light receiving surface of the photodiode 925 is disposed at a position separated slightly from the focal position of the focus lens 924 with respect to the Q direction, the beam diameter on the light receiving surface increases. As a result, a large decrease in the reception light amount may be suppressed even when an accreted material or a scratch is present on the light receiving surface.

Figure 23:
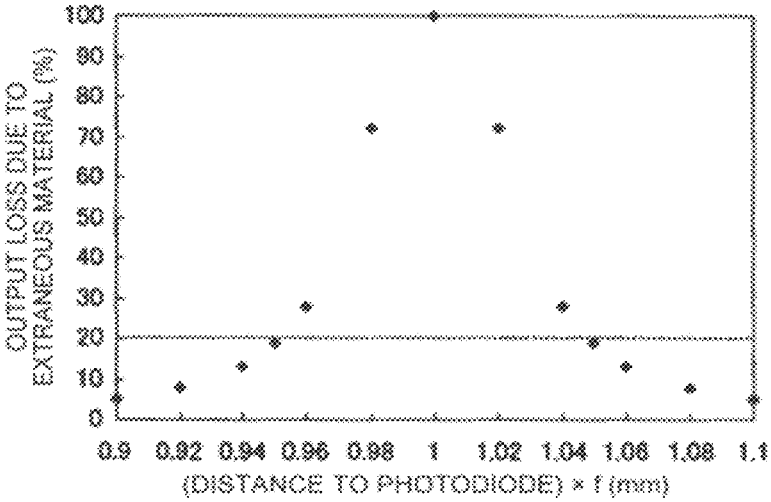
FIG. 23 is a graph illustrating the relation between a distance from a focus lens to a photodiode and an amount of decrease in output of the photodiode when an accreted material adheres to the center of a light receiving surface.

FIG. 23 is a view illustrating the relation between the amount of decrease in the output of the photodiode 925 and the distance between the focus lens 924 and the photodiode 925 when an accreted material (having a diameter ϕ of 50 μm) that can be recognized by a visual observation adheres to the center of the light receiving surface of the photodiode 925. In FIG. 23, "f" is the focal length of the focus lens 924.

When the distance between the focus lens 924 and the photodiode 925 is set to be equal to or smaller than "f×0.95", or to be equal to or greater than "f×1.05", the decrease in the output of the photodiode 925 is 20% or less even if an accreted material having a diameter ϕ of 50 μm adheres to the center of the light receiving surface of the photodiode 925. Such a decrease in the output is within the range to be sufficiently covered by correcting the light amount of the light source 914 during an adjustment operation before shipping. Therefore, in the present embodiment, the distance between the focus lens 924 and the photodiode 925 is set to "f×1.06."

Moreover, if the monitoring light beam enters the light receiving surface of the photodiode 925 in the direction perpendicular to the light receiving surface, the reflection light reflected from the light receiving surface may return to the light source 914 along the reverse optical path from the incident light. Therefore, in the present embodiment, as illustrated in FIG. 11, the direction of a normal line (Ln in FIG. 11) of the light receiving surface at the reception position of the monitoring light beam is tilted relative to the incidence direction of the incident light so that the reflection light from the light receiving surface does not return to the light source 914. Specifically, the angle of incidence is set to 10°.

Moreover, a lateral magnification β of an optical system provided between the light source 914 and the photodiode 925 is about 0.5, and the size in the longitudinal direction of the two-dimensional array 901 is 0.3 mm. Therefore, the two-dimensional array 901 projected onto the light receiving surface of the photodiode 925 has a dimension of 0.3 mm×0.5=0.15 mm.

In general, detection sensitivity of a photodiode varies depending on the light receiving position. Accordingly, it is preferable that light is always received at a position near the center of the light receiving surface.

Figure 24:
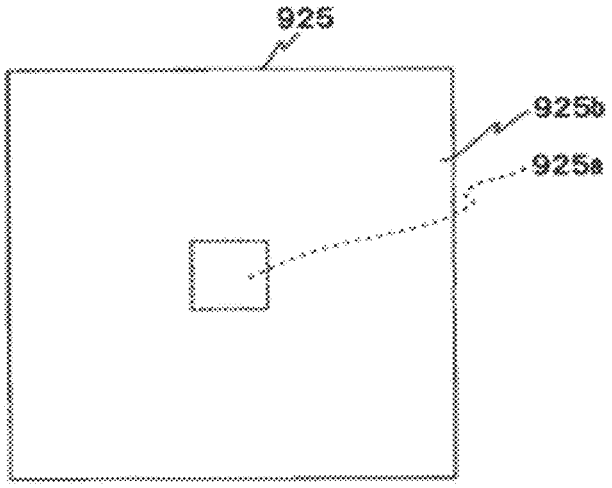
FIG. 24 is an explanatory diagram illustrating a light receiving surface and a light receiving region of a photodiode.

In the present embodiment, for example, as illustrated in FIG. 24, the photodiode 925 has a light receiving surface **925*b* having a size of 1.1 mm by 1.1 mm and light is received at a light receiving region 925*a* that is disposed to be close to the center of the light receiving surface 925*b* and is present at a distance of less than a half of the size (1.1 mm) of the light receiving surface 925*b*. That is, when the length in the longitudinal direction of the two-dimensional array 901 is denoted by L, and the length of the photodiode 925 in the direction corresponding to the longitudinal direction is denoted by L', a relation of (L×β)≤(L'×0.5) is satisfied. With this configuration, the photodiode 925** can always receive light with constant detection sensitivity.

Moreover, in the present embodiment, for example, as illustrated in FIG. 11, the light source 914 and the photodiode 925 are mounted on the same substrate 928.

Next, the details of a surface-emitting laser used in the present embodiment will be described.

The surface-emitting laser array of the present embodiment can be prepared in the following manner. An example of the structure of a 780-nm surface-emitting laser is described. The surface-emitting laser uses a current confining structure in which an AlAs layer is selectively oxidized. The wavelength can be selected in accordance with the sensitivity characteristics of a photosensitive element.

Figure 25:
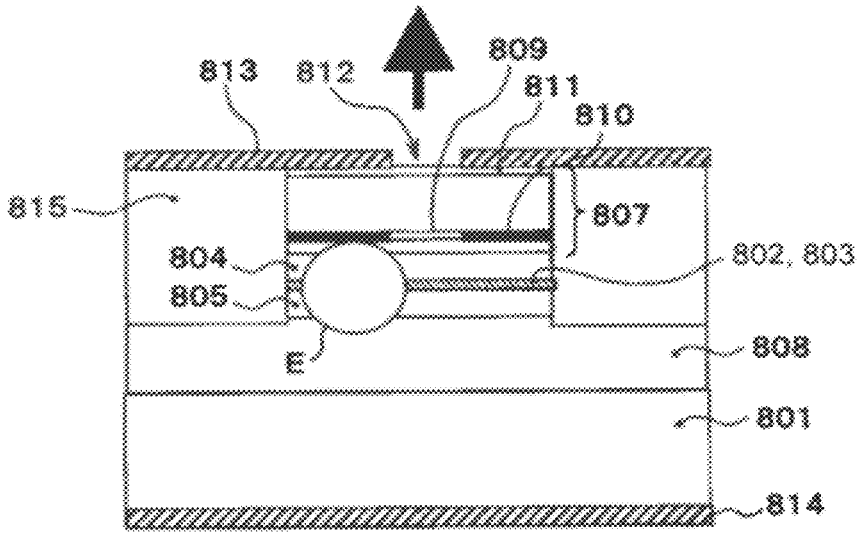
FIG. 25 is a schematic drawing of a cross-section on the structure of a surface-emitting laser array.

FIG. 25 is a schematic drawing of a cross-section on the structure of a surface-emitting laser array.

Figure 26:
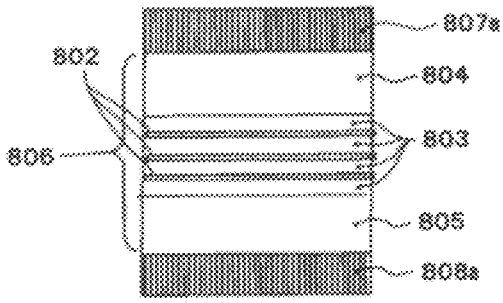
FIG. 26 is an enlarged explanatory diagram illustrating a region E in FIG. 25.

Moreover, FIG. 26 is an enlarged explanatory diagram illustrating a region E in FIG. 25 around active layers 804 and 805.

The surface-emitting laser has a configuration in which a resonator region 806 is disposed on an n-GaAs substrate 801 so as to be sandwiched between a lower reflection mirror 808 and an upper reflection mirror 807. The resonator region 806 includes active layers formed by an $Al_{0.12}Ga_{0.88}As$ quantum well layer 802 and an $Al_{0.3}Ga_{0.7}As$ barrier layer 803. The resonator region 806 includes an $Al_{0.6}Ga_{0.4}As$ upper spacer layer 804 and an $Al_{0.6}Ga_{0.4}As$ lower spacer layer 805 and has an optical thickness corresponding to one wavelength λ. The lower reflection mirror 808 includes 40.5 pairs of n-$Al_{0.3}Ga_{0.7}As$ high refractive index layers and n-$Al_{0.9}Ga_{0.1}As$ low refractive index layers, in which each layer has an optical thickness corresponding to λ/4. The upper reflection mirror 807 includes 24 pairs of p-$Al_{0.3}Ga_{0.7}As$ high refractive index layers and p-$Al_{0.9}Ga_{0.1}As$ low refractive index layers. As illustrated in FIG. 26, an $Al_{0.9}Ga_{0.1}As$ low refractive index layer **807*a* (thickness: λ/4) is provided at the bottom of the upper reflection mirror 807, and an $Al_{0.9}Ga_{0.1}As$ low refractive index layer 808*a* (thickness: λ/4) is provided at the top of the lower reflection mirror 808. Moreover, the upper reflection mirror 807 includes an AlAs selective oxidation layer 809 (current injection portion), which is separated by λ/4 from the resonator region 806**. Moreover, a composition slope layer in which the composition changes gradually is disposed between the respective layers of the reflection mirrors so as to reduce resistance. For the crystal growth of the above described layers, a metal organic chemical vapor deposition (MOCVD) method or a molecular-beam epitaxy (MBE) method can be utilized.

Subsequently, a dry etching method is performed to form a mesa shape. In this case, an etching surface is generally made to reach the lower reflection mirror 808. Subsequently, the AlAs selective oxidation layer 809 having side surfaces exposed by the etching process undergoes a thermal process in a vapor atmosphere so that an periphery of the AlAs selective oxidation layer 809 is oxidized to form an $Al_xO_y$ insulating layer ($Al_xO_y$ current confining layer 810). In this way, a current confining structure is formed in which an element drive current can flow only into the non-oxidized AlAs region located at the center of the AlAs selective oxidation layer 809. Subsequently, a $SiO_2$ protective layer (not illustrated) is formed on the AlAs selective oxidation layer 809, and the etched portion is filled with polyimide so as to flatten the layer. An insulating film 815 formed by polyimide above the upper reflection mirror 807 that includes a p-GaAs contact layer 811 and a light emitting portion 812 as well as the $SiO_2$ protective layer (not illustrated) are removed. In this way, a p-side individual electrode 813 is formed on the p-GaAs contact layer 811 on an area different from the light emitting portion 812, and an n-side common electrode 814 is formed on the back side.

In the present embodiment, the mesa portion formed by the dry etching method becomes a surface-emitting laser device. In the present embodiment, an array arrangement can be realized by forming a photomask corresponding to the array arrangement of the present embodiment and forming an etching mask by a typical photolithographic process, and performing an etching process. It is preferable to provide spacing of 5 μm or more between elements so as to realize electrical and spatial separation between the respective elements of the array. If the spacing is too small, it becomes difficult to control the etching process. Moreover, the mesa portion may have an arbitrary shape other than a circular shape as in the present embodiment, such as an elliptical shape, a square shape, or a rectangular shape. Moreover, the mesa portion preferably has a size (for example, diameter) of 10 μm or more. If the size is too small, heat may accumulate when the device operates to deteriorate a functional property.

Moreover, because the element-to-element spacing is increased in the main scanning direction which does not affect an increase in the density of elements in the sub-scanning direction, it is possible to suppress the influence of heat interference between respective elements and secure a space necessary for wiring the respective elements.

The 780-nm surface-emitting laser described above may be prepared using other materials.

Figure 27:
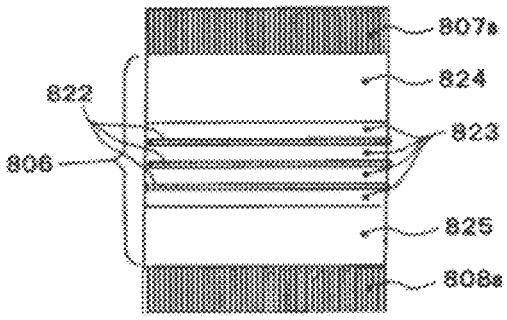
FIG. 27 is an enlarged explanatory diagram illustrating the region E in FIG. 25 when different materials from those used in FIG. 26 are used.

FIG. 27 is an enlarged explanatory diagram illustrating the region E in FIG. 25, which surrounds the active layers 804 and 805, in which materials different from those used in FIG. 26 are used.

As illustrated in FIG. 27, the active layer includes a GaInPAs quantum well active layer 822 and a $Ga_{0.6}In_{0.4}P$ tensile-strain barrier layer 823. The GaInPAs quantum well active layer 822 includes three layers having a compressive strain structure and a bandgap wavelength of 780 nm. The $Ga_{0.6}In_{0.4}P$ tensile-strain barrier layer 823 includes four lattice-matched layers having a tensile strain structure. Moreover, the active layer includes a cladding layer (the spacer layer in the present embodiment) for trapping electrons, which uses $(Al_{0.7}Ga_{0.3})_{0.5}In_{0.5}P$ having a wide bandgap. The cladding layer includes an $(Al_{0.7}Ga_{0.3})_{0.5}In_{0.5}P$ upper spacer layer 824 and an $(Al_{0.7}Ga_{0.3})_{0.5}In_{0.5}P$ lower spacer layer 825. In this way, an extremely high bandgap difference between the cladding layers 824 and 825 and the GaInAs quantum well active layer 822 can be obtained as compared to a case where the cladding layers 824 and 825 for trapping carriers are formed using AlGaAs. The other configurations are the same as those of FIG. 26.

Table 1 illustrates a bandgap difference between a spacer layer and a well layer, and a bandgap difference between a barrier layer and a well layer generated with the typical material compositions of 780-nm and 850-nm surface-emitting-type semiconductor lasers using AlGaAs (spacer layer) and AlGaAs (quantum well active layer) and a 780-nm surface-emitting-type semiconductor laser using AlGaInP (spacer layer) and GaInPAs (quantum well active layer). The spacer layer is typically a layer provided between an active layer and a reflection mirror and is a layer that functions as a cladding layer for trapping carriers.

TABLE 1

| Wavelength | | 780 [nm] | | 850 [nm] (Ref.) |
|---|---|---|---|---|
| Spacer layer/quantum well active layer | | AlGaAs/AlGaAs material | AlGaInP/GaInPAs material | AlGaAs/GaAs material |
| Spacer layer | | $Al_{0.6}Ga_{0.4}As$ (Eg = 2.0226 [eV]) | $(AlxGa_{1-x})_{0.5}In_{0.5}P$ (Eg(x = 0.7) = 2.324 [eV]) | $Al_{0.6}Ga_{0.4}As$ (Eg = 2.0226 [eV]) |
| Active layer | Quantum well active layer | $Al_{0.12}Ga_{0.88}As$ (Eg = 1.5567 [eV]) | GaInPAs (compressive strain) (Eg = 1.5567 [eV]) | GaAs (Eg = 1.42 [eV]) |
| | Barrier layer | $Al_{0.3}Ga_{0.7}As$ (Eg = 1.78552 [eV]) | $Ga_xin_{1-x}p$ (tensile strain) (Eg(x = 0.6) = 2.02 [ev]) | $Al_{0.3}Ga_{0.7}As$ (Eg = 1.78552 [eV]) |
| Energy (Eg) difference (ΔEg) between spacer layer and well layer | | 465.9 [meV] | 767.3 [meV] | 602.6 [meV] |
| Energy (Eg) difference (ΔEg) between barrier layer and well layer | | 228.8 [meV] | 463.3 [meV] | 365.5 [meV] |

As illustrated in Table 1, it can be understood that the 780-nm surface-emitting-type semiconductor laser using AlGaInP (spacer layer) and GaInPAs (quantum well active layer) has a greater bandgap difference than the 780-nm surface-emitting-type semiconductor laser using AlGaAs/AlGaAs and the 850-nm surface-emitting-type semiconductor laser using AlGaAs/AlGaAs.

Specifically, the bandgap difference between a cladding layer and an active layer is 767 meV, which is extremely greater than 466 meV in the case where the cladding layer is formed of AlGaAs (Al composition ratio is 0.6). Similarly, the bandgap difference between a barrier layer and an active layer has a greater value, and a favorable carrier trapping property can be obtained.

Moreover, because the active layer has a compressive strain structure, the gain is increased greatly due to a band separation of heavy holes and light holes. With this configuration, a higher gain is attained, and a higher output can be obtained at a lower threshold value. This effect is not obtained in the 780-nm or 850-nm surface-emitting laser using AlGaAs having a lattice constant substantially the same as a GaAs substrate. Moreover, by improving carrier trapping properties, and obtaining a lower threshold value by a higher gain obtained by a strained quantum well active layer, a reflection rate at a light extracting-side DBR can be reduced, and a higher output can be obtained. Moreover, if the gain is increased as in the present embodiment, a decrease in the optical output due to a temperature rise can be suppressed and further the element-to-element spacing of the array can be decreased.

Moreover, because the active layer and the barrier layer are formed of materials that do not contain Al so as to form an Al-free active region (the quantum well active layer and the adjacent layers), incorporation of oxygen may be reduced. Therefore, the formation of a nonradiative recombination center may be suppressed and the lifetime of the device may be extended. As a result, a writing unit or a light source unit can be reused.

Next, the details of a photosensitive element according to the present embodiment will be described.

Example of Preparing Photosensitive Element Synthesis of Titanyl Phthalocyanine Crystal A titanyl phthalocyanine crystal was prepared in accordance with Embodiment 1 of Japanese Patent Application Laid-open No. 2004-83859. That is, 292 parts of 1,3-diiminoisoindoline and 1800 parts of sulfolane were mixed, and 204 parts of titanium tetrabutoxide was dropped to the mixture under nitrogen gas stream. After the dropping, the mixture was gradually heated to 180° C., and a reaction temperature was kept to be in the range between 170° C. and 180° C. while the mixture was stirred for five hours for causing a reaction. After the reaction, the mixture was cooled down and then filtered to obtain a precipitation. The precipitation was washed with chloroform until the precipitation became blue powder, and then the precipitation was washed with methanol several times. The precipitation was further washed with hot water at 80° C. several times and dried to obtain pre-purified titanyl phthalocyanine. 60 parts of the obtained pre-purified titanyl phthalocyanine pigment having been washed with hot water was dissolved into 1000 parts of a 96% sulfuric acid while being stirred at 3° C. to 5° C. and filtered. The resultant sulfuric acid solution was been dropped into 35000 parts of ice water while being stirred to obtain a crystal precipitation. The crystal was then filtered, and repeatedly washed with ion-exchange water (pH: 7.0, specific conductance: 1.0 μS/cm) until the washed solution becomes neutral (for example, after washing, the ion-exchange water has had a pH of 6.8 and a specific conductance of 2.5 μS/cm). In this way, a water paste of titanyl phthalocyanine pigment was obtained. Then, 1500 parts of tetrahydrofuran was added to the water paste and vigorously stirred by a homomixer (KENIS Ltd., MARK, f model) at a high speed of 2000 rpm at room temperature. The stirring was stopped when the paste color changed from navy blue to pale blue (20 minutes after the beginning of stirring), and the paste solution was filtered under reduced pressure. The crystal obtained on a filtering device was washed with tetrahydrofuran to obtain 98 parts of a wet cake of pigment. The wet cake was dried for two days under reduced pressure (5 mmHg) at 70° C. to obtain 78 parts of titanyl phthalocyanine crystal.

Figure 28:
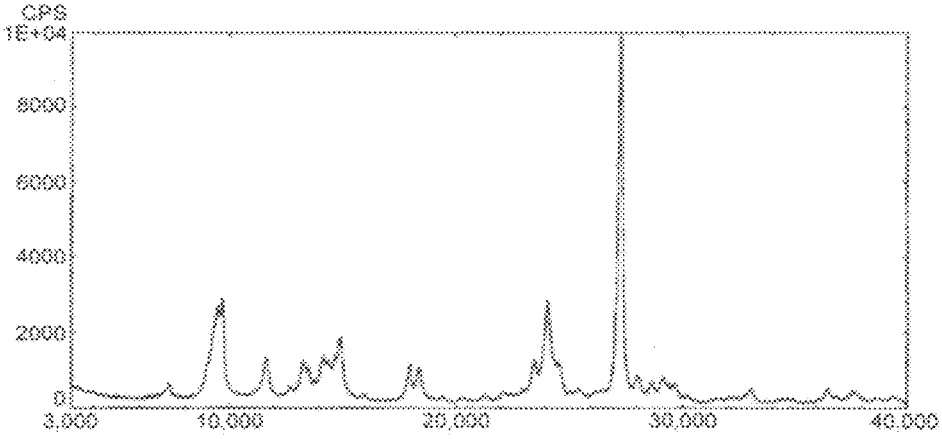
FIG. 28 is a diagram illustrating an X-ray diffraction spectrum of the titanyl phthalocyanine crystal obtained through a preparation example of a photosensitive element.
Figure 29:
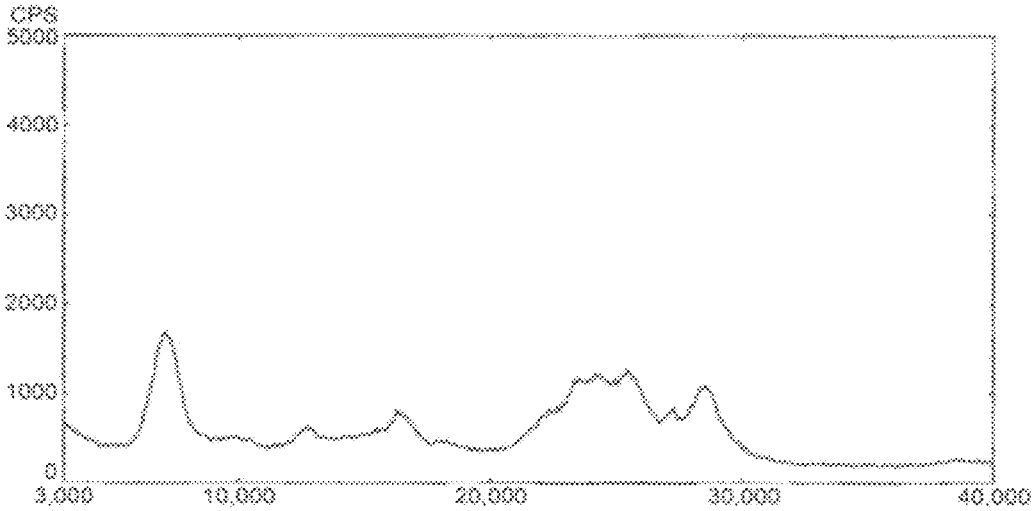
FIG. 29 is a diagram illustrating an X-ray diffraction spectrum of dry powder of a water paste.

The X-ray diffraction spectrum of the obtained titanyl phthalocyanine powder was measured using a commercially available X-ray diffractometer (trade name: RINT1100, manufactured by Rigaku Denki Corporation) under the following conditions. The titanyl phthalocyanine powder had the maximum peak at a Bragg angle 2θ of 27.2±0.2° with respect to a Cu—Kα line (wavelength: 1.542 Å) and peaks at the minimum angle of 7.3±0.2°. Moreover, the titanyl phthalocyanine powder had no peaks between the peak at 7.3° and the peak at 9.4° and no peak at 26.3°. FIG. 28 illustrates the measurement results. Moreover, a part of the obtained water paste was dried for two days at 80° C. and under reduced pressure (5 mmhg) to obtain a low crystallinity titanyl phthalocyanine powder. FIG. 29 illustrates an X-ray diffraction spectrum of the dry powder of the water paste.

Measurement conditions of X-ray diffraction spectrum

X-ray tube: Cu

Potential: 50 kV

Current: 30 mA

Scan speed: 2°/minute

Scan area: 3° to 40°

Time constant: 2 seconds

Preparation of Dispersion Liquid

A dispersion liquid of the synthesized titanyl phthalocyanine crystal was prepared. The dispersion liquid having the following combination was prepared by a bead milling process under the conditions illustrated below.

Synthesized titanyl phthalocyanine crystal: 20 parts

Polyvinyl butyral (trade name: BX-1, manufactured by SEKISUI CHEMICAL CO., LTD.): 12 parts 2-butanone: 368 parts The bead milling process was performed using a commercially available bead mill dispersion machine (trade name: DISPERMAT SL having a rotor diameter of 45 mm and dispersion room capacity of 50 mL, manufactured by VMA-GETZMANN GMBH) and a zirconia ball having a diameter of 0.5 mm. First, 2-butanone solution including polyvinyl butyral was charged into a circulation tank, and circulated to fill a circulation system with a resin solution, and then, a return of solution to the circulation tank was checked. Subsequently, all titanyl phthalocyanine crystal was charged into the circulation tank, and stirred in the circulation tank. Thereafter, the solution was circulated for 60 minutes to obtain a dispersion solution using a rotor rotating at 3000 rpm. After the dispersion, the mill base was removed from the bead mill dispersion machine, and 600 parts of 2-butanone was charged to dilute the dispersion solution, and at the same time, the remaining mill base was removed from the dispersion machine to prepare a dispersion liquid.

Preparation of Electrophotographic Photosensitive Element

An underlayer coating liquid, a charge generation layer coating liquid, and a charge transport layer coating liquid having the following compositions were sequentially applied and dried on an aluminum drum having a diameter of 30 mm to obtain a stacked photosensitive element with an underlayer having a thickness of 3.5 μm, a charge generation layer having a thickness of 0.2 μm, and a charge transport layer having a thickness of 28 μm.

| (Underlayer coating liquid) | |
|---|---|
| Titanium oxide (Trade name: CR-EL, manufactured by ISHIHARA SANGYO KAISHA, LTD.): | 70 parts |
| Alkyd resin (Trade name: BECKOLITE M6401-50-S (solid component 50%), manufactured by DIC Corporation): | 15 parts |
| Melamine resin (Trade name: SUPER BECKAMINE L-121-60 (solid component 60%), manufactured by DIC Corporation): | 10 parts |
| 2-butanone: | 100 parts |

(Charge Generation Layer Coating Liquid)

The dispersion liquid of the above described titanyl phthalocyanine crystal was used.

| (Charge transport layer coating liquid) | |
|---|---|
| Polycarbonate (Trade name: European Z 300, manufactured by MITSUBISHI GAS CHEMICAL COMPANY, INC.): | 10 parts |
| Charge transport material having the following structural formula (see Chemical Formula 1): | 7 parts |
| Tetrahydrofuran: | 80 parts |

Next, the scanner 300 will be described briefly with reference to FIG. 1.

In the scanner 300, first and second carriages 33 and 34 on which a document illuminating light source and mirrors are mounted reciprocate in order to scan a document (not illustrated) placed on a contact glass 31. Image information obtained through the scanning by the carriages 33 and 34 is focused by a focus lens 35 on an imaging surface of a reading sensor 36 provided on a rear side of the focus lens 35, and is read as an image signal by the reading sensor 36.

Figure 30:
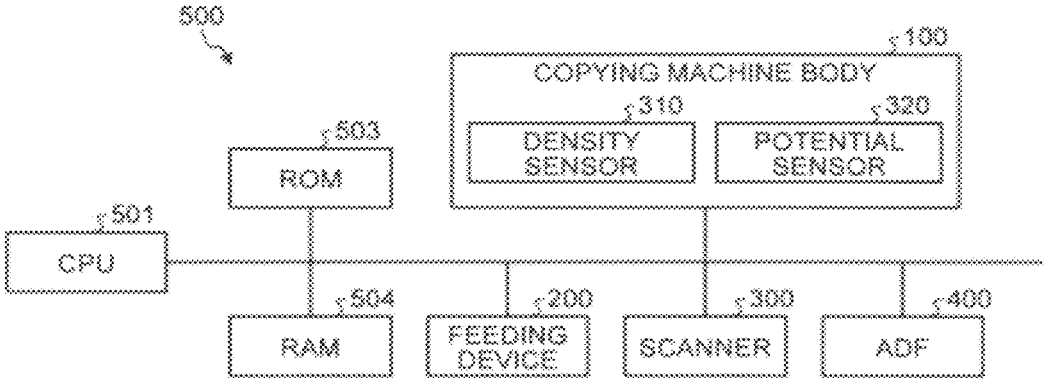
FIG. 30 is a block diagram illustrating main parts of an electric circuit of the copying machine.

FIG. 30 is a block diagram illustrating an electrical connection of the respective units of the copying machine according to the present embodiment.

As illustrated in FIG. 30, the copying machine 600 of the present embodiment includes a main controller 500 having the configuration of a computer, and the main controller 500 drives and controls the respective units. The main controller 500 has a configuration in which a central processing unit (CPU) 501 that executes various operations and controls the driving of respective units is connected to a read only memory (ROM) 503 that stores fixed data such as a computer program in advance and a random access memory (RAM) 504 that functions as a work area for storing various data in a rewritable manner through a bus line 502. The ROM 503 stores a conversion table (not illustrated) storing information used for converting the output value of the density sensor 310 into a toner adhesion amount per unit area. The main controller 500 is connected to the respective units of the copying machine body 100, the feeding device 200, the scanner 300, and the ADF 400. The density sensor 310 and the potential sensor 320 of the copying machine body 100 output detected information to the main controller 500.

Next, the operation of the copying machine 600 will be described.

When copying a document using the copying machine 600, the original is set on an original table 30 of the ADF 400. Alternatively, the user opens the ADF 400 and then sets the original on a contact glass 31 of the scanner 300 and closes and presses the ADF 400. Thereafter, when the user presses a start switch (not illustrated), the original is conveyed to be placed on the contact glass 31 if the original is set on the ADF 400. Then, the scanner 300 is driven, and the first carriage 33 and the second carriage 34 start moving. In this way, light emitted from the first carriage 33 is reflected from the original set on the contact glass 31, and the reflection light is reflected from a mirror of the second carriage 34. Then, the reflection light is guided to the reading sensor 36 through the focus lens 35. In this way, image information of the original is read.

Moreover, when the user presses the start switch, one of the three support rollers 14, 15, and 16 is driven by a drive motor (not illustrated) to rotate the intermediate transfer belt 10. At the same time, the photosensitive elements 20Y, 20C, 20M, and 20K of the image forming units 18Y, 18C, 18M, and 18K also rotate, respectively. Thereafter, based on the image information read by the reading sensor 36 of the scanner 300, the exposing unit 900 emits a writing beam to each of the photosensitive elements 20Y, 20C, 20M, and 20K of the image forming units 18Y, 18C, 18M, and 18K. In this way, an electrostatic latent image is formed on each of the photosensitive elements 20Y, 20C, 20M, and 20K, and is changed into a visible image by the corresponding developing units 61Y, 61C, 61M, and 61K. As a result, toner images of the respective colors of yellow, cyan, magenta, and black are formed on the photosensitive elements 20Y, 20C, 20M, and 20K, respectively.

The respective color toner images formed in this way are primarily transferred sequentially onto the intermediate transfer belt 10 by the primary transfer units 62Y, 62C, 62M, and 62K so that the toner images are superimposed onto each other. In this way, a combined toner image in which the respective color toner images are superimposed onto one another is formed on the intermediate transfer belt 10.

Moreover, when the user presses the start switch, the feed roller 42 of the feeding device 200 corresponding to the transfer sheets 5 selected by the user rotates, and the transfer sheets 5 are fed from one of the sheet cassettes 44. The fed transfer sheets 5 are separated one by one by the separation roller 45 and the separated transfer sheet 5 is fed into the sheet feed path 46 and conveyed to the conveying path 48 in the copying machine body 100 by the carriage roller 47. The transfer sheet 5 conveyed in this way is stopped by the registration roller 49*b*.

The registration roller 49*b* starts rotating in synchronization with timing at which the combined toner image formed on the intermediate transfer belt 10 as above described is conveyed to a secondary transfer portion that faces the secondary transfer roller 24. The transfer sheet 5 fed by the registration roller 49*b* is conveyed to a position between the intermediate transfer belt 10 and the secondary transfer roller 24, and the combined toner image on the intermediate transfer belt 10 is secondarily transferred onto the transfer sheet 5 by the secondary transfer roller 24. Thereafter, the transfer sheet 5 is conveyed to the fixing unit 25 by being attached to the secondary transfer roller 24, and the toner image is fixed to the transfer sheet 5 with heat and pressure applied by the fixing unit 25. The transfer sheet 5 having passed through the fixing unit 25 is discharged onto the discharge tray 7 by the discharge roller 56 and stacked. When forming another image on a back surface of the transfer sheet 5 with the toner image fixed thereon, the conveying direction of the transfer sheet 5 having passed through the fixing unit 25 is changed by the switching claw 55 and the transfer sheet 5 is conveyed to the sheet reverse unit 93. The transfer sheet 5 is reversed in the sheet reverse unit 93 and is fed again to the secondary transfer roller 24. In the meantime, the residual toner remaining on the intermediate transfer belt 10 after the secondary transfer process is removed by the belt cleaning unit 17.

In the copying machine 600, image density adjusting control is performed at predetermined timing (for example, when power is turned ON, after a predetermined period elapses, or at a printing of every predetermined number of sheets). The image density adjusting control includes detecting a change in characteristics of a latent image potential (hereinafter may be referred to as light attenuation characteristics) with respect to an exposure power to the photosensitive element and feeding back the detection result to set the optimum charging potential, exposure power, and developing bias. The image density adjusting control is performed based on a computer program by the CPU 501 of the present embodiment, and is referred to as a "self-check operation."

In particular, the light attenuation characteristics of the photosensitive element depend on the usage environment, the degree of electrostatic fatigue, the thickness of a photoconductive layer, or the like. As for the environmental dependence of the light attenuation characteristics, the latent image potential under the same charging potential and the same exposure power changes depending on the usage environment such as a normal-temperature and normal-humidity environment, a high-temperature and high-humidity environment, and a low-temperature and low-humidity environment. As a result, the shape of a light attenuation curve changes depending on the usage environment. Moreover, as for the electrostatic fatigue characteristics of the light attenuation characteristics, the characteristics of a photosensitive element deteriorate when charging and exposure operations are repeated for a long period of time to form images on hundreds of thousands of sheets. Therefore, when a number of sheets are printed, the photosensitive element deteriorates. As a result, even when the same charging potential and the same exposure power are set, the surface potential of the photosensitive element may hardly decrease. Therefore, the shape of the light attenuation curve changes depending on the degree of electrostatic fatigue. Moreover, when image formation is repeated for a long period of time, a photosensitive element cleaning blade for removing residual non-transferred toner gradually scrapes not only the toner but also a surface layer off the photosensitive element. Thus, the thickness of the photoconductive layer of the photosensitive element decreases with time. The surface potential of the photosensitive element changes according to the change in the thickness of the photoconductive layer even when the same charging potential and the same exposure power are set. Therefore, the shape of the light attenuation curve changes depending on the thickness of the photoconductive layer.

As described above, the light attenuation characteristics of the photosensitive element changes depending on the usage environment, the degree of electrostatic fatigue, and the thickness of the photoconductive layer. The shape of the light attenuation curve changes in a relatively simple manner when only one effect of the usage environment, the degree of electrostatic fatigue, and the thickness of the thickness of the photoconductive layer on the light attenuation characteristics is taken into consideration. However, in actual apparatuses, the thickness change by the cleaning blade, the progress of electrostatic fatigue, and the change in the usage environment occur simultaneously. Therefore, the usage environment, the degree of electrostatic fatigue, and the thickness have a complex effect on the light attenuation characteristics. Therefore, it is difficult to predict latent image potential characteristics with respect to the exposure power of an actual photosensitive element based on data such as the operating time and the number of printed sheets. Accordingly, it is important to detect a change in the characteristics of the latent image potential with respect to the exposure power of the photosensitive element and feed back the detection result to image formation conditions through the image density adjusting control.

Figure 31:
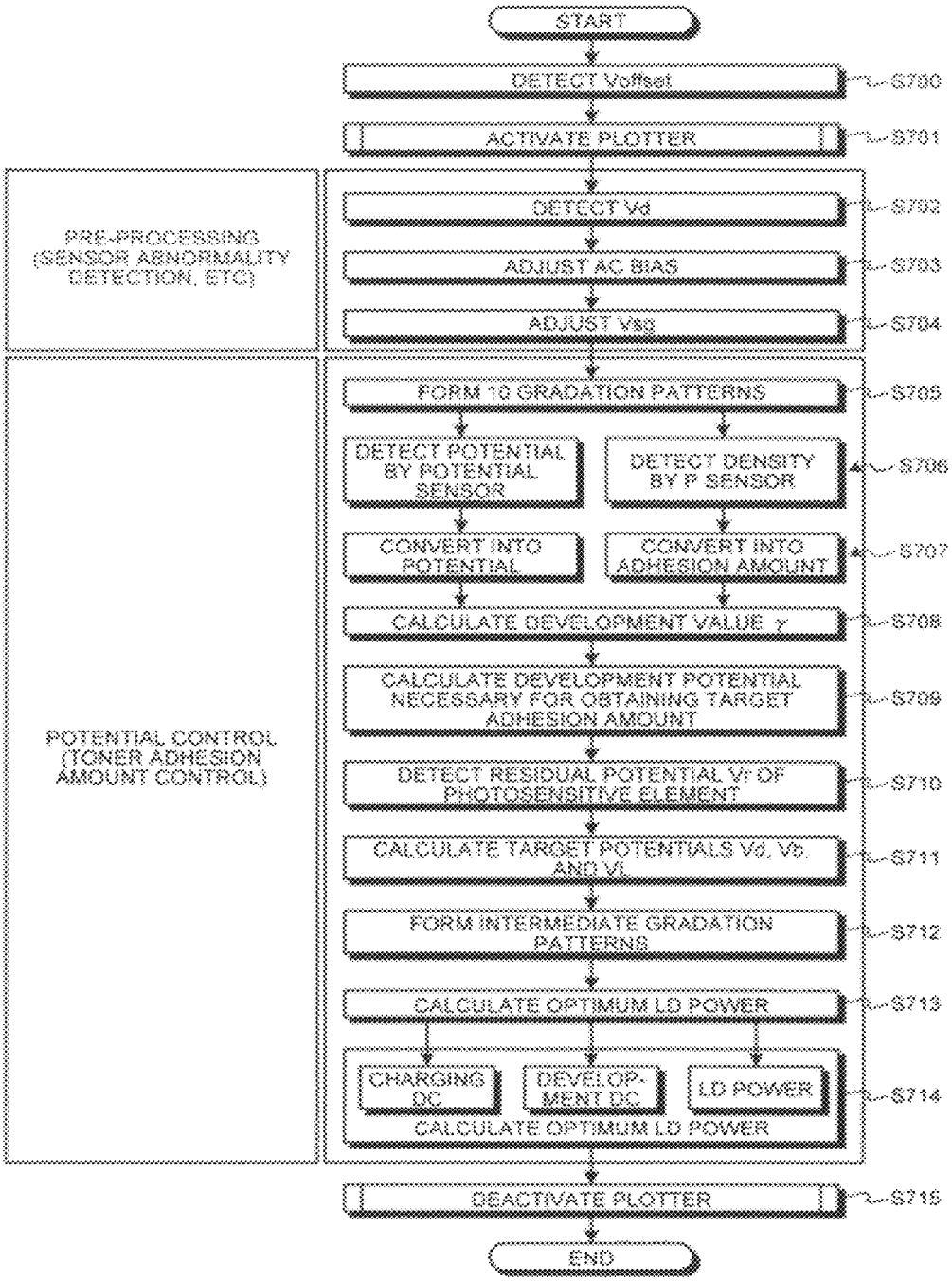
FIG. 31 is a flowchart illustrating a control flow of a self-check operation performed by a control unit of the copying machine.

FIG. 31 is a flowchart illustrating the self-check operation (a potential control operation).

The toner pattern on the intermediate transfer belt 10 used in the self-check operation is illustrated in FIG. 3 described above. The processing routine of the self-check operation illustrated in FIG. 31 is basically performed as necessary, for example, when the copying machine is activated; after a predetermined number of sheets are printed (that is, between printing operations during a continuous printing operation); or after a predetermined period elapses. Here, an explanation is given of the case in which the self-check operation is performed when the copying machine is activated. First, in order to distinguish the condition when the power is ON from the condition when an abnormality such as paper jam occurs, the fixing temperature of the fixing unit 25 is detected to determine whether the potential control operation is to be performed. Specifically, based on an input signal from a fixing temperature sensor, it is determined whether the fixing temperature of the fixing unit 25 exceeds 100° C. If the fixing temperature of the fixing unit 25 exceeds 100° C., the potential control operation is not performed. If the fixing temperature of the fixing unit 25 does not exceed 100° C., the self-check operation is performed. That is, in the copying machine, the self-check operation is executed when the power is turned on and a control unit immediately determines that the surface temperature of the fixing roller does not exceed 100° C. In such a configuration, the control unit including the CPU 501 functions as a determination means.

Figure 32:
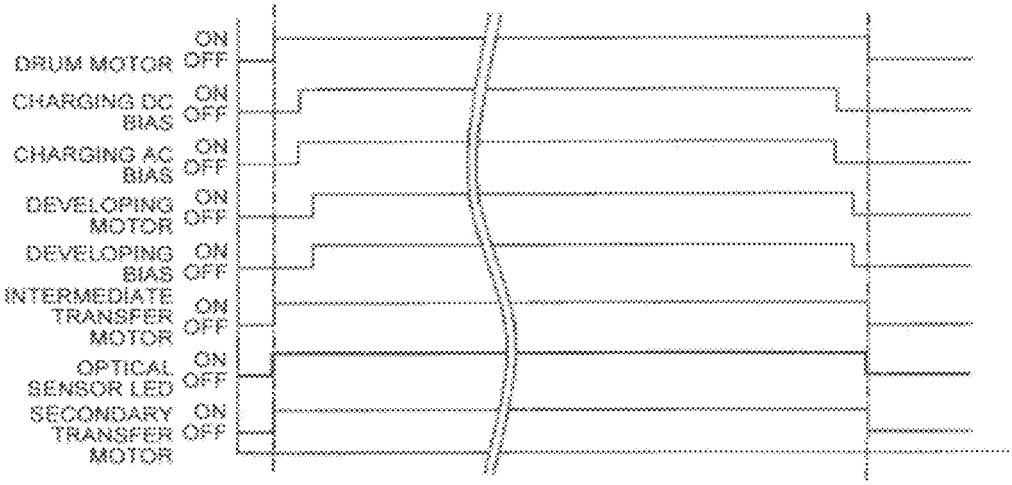
FIG. 32 is a timing chart illustrating the ON/OFF timing of each device of the copying machine.

In the self-check operation, to be performed in step S700, before activating a plotter, two density sensors 310*a* and 310*b* (referred to as a "density sensor 310" as appropriate) detect offset potentials (Voffset_reg and Voffset_dif), which are the output potential values when the LED 315 is turned off, as Voffset. Here, "Voffset_reg" is an output potential value of regularly reflected light received by the regularly reflected light receiving element 316, and "Voffset_dif" is an output potential value of diffuse reflection light received by the diffuse reflection light receiving element 317. After the detection, a plotter activation operation is performed in step S701. In the plotter activation operation, as illustrated in the timing chart of FIG. 32, a control activation operation necessary for an image forming operation such as an operation of activation charging, developing, and a transfer bias is performed in accordance with the timing for activating a motor such as the respective photosensitive element motors, the intermediate transfer motor, and the secondary transfer motor and predetermined image forming timing. Moreover, as illustrated in FIG. 32, in the present embodiment, the LED 315 of the density sensor 310 is turned on in synchronization with the timing of activating the intermediate transfer motor during the activation operation.

In the meantime, the LED 315 of the density sensor 310 is turned on in synchronization with the timing of activating the intermediate transfer motor for a reason to be described below.

Figure 33:
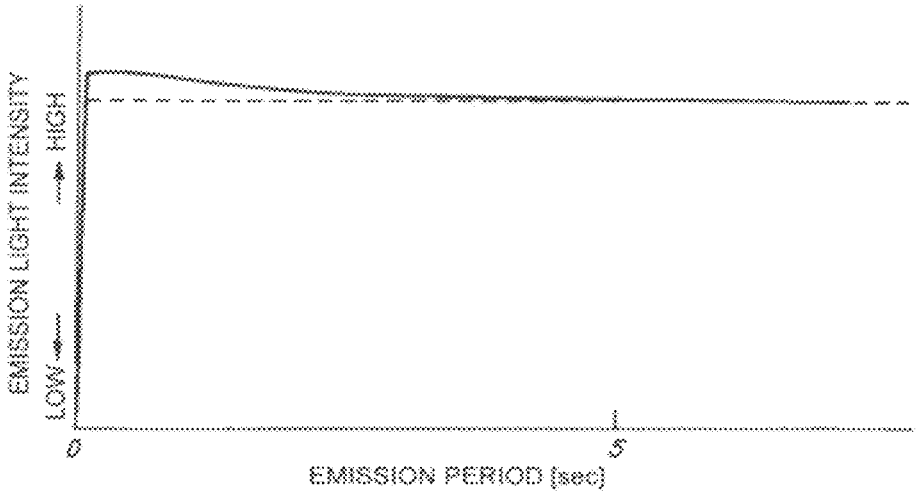
FIG. 33 is a graph illustrating emission characteristics of a light-emitting diode (LED) at an initial stage of light emission.

When the image forming condition adjusting control is started, although a light emitting means such as an LED is turned on so as to measure the amount of light reflected by a reference toner image, an amount of luminescence of the light emitting means changes with time from the start of light emission as illustrated in the graph of FIG. 33. In FIG. 33, although the amount of luminescence reaches a maximum after several tens of μs has elapsed from the start of light emission, the amount of luminescence decreases gradually with an increase of the internal resistance due to an increase of the internal temperature of the light emitting means, and the amount of luminescence stabilizes when the increase of the internal temperature is saturated. Although the time required for stabilization is several seconds, it is difficult to detect the optical reflectance of the reference toner image exactly during this period. Therefore, it is required to detect the optical reflectance of the reference toner image using an optical sensor after the amount of luminescence of the light emitting means is stabilized. In contrast, in the present embodiment, the LED 315 of the density sensor 310 is turned on in synchronization with timing when the intermediate transfer motor is activated. As a result, a multi-gradation patch pattern is formed on the photosensitive element 20 and developed to form a toner pattern. The toner pattern is transferred onto the intermediate transfer belt 10. Thereafter, the transferred toner pattern reaches a detection position of the density sensor 310. Accordingly, the amount of luminescence of the LED 315 of the density sensor 310 can be stabilized before the toner pattern reaches the detection position of the density sensor 310.

However, in the past, as an ideal detection position for detecting a density of the toner pattern with high accuracy, the density of the toner pattern was generally detected between developing and transferring, namely when the toner pattern was on the photosensitive element. However, if the density of the toner pattern is detected on the photosensitive element, irradiation of LED light may cause light-induced fatigue to the photosensitive element. This causes a problem in that only the image formed in the LED irradiation portion of the photosensitive element becomes dark or light in a stripe shape. Therefore, in the present embodiment, the toner pattern is detected on the intermediate transfer belt 10 rather than on the photosensitive element. In such a configuration, light-induced fatigue may not occur in the photosensitive element due to the irradiation of LED light.

Figure 34:
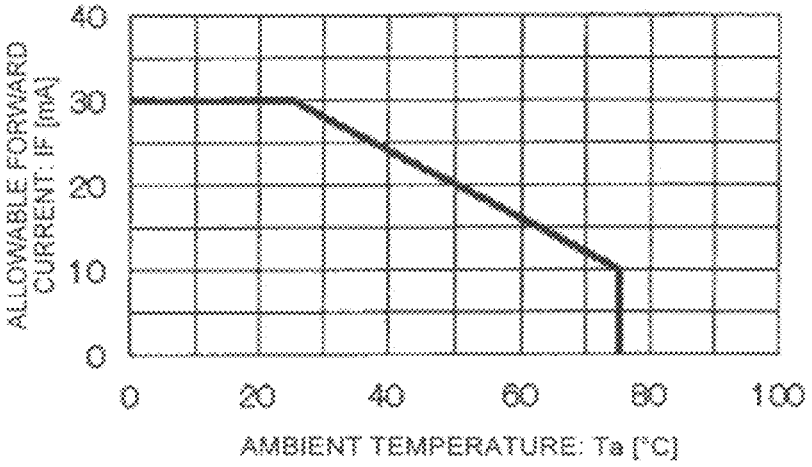
FIG. 34 is a graph illustrating the relation between an ambient temperature of the LED and an allowable forward current of the LED.

FIG. 34 is a graph (temperature rating diagram) illustrating the relation between an ambient temperature Ta that is the temperature under the environment where the LED is placed and an allowable forward current IF of the LED 315.

As illustrated in FIG. 34, in the LED 315, it is necessary to determine the current value to be generated by the LED 315 in accordance with the ambient temperature Ta. This is because the allowable current value for the LED 315 decreases as the ambient temperature Ta increases. When the optical reflectance in the background portion of the intermediate transfer belt 10 that is the detection target surface of the density sensor 310 is relatively high, the amount of luminescence by the LED, that is required for a light receiving element to receive a predetermined amount of reflection light in a Vsg adjusting process, is relatively small. That is, the LED current value, that is required for the density sensor 310 to output a predetermined output potential (for example, 4.0±0.2 V), is relatively small. Here, "Vsg" is the value of an output potential of the density sensor 310 when detecting the background portion of the intermediate transfer belt 10.

For example, when a transparent intermediate transfer belt 10 is used, a metal roller having a high mirror reflectivity (gloss level at 20°: about 500) is used as a roller that faces the density sensor 310, and the LED light is reflected from the surface of the roller, the LED current value necessary for obtaining Vsg of 4.0 V is about 4 to 7 mA.

In contrast, in the present embodiment, a carbon-dispersed belt (gloss level at 20°: 120) that has little resistance variation with respect to a change in temperature and humidity environment is used as the intermediate transfer belt 10 serving as a detection target. The intermediate transfer belt 10 looks black due to the carbon dispersed, and the mirror reflectivity is considerably lowered by about ¼. In such an intermediate transfer belt 10, in order to obtain the Vsg of 4.0 V, the LED current becomes 20 to 35 mA, which is about five times as large as that of a transparent belt. The LED current may similarly increase considerably in a belt having a low gloss level and a belt having high surface roughness.

As described above, because the LED current needs to be set within the allowable forward current value determined based on the ambient temperature, it is difficult to supply a current of 20 to 35 mA into the LED. As a method of obtaining a desired Vsg value while maintaining the LED current to be within the allowable forward current value, a method of increasing the sensitivity of the light receiving element of the density sensor 310, namely a method of increasing the gain of an OP amplifier, may be used. According to this method, it may be also possible to obtain the Vsg value of 4.0 V while maintaining the LED current to be within the allowable forward current value. However, in this method, because a very weak light entering a light receiving element is merely amplified by an electrical circuit, it may not be possible to obtain a high S/N ratio.

In view of the above, in the present embodiment, as a countermeasure against the black surface of the intermediate transfer belt 10 that is the detection target surface, the LED current value is increased as compared to a belt having higher reflectivity, and the gain of an OP amplifier is also increased. By increasing both the LED value and the gain of an OP amplifier, a decrease in the S/N ratio is suppressed while maintaining the LED current value to be within the allowable forward current value. Specifically, the LED current is set to 15 mA by assuming that the maximum ambient temperature is 50° C. and a decrease in the light amount over time is about ⅔. Moreover, the gain of an OP amplifier is set to be 2.5 times greater by assuming that a variation of the LED current is in the range of 20 to 35 mA (maximum variation of 15 mA). In this way, it is possible to secure an S/N ratio required for the density sensor 310 on the black intermediate transfer belt 10 that provides stable transfer performance regardless of the environment.

Figure 35:
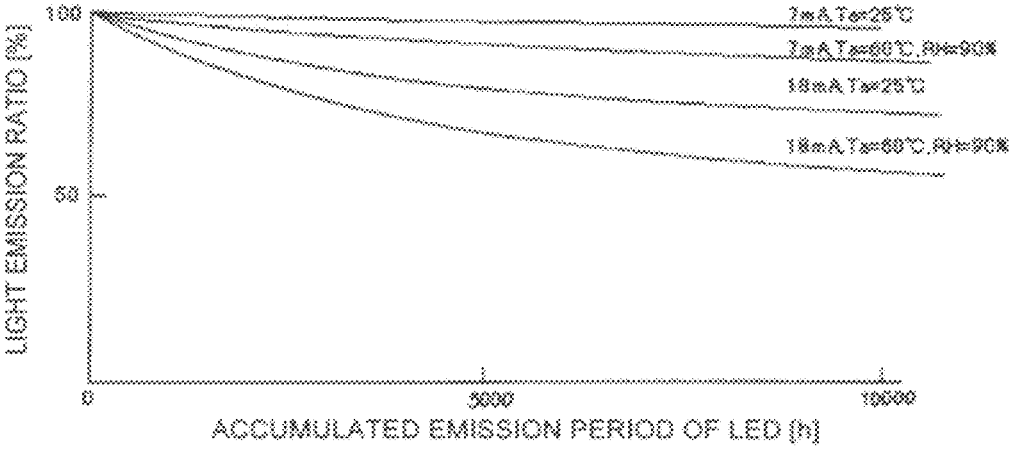
FIG. 35 is a graph illustrating emitted light amount variation characteristics of the LED due to a long period of use.

As illustrated in FIG. 35, the LED 315 has a property that the amount of luminescence thereof decreases gradually as the density of lattice defect increases gradually over time. Although the degree of decrease in the amount of luminescence depends on the material that forms the LED 315, in many cases the degree depends on the current supplied to the LED, and the ratio of decrease in the amount of luminescence over time increases as the current value increases. In FIG. 35, the light emission ratio represents the ratio of the amount of luminescence at each time by assuming that the amount of luminescence of the LED in the initial state is 100%. It can be understood from FIG. 35 that a decreasing rate of the amount of luminescence of the LED increases as the current value increases, and the progress of degradation is accelerated as the ambient temperature increases.

In the present embodiment, as described above, in order to eliminate a waiting time during the self-check operation, the LED 315 is turned ON when the plotter is activated, and the LED 315 is kept ON until the plotter is deactivated. In such a configuration, the period over which the LED is kept ON is extended considerably as compared to the related art in which the LED is turned on and off only when optical detection is required. As a result, the amount of luminescence of the LED 315 decreases over time as illustrated in FIG. 35, which may not occur in the related art. As for the second density sensor 310*b* that is a regular reflection optical sensor, the decrease in the amount of luminescence has no great influence on the detection accuracy. However, for the first density sensor 310*a* that is a multi-reflection optical sensor, the decrease in the amount of luminescence has an influence on the detection accuracy.

Therefore, in the present embodiment, the detection result is corrected so as to suppress a decrease in the detection accuracy of the first density sensor 310*a*, which is a multi-reflection optical sensor, caused by the decrease in the light amount of the LED 315 over time. In this way, a variation in the output of diffuse reflection light caused by a decrease in the light amount of the LED current over time is corrected.

Subsequently, in step S702, the potential sensor 320 detects the surface potential (background potential Vd of a photosensitive element) of the respective photosensitive elements 20 that are uniformly charged under predetermined conditions. In step S703, the AC bias of the charging unit 60 is adjusted based on the detection result. Thereafter, in step S704, Vsg adjustment is performed. In the Vsg adjustment, the amount of luminescence by the LED of the density sensor 310 is adjusted so that regularly reflected light "Vsg_reg" reflected from the background portion (surface) of the intermediate transfer belt 10 is kept within a predetermined range (4.0±0.2 V). After adjusting the light intensity, the belt background outputs "Vsg_reg" and "Vsg_dif" are stored in the RAM. The processes in steps S701 and S702 are performed in parallel by the image forming units 18 of the respective colors, and the process in step S703 is performed in parallel by the two density sensors 310*a* and 310*b*. Moreover, the start timing for Vsg adjustment occurs after the processes in steps S702 and S703 have been completed so that the Vsg adjustment is performed about five seconds after the LED 315 of the density sensor 310 is turned on and the sensor output has been stabilized.

Subsequently, in step S705, latent images of a 10-gradation patch pattern (multi-gradation patch pattern) for each color are formed on the respective photosensitive elements 20. In step S706, the output values of the potential sensor 320 for the respective patch potentials of the ten gradation patterns on the respective photosensitive elements 20 are read and stored in the RAM 504. In step S707, a development potential is calculated based on the sensor output values (potentials of the respective patches) and a developing bias used for developing the patch patterns. The image forming conditions and the pattern structure of the 10-gradation patch pattern formed at this time will be described in detail later.

The electrostatic latent images formed on the photosensitive elements 20 are developed by the black, cyan, magenta, and yellow developing units 61K, 61C, 61M, and 61Y so as to obtain visible toner images of the respective colors. Subsequently, as illustrated in FIG. 3, the toner images are primarily transferred onto the intermediate transfer belt 10. As illustrated in FIG. 3, the 10-gradation patterns of the respective colors are formed on positions corresponding to the positions W of the two density sensors 310*a* and 310*b* in the belt width direction. In this case, the C, M, and Y patterns are formed at a position that is 40 mm to the front side away from the center of the image, and the K patterns are formed at a position that is 40 mm to the rear side away from the center of the image.

Subsequently, in step S706, the CPU 501 instructs the density sensor 310 (P sensor) to detect the toner adhesion amount of the toner pattern transferred onto the intermediate transfer belt 10, obtained by developing the ten gradation patterns described above. In the toner adhesion amount detection, the regularly reflected light output "Vsp_reg" and the diffuse-reflection light output "Vsp_dif" of the density sensor 310 for all toner patches of the respective colors (ten patches× four colors) are stored in the RAM 504. Subsequently, the toner adhesion amount is calculated in step S707. Different algorithms are used for calculating the adhesion amounts for black toner and color toner because a black toner detecting sensor and a color toner detecting sensor have different sensor configurations.

First, an adhesion amount conversion process for a black toner patch is described.

The black toner adhesion amount can be calculated by calculating the output ratio (Vsp/Vsg) between the belt background output (Vsg) and the patch output (Vsp) shown in the related art and referencing an adhesion amount conversion table (not shown) stored in the ROM 503.

Next, an adhesion amount conversion process for a color toner patch will be described.

In the present embodiment, the adhesion amount is detected on the black intermediate transfer belt 10, in which the LED current needs to be set to a high value, using a diffuse-reflection type sensor. Therefore, in this toner adhesion amount conversion process, it is necessary to correct a variation in the output of diffuse reflection light caused by a decrease in the sensor output due to a decrease in the light amount of the LED current over time and the Vsg adjustment (adjustment of the regularly reflected light output from the belt background portion to be 4.0 V±0.2 V). In the present embodiment, the adhesion amount of color toner is calculated by the following six steps 1 to 7.

In step 1, data sampling is performed to calculate ΔVsp and ΔVsg.

First, a difference between an offset potential and the regularly reflected light output and another difference between the offset potential and the diffused light output are calculated for all patches (n=C1 to C10, M1 to M10, and Y1 to Y10) that form the toner patterns of the respective colors (C, M, and Y). This is a process for assigning the increase of the sensor output to the increase caused by a change in the adhesion amount of color toner.

An increase of the regularly reflected light output is calculated by the following equation.

$$\Delta Vsp_\text{reg}.[n]=(Vsp_\text{reg}.[n])-(V\text{offset_reg})$$

Moreover, the increase of the diffuse reflection light output is calculated by the following equation.

$$\Delta Vsp_\text{dif}.[n]=(Vsp_\text{dif}.[n])-(V\text{offset_dif})$$

Figure 36:
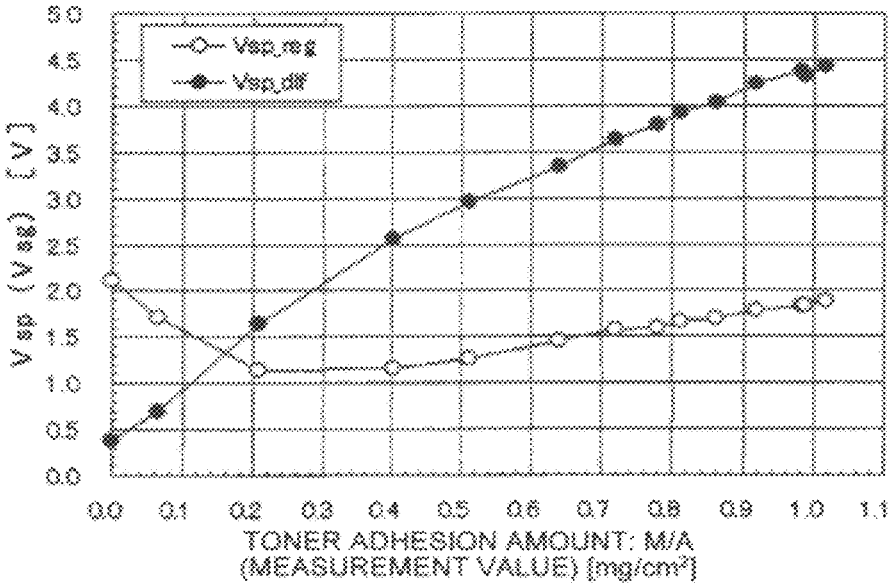
FIG. 36 is a graph illustrating the variations of Vsp and Vsg as functions of a toner adhesion amount to a reference patch.

However, the above difference calculation processes may not be performed if an OP amplifier is used such that the respective offset output potentials (Voffset_reg and Voffset_dif) have negligibly small values. As a result of the processes in step 1, characteristic curves as illustrated in FIG. 36 are obtained.

In step 2, a sensitivity correction coefficient α is calculated.

First, ΔVsp_reg.[n]/ΔVsp_dif.[n] is calculated for each patch based on ΔVsp_reg.[n] and ΔVsp_dif.[n] calculated in step 1. Then, the sensitivity correction factor α to be multiplied to the diffused light output (ΔVsp_dif.[n]) when decomposing the component of the regularly reflected light output in step 3, to be described later, is calculated by the following equation.

$$\alpha=\min[(\Delta Vsp_\text{reg}[n])/(Vsp_\text{Dif}.[n])]$$

Figure 37:
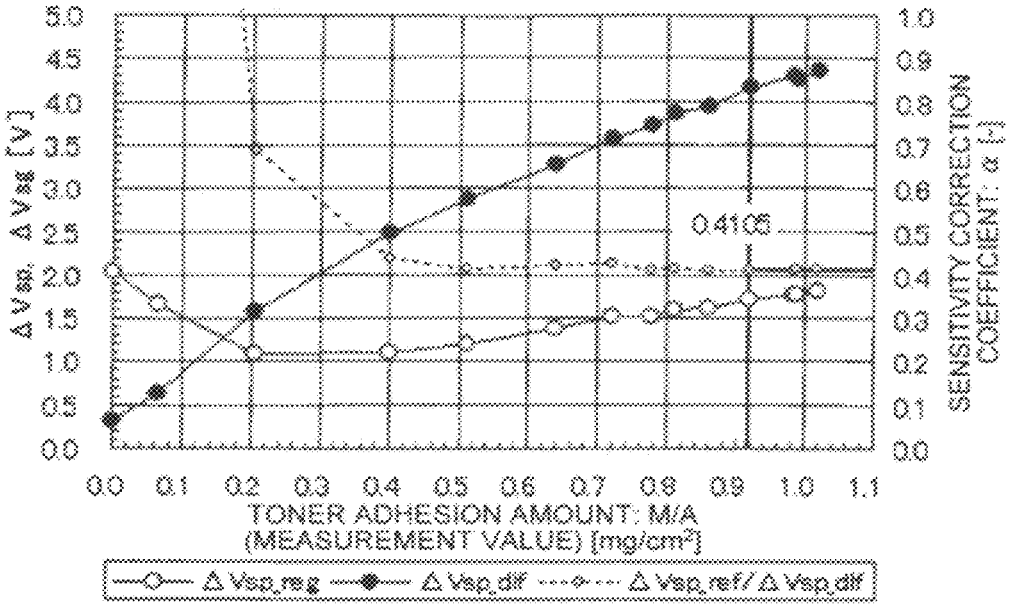
FIG. 37 is a graph illustrating the variations of ΔVsp, ΔVsg, and a sensitivity correction coefficient $\alpha$ as functions of a toner adhesion amount to a reference patch.

As a result of the process in step 2, characteristic curves as illustrated in FIG. 37 are obtained. The sensitivity correction factor α is set to the minimum value of (ΔVsp_reg.[n]/Vsp_dif.[n]) because it is known that the minimum value of the regular reflection component of the regularly reflected light output becomes a positive value close to zero.

In step 3, the regularly reflected light is decomposed into a plurality of components.

A diffused light component of the regularly reflected light output is calculated by the following equation.

$$\Delta Vsp_\text{reg.dif.}[n]=(\Delta Vsp_\text{dif.}[n])\times\alpha$$

Moreover, a regular reflection component of the regularly reflected light output is calculated by the following equation.

$$\Delta Vs_\text{preg.reg.}[n]=(\Delta Vsp_\text{reg.}[n])-(\Delta Vsp_\text{reg.dif.}[n])$$

Figure 38:
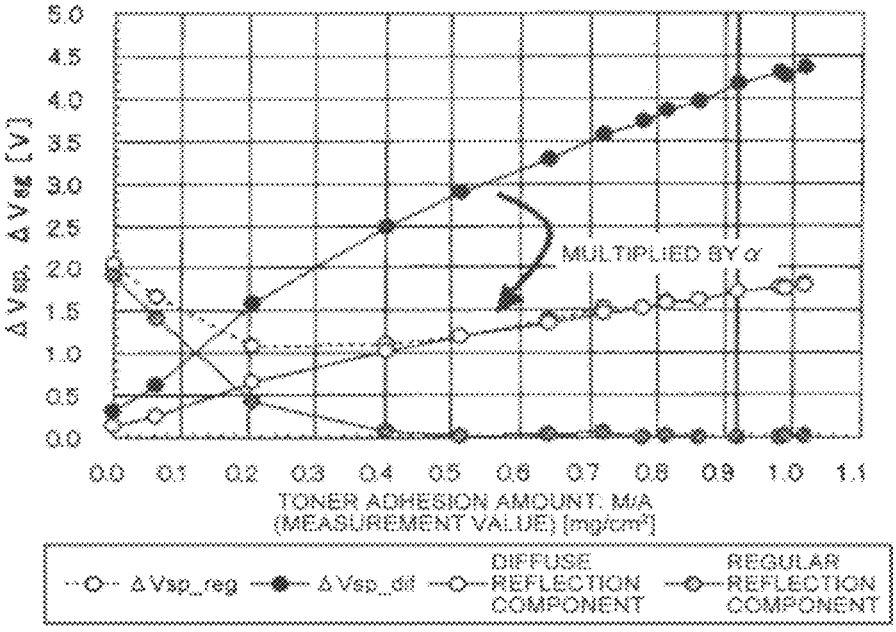
FIG. 38 is a graph illustrating the variations of a diffuse reflection component and a regular reflection component as functions of a toner adhesion amount to a reference patch.

When the decomposition is performed in this way, the regular reflection component of the regularly reflected light output becomes zero at the patch detection potential at which the sensitivity correction coefficient $\alpha$ is obtained. By this process, as illustrated in FIG. 38, the regularly reflected light output is decomposed into the "regularly reflected light component" and the "diffused light component."

In step 4, the regular reflection component of the regularly reflected light output is normalized.

The ratio of each of the patch detection potentials to the background detection potential is calculated by the following equation so as to normalize the regular reflection component to a normalized value ranging from 0 to 1.

$$\text{Normalized value } \beta[n]=(\Delta Vsp_\text{reg._reg.})/(\Delta Vsg_\text{reg._reg})(=\text{Exposure rate of a background portion of the intermediate transfer belt})$$

Figure 39:
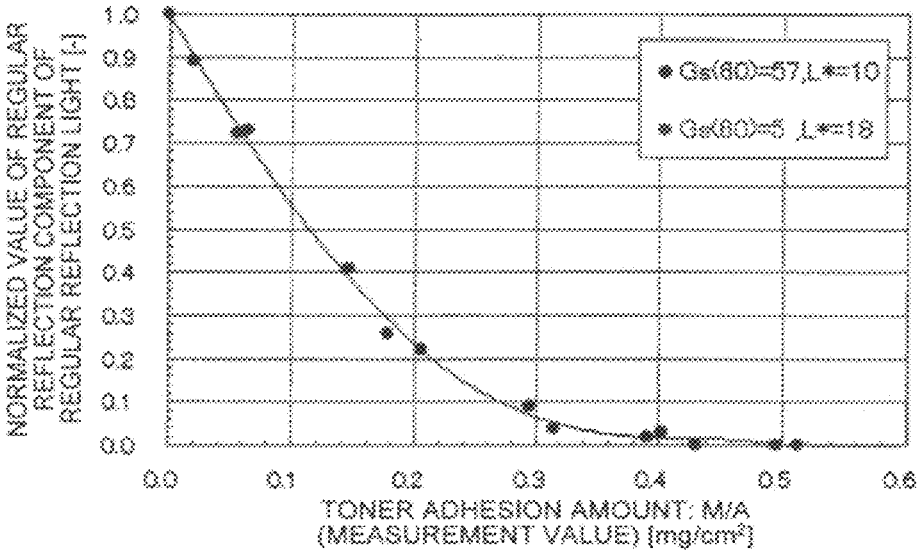
FIG. 39 is a graph illustrating the relation between a toner adhesion amount to a reference patch and a normalized value of the regular reflection component of regularly reflected light.

As a result of the process in step 4, characteristic curves as illustrated in FIG. 39 are obtained.

In step 5, the variation of the diffused light output in the background portion is corrected.

First, "the diffused light output component obtained from the background portion of the belt" is subtracted from "the diffused light output potential" by the following equation.

$$\begin{aligned}\text{Corrected diffused light output} &= (\Delta\text{Vsp_dif}')\\ &= [\text{Diffused-light output potential}] - [\text{Potential detected from background portion}]\times[\text{Normalized value of regular reflection component}]\\ &= [\Delta\text{Vsp_dif.}[n]] - [(\Delta\text{Vsg_dif})\times\beta[n]]\end{aligned}$$

Figure 40:
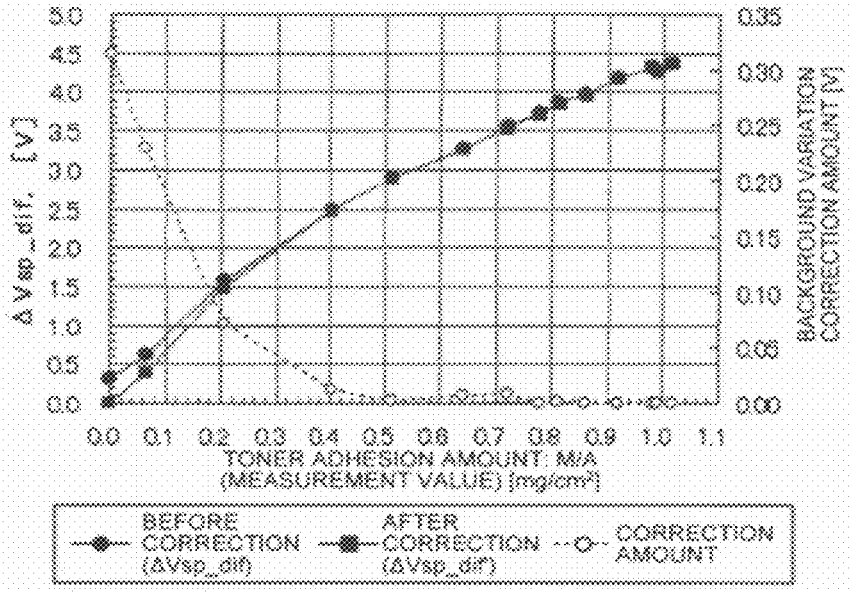
FIG. 40 is a graph illustrating the variations of ΔVsp_dif and a background variation correcting amount as functions of a toner adhesion amount to a reference patch.

In this way, the effect of the background portion of the intermediate transfer belt 10 can be removed. Thus, the diffused light component directly reflected from the background portion of the belt can be removed from the diffused light output in a small toner adhesion amount range in which the regularly reflected light output is detectable. By performing such a process, the corrected diffused light output in the toner adhesion amount range of zero to one layer is converted into values having a first-order linear relation, extended from the origin, with respect to the toner adhesion amount as illustrated in FIG. 40.

In step 6, the sensitivity of the diffused light output is corrected.

Figure 41:
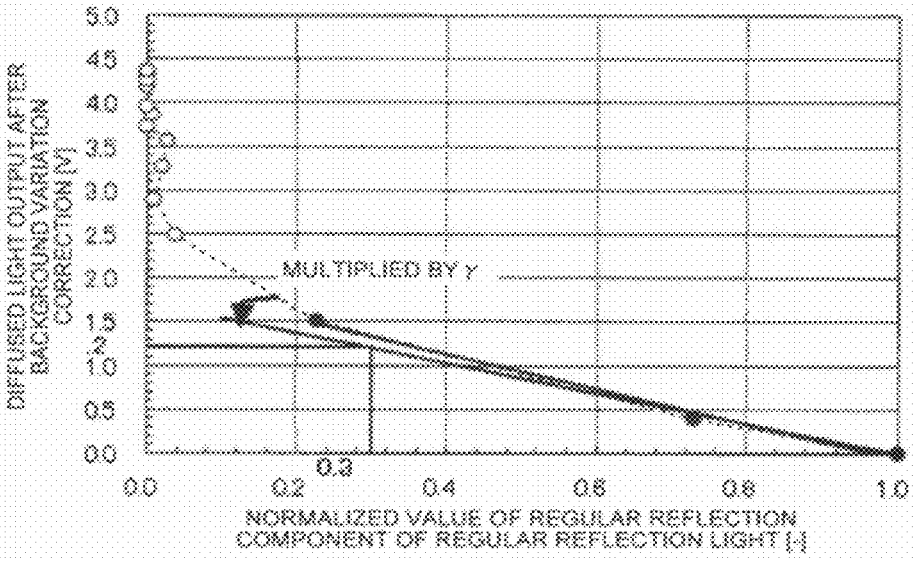
FIG. 41 is a graph illustrating the relation between a normalized value of a regular reflection component in a commercially available light shielding film and an output value of diffused light after background variation correction.

Specifically, as illustrated in FIG. 41, the diffused light output, that is obtained after the background variation is corrected, is plotted with respect to "the normalized value of the regular reflection component of the regularly reflected light." Then, the sensitivity of the diffused light output is calculated based on the linear relation in the small toner adhesion amount range. Then, the sensitivity is corrected to predetermined target sensitivity. The sensitivity of the diffused light output mentioned herein is the slope of the line illustrated in FIG. 41. A correction coefficient to be multiplied by the present slope is calculated so that the diffused light output, that is obtained after the background variation correction at a certain normalized value, becomes a predetermined value (in the shown example, y=1.2 at x=0.3).

That is, measurement results of the output potential value are to be corrected. The slope of a line is calculated by the least squares method as in the following equations.

$$\text{Slope of line}=\Sigma(x[i]-X)(y[i]-Y)/\Sigma(x[i]-X)^2;$$

X=Average value of normalized values of regular reflection components of regularly reflected light y=Y−(slope of line)×X x[i]=Normalized value of regular reflection component of regularly reflected light (where, the range of "x" used for calculation is $0.06\leq x\leq 1$)

y[i]=Diffused light output after background variation correction

Y=Average value of diffused light outputs after background variation correction

In the present embodiment, the lower limit of the range of "x" used for calculation is set to 0.06, but the lower limit may have an arbitrary value if it is in the range where "x" and "y" have a linear relation. The upper limit of "x" is set to 1 because the normalized value is in the range of 0 to 1. Then, a sensitivity correction coefficient $\gamma$ is calculated using the following equation so that a normalized value "a" calculated based on the sensitivity obtained in this way is converted into a certain value "b."

$$\text{Sensitivity correction coefficient: } \gamma=b/[(\text{Slope of line})\times a+(y\text{-axis intercept})]$$

Then, the diffused light output after the background variation correction obtained in step 5 is corrected through a multiplication of the sensitivity correction coefficient $\gamma$.

Diffused light output after sensitivity correction:

$$\begin{aligned}(\Delta\text{Vsp_dif}'') &= [\text{Diffused light output after background variation correction}]\times[\text{Sensitivity correction coefficient } \gamma]\\ &= \{\Delta\text{Vsp_dif}(n)'\}\times\gamma\end{aligned}$$

In step 7, the sensor output value is converted into a toner adhesion amount.

Because the variation over time in the diffuse reflection output caused by a decrease in the LED light amount or the like has been corrected through the processes at Steps 1 to 6, the corrected sensor output value is finally converted into the toner adhesion amount by referencing the toner adhesion amount conversion table. As a result of the above processes, the toner adhesion amount can be calculated for both the black toner and the color toner in step S707. Subsequently, a development value $\gamma$ is calculated in step S708.

In the development value $\gamma$ calculation process of step S708, the toner adhesion amount data (toner adhesion amount [mg/cm$^2$] per unit area) of each patch are plotted with respect to the development potential (a difference between the developing bias Vb and the detected potential of each patch when the respective patches of the 10-gradation patch pattern of each color are developed) obtained in step S707 of FIG. 31. A linear approximation equation (in which the slope is referred to as the development value γ, and the x-axis intercept is referred to as a developing start potential) of the plotted data is calculated. The development potential required to obtain a target toner adhesion amount (target toner adhesion amount of a solid image) is calculated based on the linear approximation equation in step S709. Moreover, the charging potential Vd, the developing bias Vb, and the exposure potential VL matched to the development potential are calculated in steps of S710 to S714 to be described later.

The conditions for forming a 10-gradation patch pattern formed in step S705 are as follows.

Charging potential Vd: −700 V

Developing bias Vb: −550 V

Exposure power (LD power): 0.101 mW

Writing density: 2400 dpi by 2400 dpi

The charging potential Vd is the surface potential (background potential) of the photosensitive element 20 that is uniformly charged by the charging unit 60. The developing bias Vb is a potential value applied to the developing sleeve 65. Moreover, the exposure power (LD power) is the exposure power (hereinafter, denoted by "Lp") exerted on the photosensitive element 20. Furthermore, "LD duty" is an exposure time per unit area.

Figure 42:
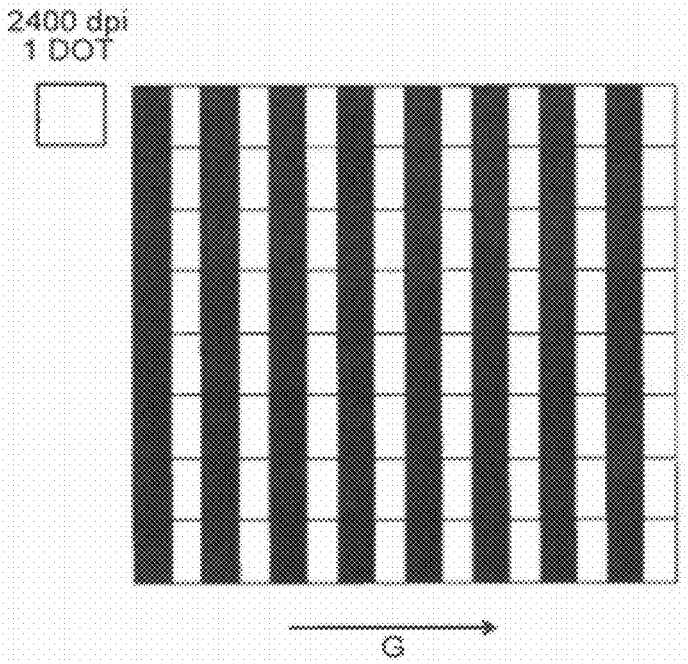
FIG. 42 is an explanatory diagram illustrating a halftone image with an exposure Duty of 32/64.

FIG. 42 is a schematic diagram illustrating a latent image pattern (32/64) when the latent image area per unit area (an area corresponding to 64 dots) is made to correspond to 32 dots by changing an exposure time per unit area (one dot area) in accordance with a duty only. In FIG. 42, the direction indicated by an arrow G is the main-scanning direction, and black portions represent latent image portions exposed by light emitted by a light source.

By changing the duty when exposing the respective dots, it is possible to set the latent image area (the number of latent image dots) per unit area (an area corresponding to 64 dots) to 32/64. Moreover, by continuously lighting the light source, it is possible to set the number of latent image dots per unit area to 64/64.

As a method of controlling the exposure time per unit area, a method of forming an exposed area and a non-exposed area in one dot latent image as in the case of FIG. 42 and a method of controlling the number of dots per unit area using a combination of exposed dots and non-exposed dots may be used. Between the two methods, the latter method can better stabilize the latent images.

Figure 43:
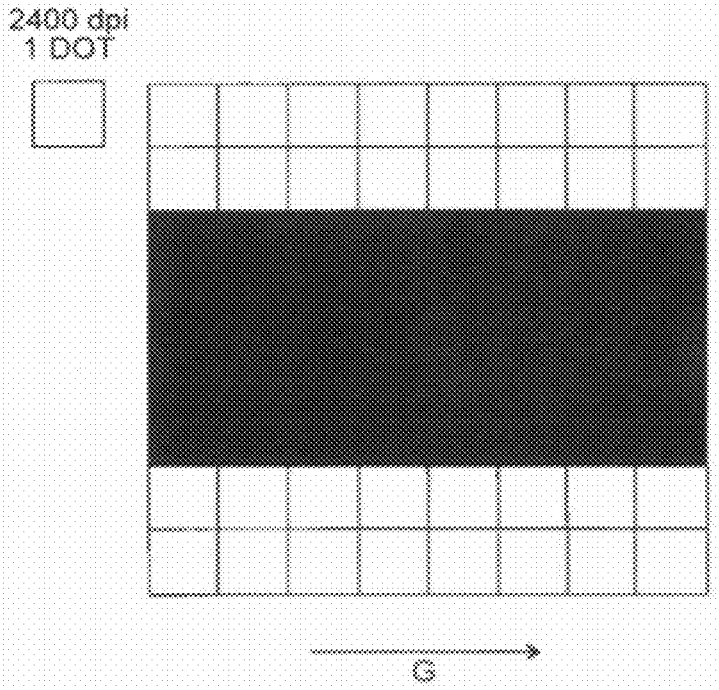
FIG. 43 is an explanatory diagram illustrating another example of a halftone image with an exposure Duty of 32/64.

FIG. 43 is a schematic diagram illustrating a latent image pattern when the number of latent images per unit area is set to 32/64 using a combination of exposed dots and non-exposed dots.

In the example illustrated in FIG. 43, each dot latent image is either entirely exposed or not exposed. As illustrated in FIG. 43, the number of latent image dots per unit area is changed by changing the LD duty using a combination of exposed dots and non-exposed dots. In this case, because the exposed latent images are formed on the photosensitive element in a concentrated manner, it is possible to form latent images stably as compared to the example of FIG. 42 in which latent images are formed while changing the LD duty for every dot.

Moreover, in the latent image pattern illustrated in FIG. 43, exposed dots (latent image dots) are concentrated so as to be adjacent to each other. By concentrating the exposed dots (latent image dots), there is a small boundary area between an exposed area and a non-exposed area as compared to the latent image pattern illustrated in FIG. 42. Thus, the latent images are stabilized even when the two patterns have the same number (32/64) of latent image dots per unit area. Moreover, the exposed dots are continuous in the main-scanning direction. In the latent image pattern illustrated in FIG. 42, because the light source is frequently turned on and off, the latent images are likely to become unstable. In contrast, in the case of the latent image pattern illustrated in FIG. 43, because the light source is in the ON state when the latent image dots appear continuously in the main-scanning direction, the latent image becomes more stable than the latent image pattern of FIG. 42.

Figure 44:
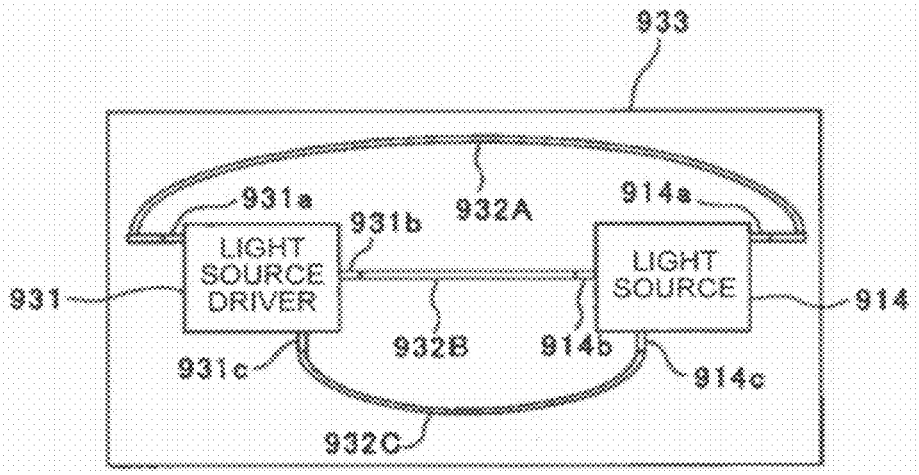
FIG. 44 is a schematic drawing illustrating a light source driver, a light source, and a substrate on which the light source driver and the light source are mounted, and wirings on the substrate, for electrically connecting the light source driver and the respective light-emitting portions of the light source, which are mounted on an exposing unit.

FIG. 44 is a schematic diagram illustrating a light source driver 931, a light source 914 including a plurality of light-emitting portions, a substrate 933 on which the light source driver 931 and the light source 914 are mounted, and wirings 932A, 932B, and 932C on the substrate 933, for electrically connecting the light source driver 931 and the respective light-emitting portions of the light source 914, which are provided in the exposing unit 900.

In FIG. 44, for convenience of description, only three light-emitting portions 930A, 930B, and 930C among forty light-emitting portions are illustrated. Moreover, an IC package that forms the light source driver 931 includes IC pins 931*a*, 931*b*, and 931*c* for supplying an emission level current to the light-emitting portions 930A, 930B, and 930C. The package of the light source 914 includes light source pins 914*a*, 914*b*, and 914*c*. The wiring 932A connects the IC pin 931*a* and the light source pin 914*a*, the wiring 932B connects the IC pin 931*b* and the light source pin 914*b*, and the wiring 932C connects the IC pin 931*c* and the light source pin 914*c*.

Figure 45:
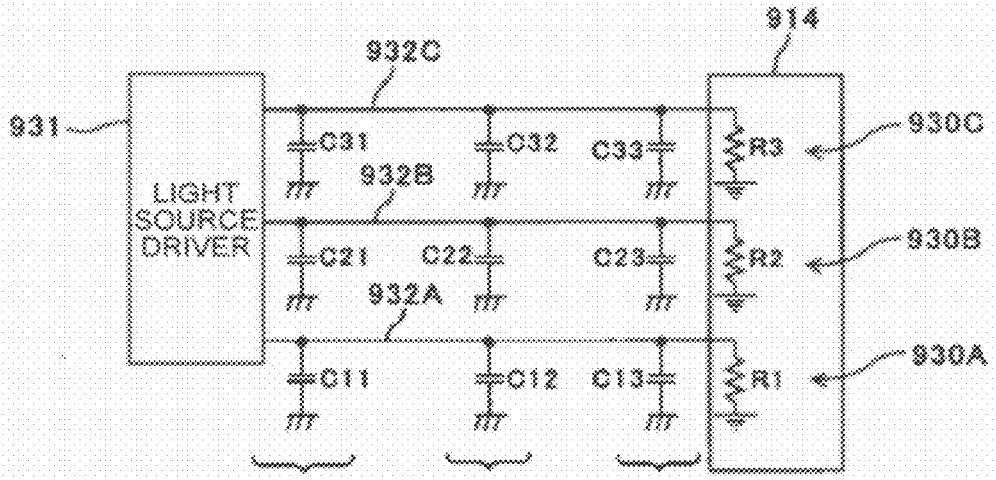
FIG. 45 is an explanatory diagram illustrating an overview of an equivalent circuit of the wirings connecting the light source driver and the respective light-emitting portions of the light source.

FIG. 45 is an explanatory diagram illustrating the overview of an equivalent circuit of the wirings connecting the light source driver 931 and the respective light-emitting portions 930A, 930B, and 930C of the light source 914.

In FIG. 45, the IC pins 931*a*, 931*b*, and 931*c* have capacitances C11, C21, and C31, respectively. The wirings 932A, 932B, 932C have coupling capacitances C12, C22, and C32, respectively. The light-emitting portions 930A, 930B, and 930C have capacitance components C13, C23, and C33, respectively. Moreover, the light-emitting portions 930A, 930B, and 930C have resistance components R1, R2, and R3, respectively.

Figure 46:
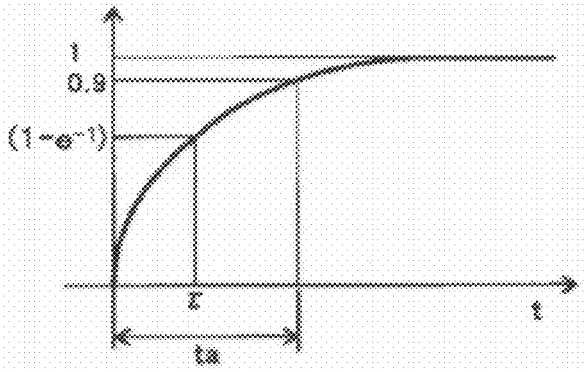
FIG. 46 is a graph illustrating a time constant and rising characteristics when a light-emitting portion emits light.

FIG. 46 is a graph illustrating a time constant and rise characteristics when a light-emitting portion emits light.

The system (channel) extending from the light source driver 931 to the light-emitting portion 930A has a capacitance component of C1<C11+C12+C13. Due to this capacitance component C1 and the resistance component R1 of the light-emitting portion 930A, this system as a whole has a time constant $\tau 1 = R1 \times C1$. The same goes for the other light-emitting portions. For example, when a constant pulse current is applied in a pulse shape and the pulse height is 1, the time constant τ indicates the time required for the current magnitude to reach $(1-e^{-1})$. On the other hand, for example, when a constant pulse current is applied in a pulse shape and the pulse height is 1, the rise characteristics can be expressed by the time (rise time ta) required for the current magnitude to change from 0.1 to 0.9. Response characteristics of a pulsed waveform are easily understood by considering the rise characteristics. The relation between the rise characteristics and the time constant is defined by $ta = 2.2 \times \tau$ based on a relational equation between the response characteristics and the rise characteristics. The same goes for a fall time. That is, when the wirings 932A, 932B, and 932C are extended so that the coupling capacitances C12, C22, and C32 increase, the time constant τ increases, and the rise time increases.

Because the light source 914 of the present embodiment includes light-emitting portions as many as 40, the wiring pattern between the light source 914 and the light source driver 931 is complex. Moreover, the wirings are extended so that the coupling capacitance of the wiring increases, and the rise time is relatively long. The rise time ta is generally 10 ns or shorter when the light source 914 is a multi-channel VCSEL, and is 5 ns or shorter when the light source 914 is an end-emitting LD. If it is not possible to secure this rise time when forming dot latent images, it is difficult to obtain a stable light amount, and the formed dot latent images become unstable. On the other hand, if the dot latent images are too concentrated so as to obtain stable light amount, the relation between the potential of the patch latent image detected in the detection step (S706) and the toner adhesion amount of the patch in a low-density patch having a few dot latent images may deviate greatly from the original relation (linear relation).

Figure 47:
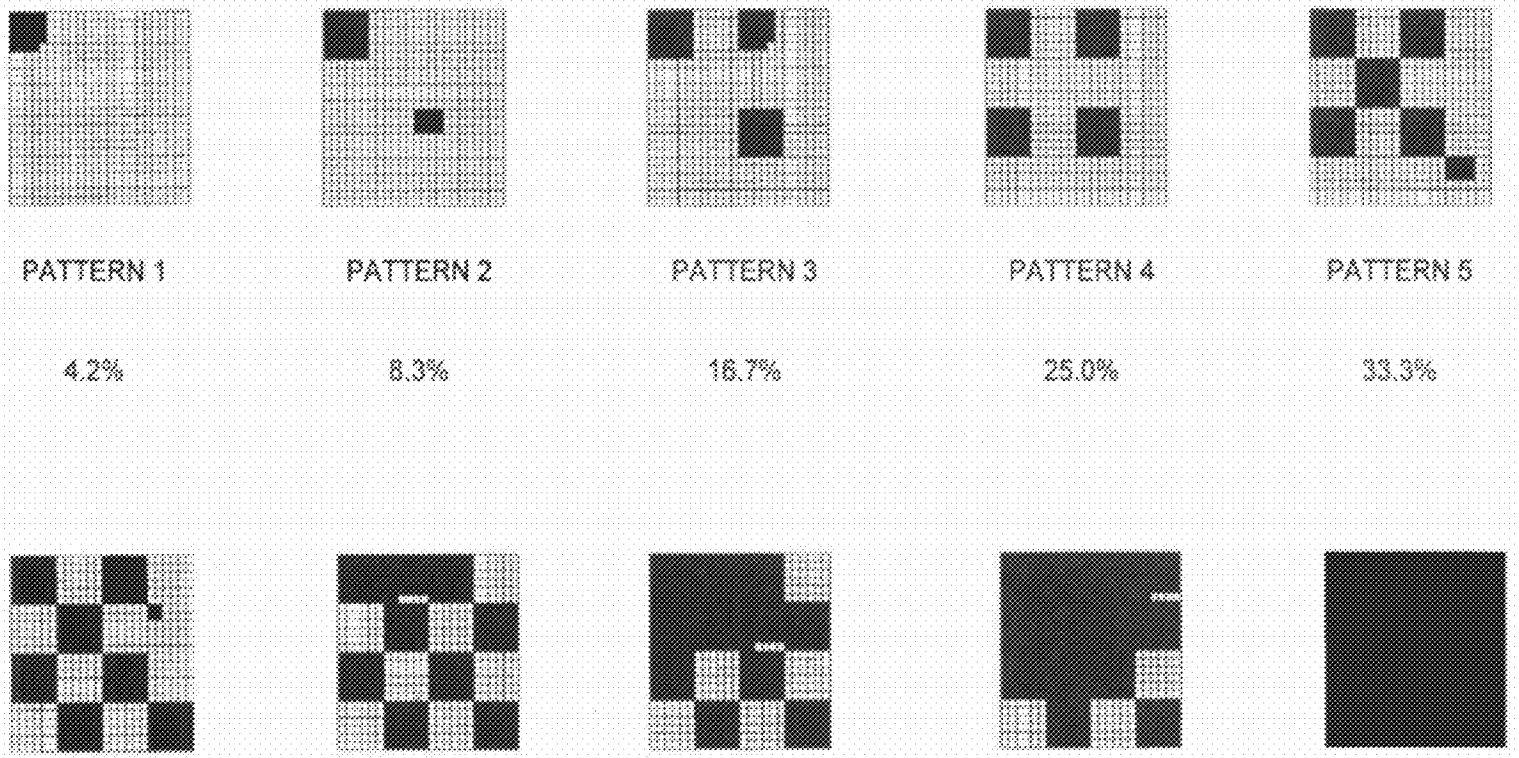
FIG. 47 is an explanatory diagram illustrating a 10-gradation pattern of a first pattern example.

FIG. 47 is an explanatory diagram illustrating a formation example (hereinafter referred to as a "first pattern example") of a 10-gradation pattern.

Figure 48:
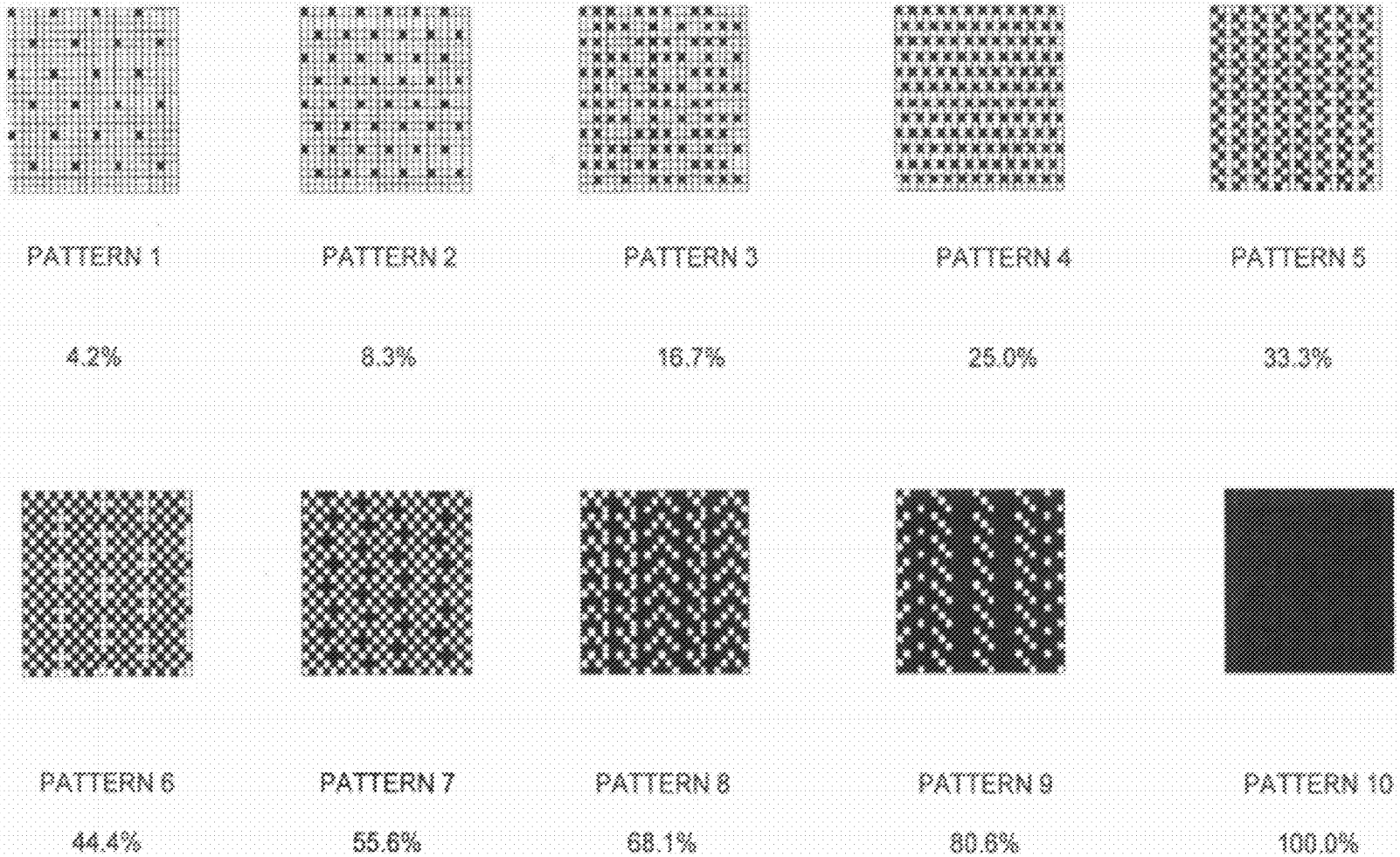
FIG. 48 is an explanatory diagram illustrating a 10-gradation pattern of a second pattern example.

FIG. 48 is an explanatory diagram illustrating another formation example (hereinafter referred to as a "second pattern example") of a 10-gradation pattern.

These 10-gradation patterns have a writing density of 2400 dpi by 2400 dpi, and each patch is formed by a repetition of a basic dot matrix including 24 dots by 24 dots. The 10 patches having different densities, that form the 10-gradation pattern of the respective pattern examples, are formed by a basic dot matrix having dot latent image patterns like the patterns 1 to 10 for each pattern example shown in the drawings. The patches of any pattern example are formed such that the number and arrangement of dot latent images in the basic dot matrix are different format in units of a unit dot latent image in accordance with the corresponding density. In the first and second pattern examples described herein, patches having different densities are formed such that the number and arrangement of dot latent images are different in units of one dot latent image (that is, the unit dot latent image includes one latent image dot). In these first and second pattern examples, although a 10-gradation pattern is formed by such area gradation control, the arrangement of dot latent images in the basic dot matrix is different from one pattern example to another. In any pattern example, the number of dot latent images in the basic dot matrix is the same.

When the ratio (hereinafter referred to as a "latent image ratio") of the number of latent image dots written within the basic dot matrix to the entire number of dots in the basic dot matrix is denoted by "a", the latent image ratio "a" is 0.5 or less for the patterns 1 to 6. That is, the ratio of the latent image area within the basic dot matrix is 50% or less. In this case, when the length in the main-scanning direction of each of groups of concentrated dot latent images that are arranged to be adjacent to each other is denoted by "cm" [dot], and the length in the sub-scanning direction of each of the groups of the concentrated dot latent images is denoted by "cs" [dot], the writing density in the main-scanning direction is denoted by ρm [dpi], and the writing density in the sub-scanning direction is denoted by ρs [dpi], $(\rho m \times \rho s)/(600^2)=(2400\times 2400)/(600^2)=16$ is obtained. Therefore, when the size of concentrated dot latent images is set so as to satisfy a relation that $cm \times cs \leq 16$, the dot latent images may not be concentrated more than a case in which the writing density is 600 [dpi]×600 [dpi].

When the writing density is 600 [dpi]×600 [dpi], even if the dot latent images are formed in a concentrated manner, it does not give rise to the problem in which the relation between the potential of a patch latent image and the toner adhesion amount of the patch deviates greatly from the original linear relation. Thus, in the present embodiment where the writing density is as high as 2400 [dpi]×2400 [dpi], by forming the patches of the respective densities so that the latent image dots are not concentrated more than the case in which the writing density is 600 [dpi]×600 [dpi], it is possible to prevent the occurrence of the above problem as in the case of the writing density of 600 [dpi]×600 [dpi]. As a result, it is possible to include a low-density patch in the 10-gradation pattern used for detecting the relation between the patch latent image potential and the toner adhesion amount of the patch. Therefore, it is possible to use patch patterns having a wide density range and detect the relation with high accuracy. Accordingly, high-accuracy density adjusting control can be performed.

The size cm×cs of the groups of the concentrated dot latent images when $a \leq 0.5$ was calculated for the first and second pattern examples. In the 10-gradation pattern of the first pattern example, the size cm×cs was 5×5=25 for the patches of the pattern 1 and was 6×6=36 for all patterns 2 to 6. On the other hand, in the 10-gradation pattern of the second pattern example, the size cm×cs was 1×1=1 for all patterns 1 to 6. In the pattern 1 of the first pattern example, in which the size cm×cs of the concentrated dot latent images is the smallest, namely the dot latent images are least concentrated, the size cm×cs was 25. This means that the dot latent images are concentrated more than the case in which the writing density is 600 [dpi]×600 [dpi]. In contrast, in the second pattern example, because the respective dot latent images are dispersed so as not to be adjacent to each other, the dot latent images are not concentrated more than the case in which the writing density is 600 [dpi]×600 [dpi].

In the above description, the gradation for one dot has been expressed with two values; one value is for a case in which the dot is exposed and the other is for a case in which the dot is not exposed. However, the number of gradation levels of one dot may be 3 or more. In this case, the values "cm" and "cs" may have values other than an integer, such as "cm"=½.

Figure 49:
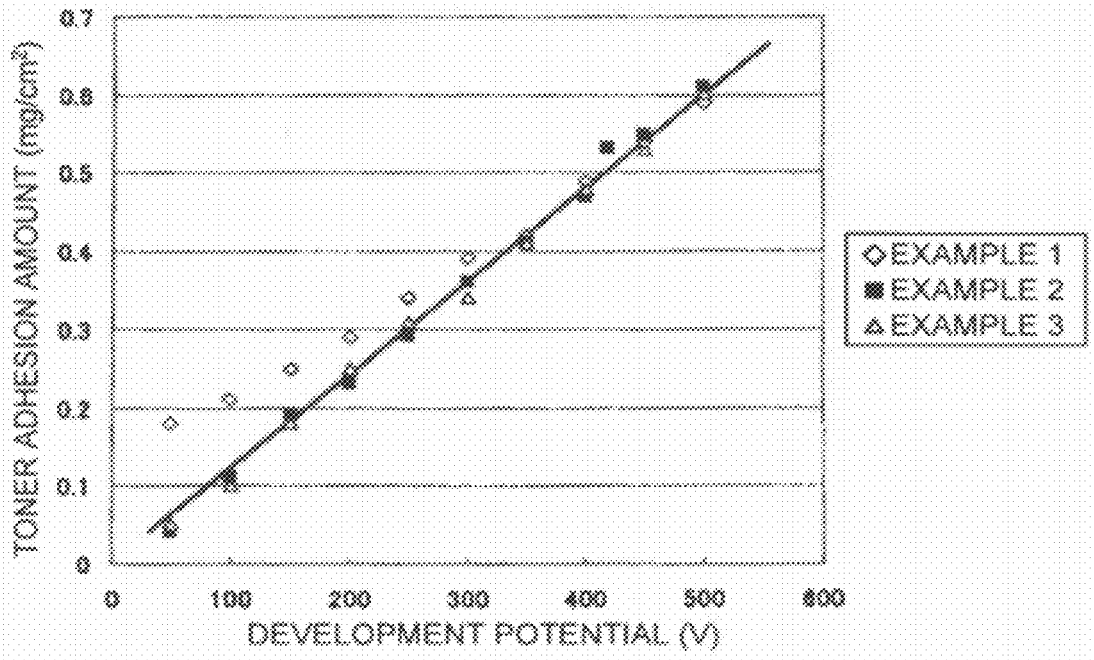
FIG. 49 is a graph plotting the relation between a development potential and a toner adhesion amount to each patch calculated from a detection result of each patch potential of the 10-gradation pattern of each pattern example.

FIG. 49 is a graph plotting the relation between a development potential and a toner adhesion amount of each patch calculated from the detection results of the respective patch potentials of the 10-gradation pattern in each pattern example.

The development potential shown on the horizontal axis of the graph is a difference between a developing bias when the 10-gradation pattern is developed and a potential read by the potential sensor 320 reading the respective patches of the 10-gradation pattern. Moreover, the toner adhesion amount shown on the vertical axis of the graph is obtained by calculating the densities of the respective toner patches obtained by developing the 10-gradation pattern from the values read by the density sensor 310.

In the graph shown in FIG. 49, viewing the first pattern example, in the four patterns 1 to 4 having a particularly low density among the patterns 1 to 6 which are low-density patches, the relation between the development potential and the toner adhesion amount deviates from the linear relation toward the large toner adhesion amount side. In contrast, the second pattern example shows that all 10 patches satisfy the linear relation. In general, because the relation between the development potential and the toner adhesion amount is in the linear relation, in the case of the second pattern example, the low-density patches are also helpful in detecting the relation with high accuracy.

In the second pattern example, the arrangement pattern of the dot latent images of the low-density patches is devised so that the dot latent images are dispersed so as not to be concentrated. Specifically, the low-density patches are dot-dispersed latent image patches in which the arrangement of dot latent images in the basic dot matrix are determined such that the minimum center-to-center distance having the smallest value among the center-to-center distances of unit dot latent images (in this example, simply referred to as a dot latent image because the unit dot latent image includes one dot latent image).

Figure 50:
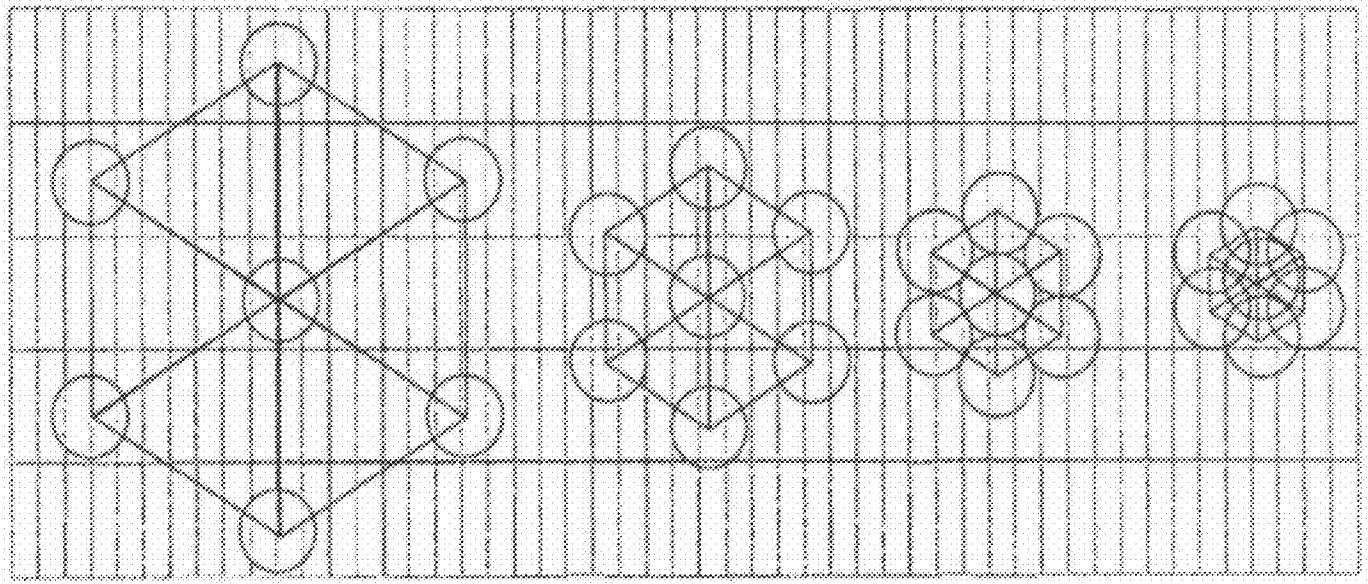
FIG. 50 is an explanatory diagram illustrating an arrangement in which dot latent images are most evenly dispersed.

An arrangement in which dot latent images are most evenly dispersed is an arrangement in which all angles (hereinafter referred to as "center-to-center angles") between imaginary straight lines connecting the centers of dot latent images are 60° as illustrated in FIG. 50. In this case, the center-to-center distances between the dot latent images are the same, and the dot latent images are evenly dispersed. However, because writing dots need to be arranged in a lattice form, it is difficult to distribute dot latent images in such an evenly dispersed manner. Thus, the arrangement of dot latent images when the center-to-center angle is changed slightly from 60° will be discussed.

Figure 51:
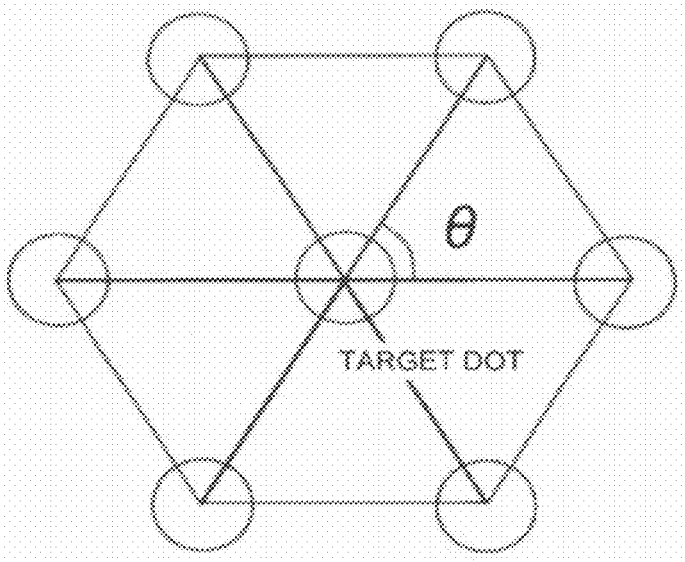
FIG. 51 is an explanatory diagram illustrating an angle θ between a main-scanning dot line and imaginary lines that connect a target dot and adjacent dots located at intersections between adjacent main-scanning dot lines and adjacent sub-scanning dot lines of the target dot.
Figure 52:
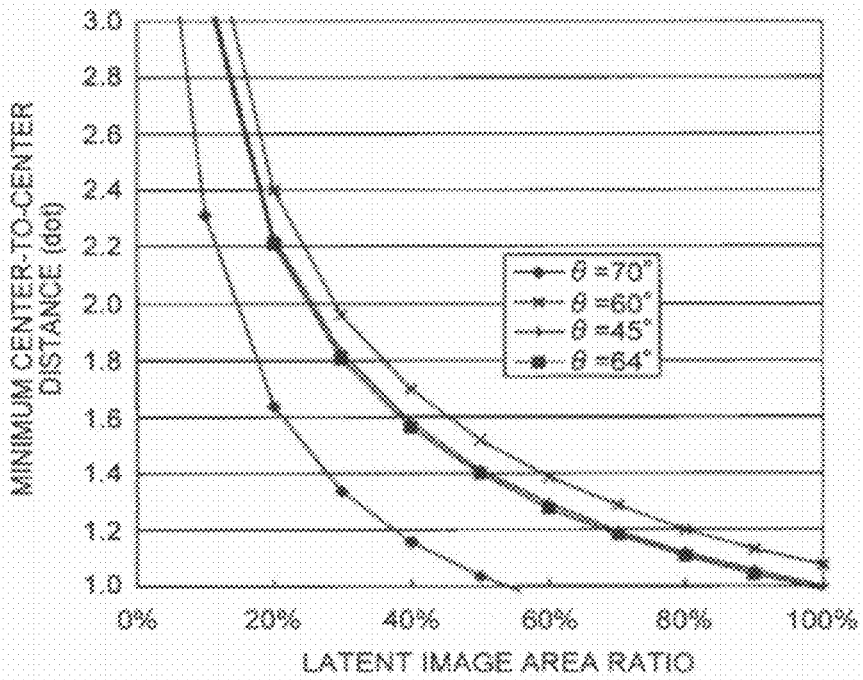
FIG. 52 is a graph illustrating the relation between a latent image area ratio and a minimum center-to-center distance in a basic dot matrix when θ is changed.

As illustrated in FIG. 51, dots present at the intersections between adjacent main-scanning dot lines adjacent to a main-scanning dot line in the main-scanning direction in which a target dot is present and adjacent sub-scanning dot lines adjacent to a sub-scanning dot line in the sub-scanning direction in which the target dot is present are referred to as adjacent dots. Moreover, the angle between the main-scanning dot line and imaginary straight lines connecting the adjacent dots and the target dot is denoted by θ. When the distance between main-scanning dot lines and the distance between sub-scanning dot lines are changed so that θ is changed without causing a change to the writing density, and when dot latent images are arranged so as to be separated as farthest as possible, the center-to-center distance between the nearest dot latent images is defined as a minimum center-to-center distance. The relation between the latent image area ratio in the basic dot matrix and the minimum center-to-center distance is shown in the graph of FIG. 52. The minimum center-to-center distance is the largest when θ=60° because the center-to-center distances between dots are all equal to each other. The minimum center-to-center distance decreases when θ deviates from θ=60° because the center-to-center distances between dots deviate from an equal distance.

In order to analyze the tendency of the change in the minimum center-to-center distance with an increase in the latent image area ratio when θ deviates from θ=60°, the minimum center-to-center distances at the latent image area ratio when θ deviates ±15° from 60°, that is θ=45° and θ=75° were calculated. As shown in FIG. 52, even under the same deviation amount of 15°, the decreased amount (hereinafter referred to as a "decreasing rate") of the minimum center-to-center distance with an increase in the latent image area ratio for θ=45° is smaller than that for θ=75°. That is, the decreasing rate of the minimum center-to-center distance is small for θ in the range of 45° to 60°, and the decreasing rate of the minimum center-to-center distance increases when θ exceeds 60°. Moreover, as shown in FIG. 52, among the values of θ greater than 60°, the decreasing rate of the minimum center-to-center distance for θ=64° is almost the same as that for θ=45°. If the decreasing rate of the minimum center-to-center distance for θ=45° is the lower limit of an allowable range (a range where a minimum center-to-center distance of one dot or more can be secured until the latent image area ratio reaches about 100%), the decreasing rate for θ in the range of 45° to 64° can be said to be within the allowable range.

Figure 53:
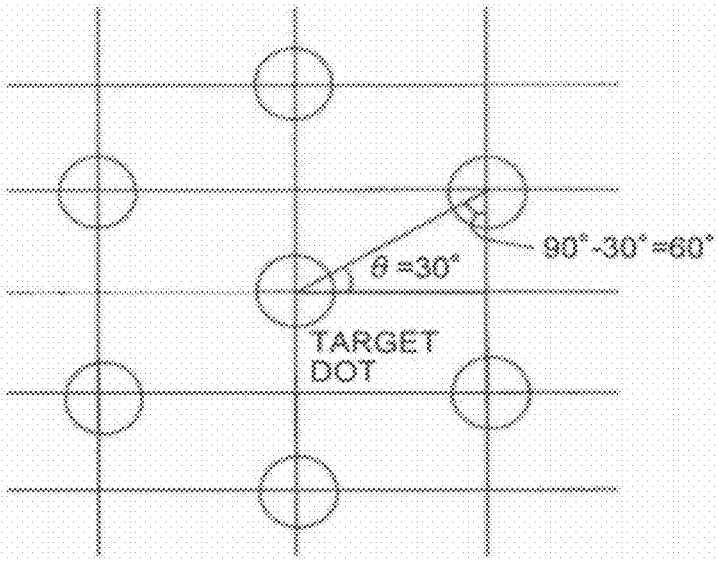
FIG. 53 is an explanatory diagram illustrating an example of a dot arrangement when θ=30°.
Figure 54:
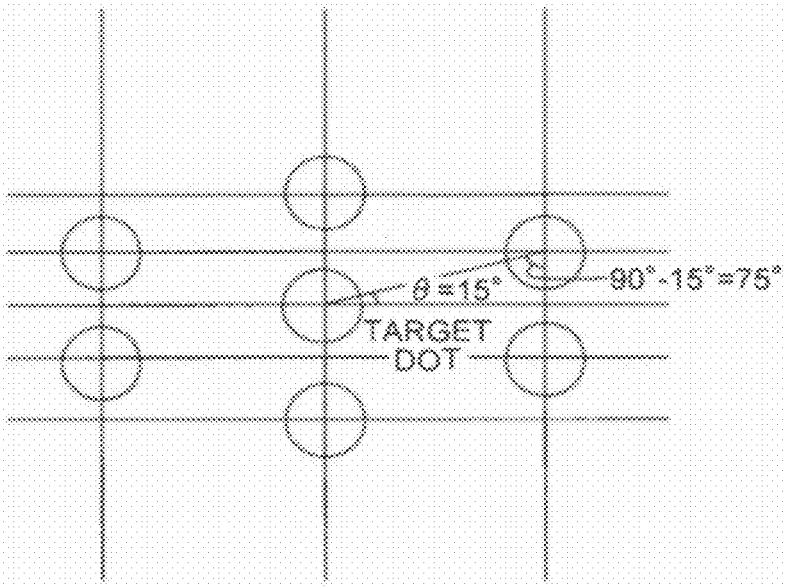
FIG. 54 is an explanatory diagram illustrating an example of a dot arrangement when θ=15°.
Figure 55:
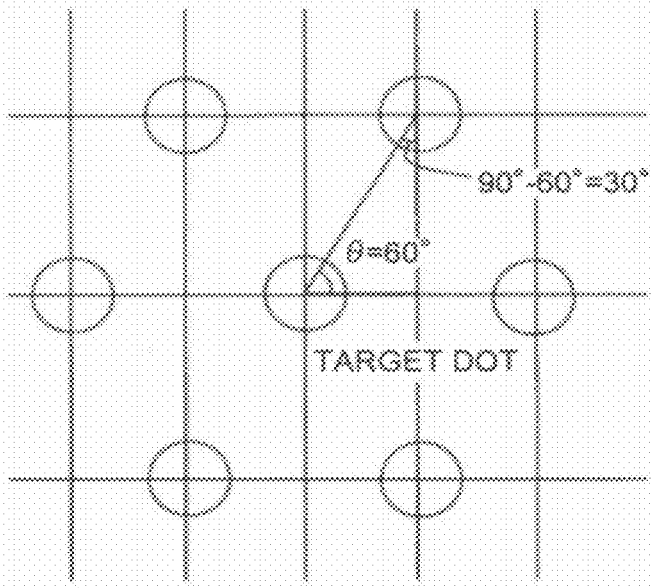
FIG. 55 is an explanatory diagram illustrating an example of a dot arrangement when θ=60'.
Figure 56:
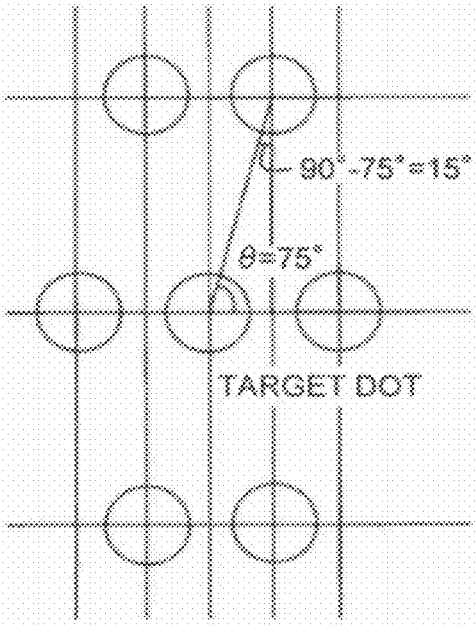
FIG. 56 is an explanatory diagram illustrating an example of a dot arrangement when θ=75°.

Examples in which θ is smaller than 45° will be examined. FIG. 53 illustrates an example of a dot arrangement for θ=30°, and FIG. 54 illustrates an example of a dot arrangement for θ=15°. Because dots are required to be arranged in a lattice form, dots have to be arranged in the main-scanning direction and the sub-scanning direction using a right-angled triangle as a basic unit as shown in FIGS. 53 and 54, so that the right-angled triangles appear in integer multiples. In this case, one angle of the right-angled triangle corresponds to θ, and the other angle becomes "90°−θ." That is, the dot arrangement for θ=30° shown in FIG. 53 can be said to be equivalent to that for θ=60° shown in FIG. 55 in which the main-scanning direction and the sub-scanning direction are interchanged with each other. Similarly, the dot arrangement for θ=15° shown in FIG. 54 can be said to be equivalent to that for θ=75° shown in FIG. 56 in which the main-scanning direction and the sub-scanning direction are interchanged with each other. As above, the dot arrangement for θ of 45° or less is equivalent to that for "90°−θ" when the main-scanning direction and the sub-scanning direction are interchanged with each other. Therefore, θ=64° which is the upper limit of the allowable range of the decreasing rate of the minimum center-to-center distance is equivalent to (90°−64°)=26°. Thus, the allowable range of the decreasing rate of the minimum center-to-center distance is increased to the range of θ from 26° to 64°.

In the second pattern example, the values of θ of the patterns 1 to 6 for a ≤0.5 are calculated to be θ=53° for the pattern 1, θ=56° for the pattern 2, and θ=45° for the patterns 3 to 6. Therefore, it can be said that all patterns 1 to 6 corresponding to the low density patches in the second pattern example are latent image patterns in which dot latent images are arranged so as to have the largest minimum center-to-center distance, and the decreasing rate of the minimum center-to-center distance falls within the allowable range.

In the exposing unit 900 of the present embodiment, the polygon mirror has six surfaces, the writing field angle is 39°, and the writing width is 328 mm. Moreover, because the field frequency b is 42.8 MHz, b/100=42.8/100=0.428. Thus, there is no problem with the rise time of an exposure waveform as long as lighting continues for a period corresponding to "cm" which is 0.428 dots or more. That is, also in the latent image patterns of the second pattern example, it is possible to form a stable multi-gradation patch pattern.

First Modification

Next, a modification (hereinafter referred to as a "first modification") in which a configuration of an exposing unit 900 and of a multi-gradation patch pattern used for image density adjusting control will be described.

The light source 914 of the first modification includes the two-dimensional array 901 in which forty light-emitting portions 101 are formed on one substrate similarly to the above embodiment. However, in the first modification, the spacing (ds2 in FIG. 10) between adjacent rows of light-emitting portions in the Dir_sub direction is 24.0 μm, and the spacing (d1 in FIG. 10) of light-emitting portions in the T direction in each row of light-emitting portions is 24.0 μm. Moreover, when each of the light-emitting portions 101 is orthogonally projected on an imaginary line extending in the Dir_sub direction, the spacing (ds1 in FIG. 10) between light-emitting portions 101 becomes 2.4 μm.

Figure 57:
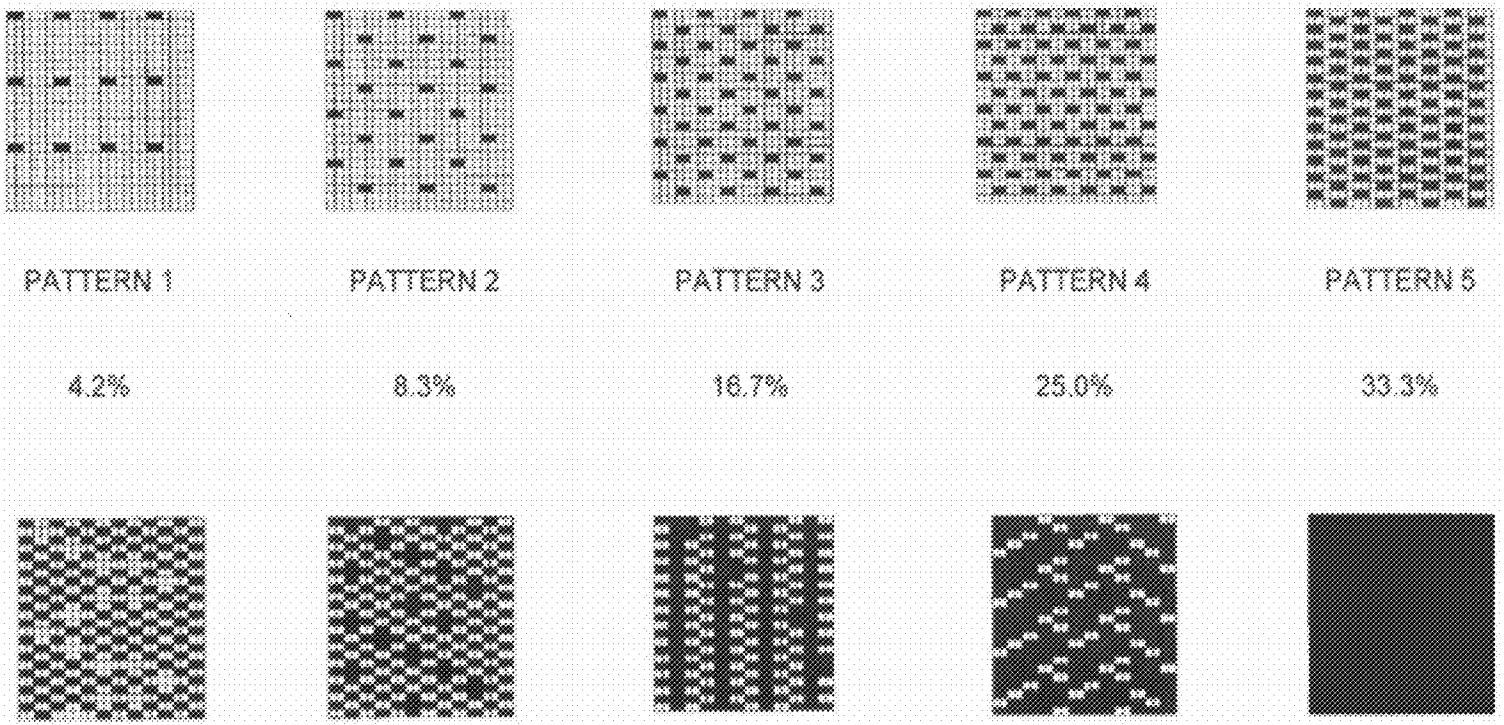
FIG. 57 is an explanatory diagram illustrating a 10-gradation pattern of a third pattern example.

FIG. 57 illustrates still another formation example (hereinafter referred to as a "third pattern example") of a 10-gradation pattern.

The multi-gradation patch pattern of the first modification is also a 10-gradation pattern similarly to the above embodiment as shown in FIG. 57 with a difference lying in that the writing density of the former is 4800 [dpi]×4800 [dpi]. Moreover, the 10 patches having different densities to configure the 10-gradation pattern of the first modification are formed by repetition of a basic dot matrix that includes 24 dots by 24 dots, and are formed with a basic dot matrix having the same dot latent image patterns as the patterns 1 to 10 of the second pattern example. However, in the third pattern example of the first modification, patches having different densities are formed such that the number and arrangement of dot latent images are different in units of two dot latent images (that is, in the first modification, the unit dot latent image is formed by a group of two latent image dots). In the 10-gradation pattern of the third pattern example according to the first modification, the latent image area ratios of the respective patches of the patterns 1 to 10 are the same as those of the other pattern examples.

In the case of the first modification, $(\rho m \times \rho s)/(600^2)=(4800\times4800)/(600^2)=64$. Therefore, when a size of a group of concentrated dot latent images (corresponding to the unit dot latent images in the first modification) is set so as to satisfy a relation that $cm\times cs\leq 64$, the dot latent images may not be concentrated more than the case in which the writing density is 600 [dpi]×600 [dpi]. The sizes cm×cs of concentrated dot latent images for a ≤0.5 were calculated for the third pattern example. In the 10-gradation pattern of the third pattern example, the size cm×cs was 2×1=2 for all patches of the patterns 1 to 6. Thus, in the third pattern example, because the unit dot latent images are dispersed so as not to be adjacent to each other, the dot latent images are not concentrated more than the case in which the writing density is 600 [dpi]×600 [dpi].

The relation between the development potential and the toner adhesion amount in the third pattern example is shown in FIG. 49 together with those of the first and second pattern examples. The third pattern example shows that all 10 patches satisfy the linear relation. Therefore, in the case of the third pattern example, the low-density patches are also helpful in detecting the relation with high accuracy.

In the exposing unit 900 of the first modification, the polygon mirror has six surfaces, the writing field angle is 39°, and the writing width is 328 mm. Moreover, because the field frequency b is 171.2 MHz, b/100=171.2/100=1.712. Thus, there is no problem with the rise time of an exposure waveform as long as lighting continues for a period corresponding to "cm" which is 1.712 dots or more. That is, when the patch pattern in which the density is adjusted in units of a unit dot latent image having a size of cm=2 as in the case of the third pattern example is used, it is possible to form a stable multi-gradation patch pattern.

Second Modification

Next, another modification (hereinafter referred to as a "second modification") on a configuration of the exposing unit 900 and a multi-gradation patch pattern used for image density adjusting control will be described.

Figure 58:
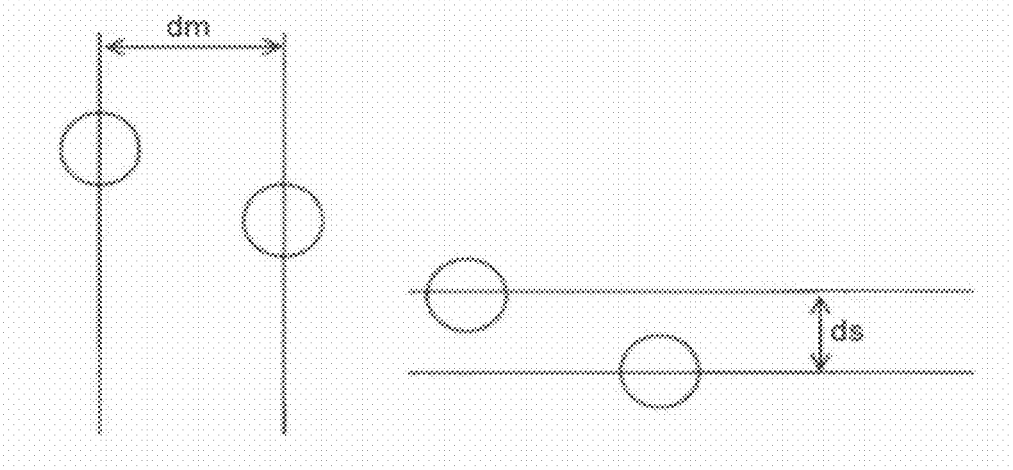
FIG. 58 is an explanatory diagram illustrating an array of light-emitting portions used in a second modification in which an end-emitting-type 4-channel LD array is used as a light source.

The light source 914 of the second modification includes a 4-channel LD array of a so-called end-emitting type that emits light in a direction parallel to the substrate surface rather than using the two-dimensional array of the above embodiment (a VCSEL-type light source that emits light in a direction perpendicular to the substrate surface). In the second modification, as shown in FIG. 58, the spacing (ds in FIG. 58) between adjacent rows of light-emitting portions in the Dir_sub direction is 9.6 μm.

The multi-gradation patch pattern of the second modification is also a 10-gradation pattern similarly to the above embodiment with a difference lying in that the writing density of the former is 1200 [dpi]×1200 [dpi]. Moreover, 10 patches having different densities, which form a 10-gradation pattern of the second modification, are formed by repetition of a basic dot matrix that includes 24 dots by 24 dots, and are formed with a basic dot matrix having the same dot latent image patterns as the patterns 1 to 10 of the second pattern example. Specifically, patches having different densities are formed such that the number and arrangement of dot latent images are different in units of one dot latent image (that is, in the second modification, the unit dot latent image includes one latent image dot). In the 10-gradation pattern (hereinafter referred to as a "fourth pattern example) according to the second modification, latent image area ratios of respective patches of patterns 1 to 10 are the same as those of the other pattern examples.

In the case of the second modification, $(\rho m\times\rho s)/(600^2)=(1200\times1200)/(600^2)=4$. Therefore, when the sizes of concentrated dot latent images (corresponding to the unit dot latent images in the second modification) are set so as to satisfy a relation that $cm\times cs\leq 4$, the dot latent images may not be concentrated more than the case in which the writing density is 600 [dpi]×600 [dpi]. The sizes cm×cs of concentrated dot latent images for a ≤0.5 were calculated in the fourth pattern example. In the 10-gradation pattern of the fourth pattern example, the size cm×cs was 1×1=1 for all patches of the patterns 1 to 6. Thus, in the fourth pattern example, because the unit dot latent images, that is, the respective dot latent images are dispersed so as not to be adjacent to each other, the dot latent images are not concentrated more than the case in which the writing density is 600 [dpi]×600 [dpi].

Although the relation between the development potential and the toner adhesion amount in the fourth pattern example is not shown, all 10 patches satisfy the linear relation similarly to the second and third pattern examples. Therefore, in the case of the fourth pattern example, the low-density patches are also helpful in detecting the relation with high accuracy.

In the exposing unit 900 of the second modification, the polygon mirror has six surfaces, the writing field angle is 39°, and the writing width is 328 mm. Moreover, because the field frequency b is 107.0 MHz, b/200=107.0/200=0.535. Thus, there is no problem with the rise time of an exposure waveform as long as lighting continues for a period corresponding to "cm" which is 0.535 dots or more. That is, when the patch pattern in which the density is adjusted in units of a unit dot latent image having a size of cm=1 as in the case of the second pattern example is used, it is possible to form a stable multi-gradation patch pattern.

In the present embodiment (including the first and second modifications; the same herein below), in step S709, the above-described 10-gradation pattern is formed, the potential of each patch and the toner adhesion amount of each patch are detected to calculate a linear approximation equation as shown in FIG. 49. Then, a development potential necessary for obtaining a target toner adhesion amount (a target toner adhesion amount of a solid image) is calculated based on the calculated linear approximation equation. When the target toner adhesion amount is denoted by Mmax, the slope of the linear approximation equation is denoted by γ, and the y-axis intercept is denoted by b, the necessary development potential Pmax can be obtained from $Mmax=\gamma\times Pmax+bpmax=(Mmax-b)/\gamma$.

When the development potential necessary for obtaining the target toner adhesion amount is calculated in step S709, the residual potential Vr of the photosensitive element 20 is detected in step S710. In this detection, the exposure power of the exposing unit 900 is controlled so as to obtain the maximum light amount, and the potential read by the potential sensor 320 at that time is used as the residual potential Vr of the photosensitive element 20. In a normal situation, a potential detected after performing the processes of charging, exposing, developing, transferring, cleaning, and neutralizing is referred to as the residual potential Vr. However, in the present embodiment, because the potential sensor 320 is provided between the exposure unit and a developing unit, the exposing process with the maximum light amount is performed instead of performing the neutralizing process, and a potential after the exposing process with the maximum light amount is referred to as a residual potential Vr.

If the residual potential Vr exceeds a reference value (for example, a residual potential Vr when the photosensitive element 20 is charged to a predetermined charging potential Vd and then exposed with light having the maximum light amount in the initial state), a potential obtained by adding the difference between the residual potential Vr and the reference value to the predetermined charging potential Vd is set as a target charging potential in step S711. When forming color images, in step S711, a power supply circuit (not shown) is adjusted so that the charging potential Vd of the photosensitive element 20 by the charging unit 60 becomes the target charging potential for each color in parallel. Moreover, the exposure power of the light source 914 is adjusted by the light source driver 931 of the exposing unit 900 so that a desired exposure potential between the exposure potential VL that is the surface potential of the photosensitive element after exposure and the target potential is obtained (step S711). The power supply circuit is further adjusted so that the developing bias Vb of the developing unit of each color provides a desired development potential between the developing bias Vb and the exposure potential VL (step S711).

A method of correcting a difference between the residual potential Vr and the reference value according to the related art will be described in detail below.

First, the exposure power when the residual potential Vr is measured will be described.

Figure 59A:
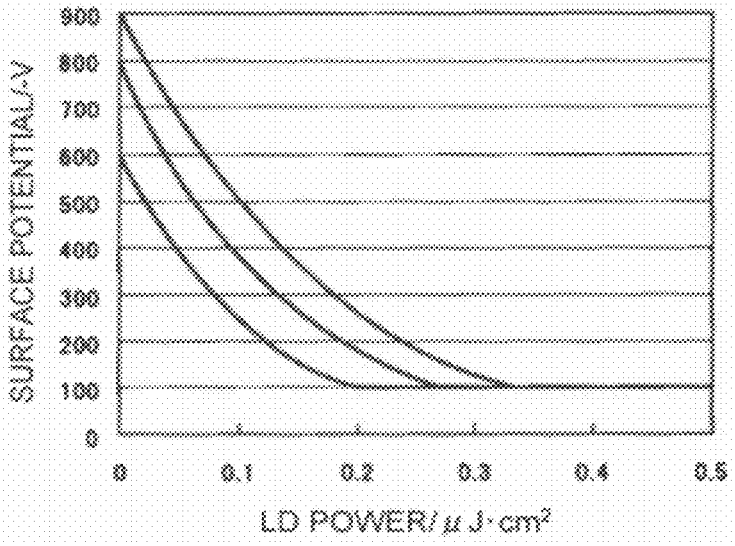
FIGS. 59A and 59B are explanatory diagrams illustrating correction control when the light attenuation characteristics of a photosensitive element are changed due to electrostatic fatigue.
Figure 59B:
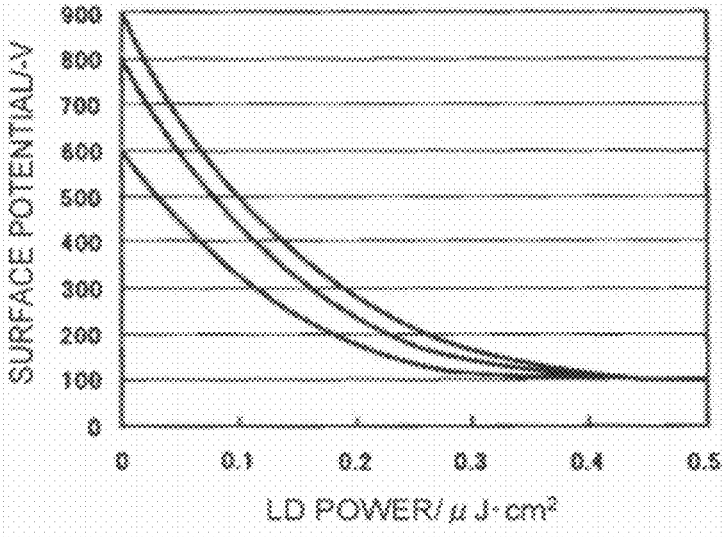

FIGS. 59A and 59B are graphs illustrating the relation between the exposure power (LD Power) Lp and the exposure potential VL when the charging potential Vd is changed to 600 V, 800 V, and 900 V. FIG. 59A illustrates an example of a photosensitive element in which the minimum value of the exposure power Lp in a potential saturation state, in which a potential rarely changes even when the exposure power is increased further, changes depending on the charging potential Vd. FIG. 59B illustrates an example of a photosensitive element in which the minimum value of the exposure power Lp in the potential saturation state does not change greatly even when the charging potential Vd is changed. In the drawing, the horizontal axis represents exposure energy ($\mu J/cm^2$), and the exposure energy can be read as the exposure power.

When measuring the residual potential Vr, an exposure power Lp (hereinafter referred to as a charging non-dependent exposure power Lpα) is used; the value of the exposure potential VL that is a surface potential of the photosensitive element after exposure does not change for the exposure power Lp even when the charging potential Vd is changed within a range used for an image forming process. The exposure power Lp is set to 0.35 $\mu J/cm^2$ or larger in the example shown in FIG. 59A, whereas the exposure power Lp is set to 0.40 $\mu J/cm^2$ or larger in the example shown in FIG. 59B. Typically, when a general photosensitive element is exposed by such a charging non-dependent exposure power Lpα, the photosensitive element may enter a potential saturation state.

Next, a correction method when the light attenuation characteristics of a photosensitive element are changed due to electrostatic fatigue will be described.

Figure 60:
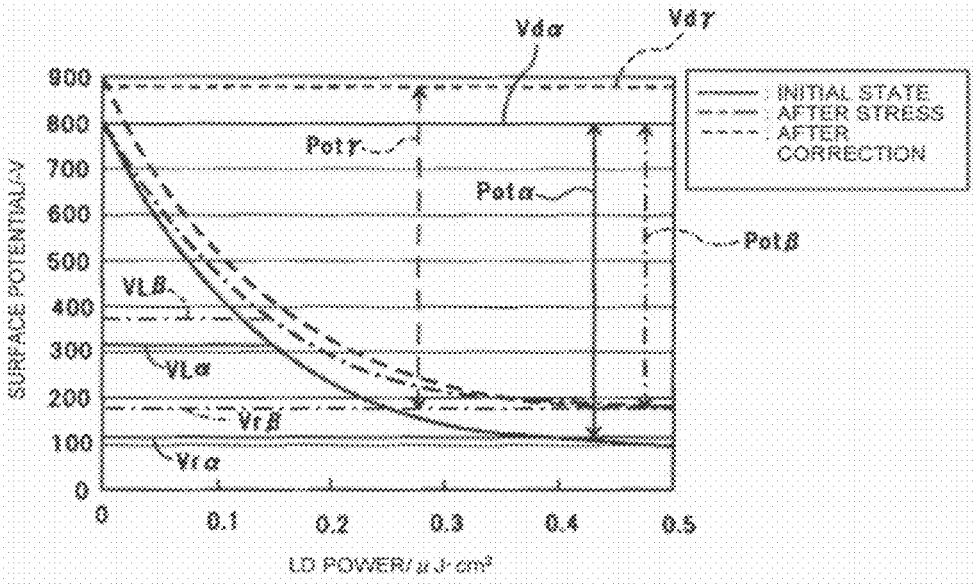
FIG. 60 is an explanatory diagram illustrating intermediate gradation control.

FIG. 60 illustrates correction control when the light attenuation characteristics of the photosensitive element described using FIG. 59B are changed.

In the example shown in FIG. 60, the exposure power of 0.45 $\mu J/cm^2$ is used. Before the photosensitive element receives electrostatic fatigue (initial state: see a solid line in FIG. 60), the initial residual potential Vrα which is the residual potential Vr has a smaller value. A sufficient exposure potential can be set between the initial residual potential Vrα and the initial charging potential Vdα (see the initial exposure potential Potα indicated by an arrow-headed solid line in FIG. 60). After the photosensitive element receives electrostatic fatigue (see a dashed-dotted curve in FIG. 60), a post-fatigue residual potential Vrβ which is the residual potential Vr of the photosensitive element becomes higher than the initial residual potential Vrα before having fatigue. Therefore, the exposure potential becomes smaller than the initial exposure potential (see a post-fatigue exposure potential Potβ indicated by an arrow-headed dashed-dotted line in FIG. 60). Accordingly, in order to obtain the same exposure potential as that of the initial state, the charging potential Vd is increased by an amount corresponding to "post-fatigue residual potential Vrβ"–"initial residual potential Vrα" to obtain a corrected charging potential Vdγ. With such a process, a necessary exposure potential (see a corrected exposure potential Potγ indicated by an arrow-headed broken line in FIG. 60) is obtained using the corrected charging potential Vdγ. By correcting the charging potential Vd in this way, the relation between the exposure potential VL and the exposure power Lp has the light attenuation characteristics as indicated by a broken line in FIG. 60. Thus, even when the photosensitive element has fatigue, it is possible to obtain the same exposure potential as that of the initial state.

When correcting the charging potential Vd, the residual potential Vr is measured using the charging non-dependent exposure power Lpα for the reason to be explained below.

As an example of the exposure power in which the value of the exposure potential VL changes when the charging potential Vd changes, a case of the exposure power set to 0.15 $\mu J/cm^2$ will be described with reference to FIG. 60. As shown in FIG. 60, even when a photosensitive element is exposed to an exposure power lower than the charging non-dependent exposure power Lpα, the post-fatigue exposure potential VLβ that is the exposure potential during electrostatic fatigue becomes higher than the initial exposure potential VLα that is the exposure potential in the initial state similarly to the relation between the post-fatigue residual potential Vrβ and the initial residual potential Vrα. Here, the charging potential Vd is increased by an amount corresponding to "post-fatigue exposure potential VLβ"–"initial exposure potential VLα" to obtain a corrected charging potential Vdδ (Vdδ=Vd+VLβ−VLα). Then, when an exposure potential of a photosensitive element of which the surface potential is the corrected charging potential Vdδ and which is exposed by the same exposure power (0.15 $\mu J/cm^2$) is denoted by VLγ that is a corrected exposure potential, the corrected exposure potential VLγ becomes higher than the post-fatigue exposure potential VLβ. When the corrected exposure potential VLγ becomes higher than the post-fatigue exposure potential VLβ, the corrected exposure potential "Vdδ-VLγ" becomes smaller than the exposure potential "Vd-VLα" in the initial state. Accordingly, under an image forming condition using the same exposure power (0.15 $\mu J/cm^2$) as above, it is not possible to obtain the same exposure potential as that of the initial state. By contrast, if the photosensitive element is exposed using the charging non-dependent exposure power Lpα (0.45 $\mu J/cm^2$), the corrected exposure potential may become equal to the post-fatigue residual potential Vrβ which is the exposure potential before correction. Accordingly, an exposure potential can be increased by the amount corresponding to the increase in the charging potential Vd, and a necessary exposure potential can be obtained. In this way, the same exposure potential as that of the initial state can be obtained for an arbitrary exposure power. Therefore, when correcting the charging potential Vd, it is necessary to use the charging non-dependent exposure power Lpα that does not change the value of the exposure potential VL even when the charging potential Vd changes. Moreover, in the correction method to be described later, for obtaining a favorable solid image and a halftone image, a residual potential Vr is used such that the surface potential of the photosensitive element becomes saturated. If the residual potential Vr changes with the charging potential Vd, because correction is not performed appropriately, it is necessary to calculate the value of the residual potential Vr using the charging non-dependent exposure power Lpα.

In this way, when the residual potential Vr of the photosensitive element 20 is detected in step S710, and the respective target potentials (the target charging potential Vd, the developing bias Vb, and the target exposure potential VL) are calculated in step S711, an image of a half tone that is called a halftone image as well as a solid image are formed in step S712. When the light attenuation characteristics of the photosensitive element 20 are changed, the image forming conditions are also adjusted so that the halftone image can be appropriately formed. In step S713, correction control for obtaining a favorable solid image and a halftone image is performed. Specifically, after correcting the charging potential Vd against fatigue or the like as described with reference to FIG. 60, control is performed so as to obtain the optimum exposure power Lp for obtaining a favorable solid image and a halftone image.

Figure 61:
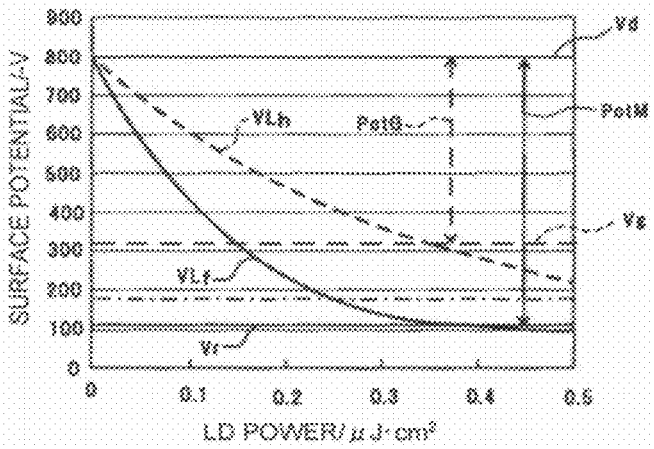
FIG. 61 is an explanatory diagram illustrating light attenuation characteristics of a photosensitive element when solid image exposure and halftone image exposure are performed.

FIG. 61 is an explanatory diagram illustrating the light attenuation characteristics of a photosensitive element when solid image exposure and halftone image exposure are performed.

In FIG. 61, a solid line is for the solid image exposure, and a broken line is for the halftone image exposure. When the exposure for the halftone image is performed, the same exposure power as that for the solid image is used, and exposure time per unit area is reduced compared to the exposure time for the solid image. A method of expressing an intermediate gradation by changing the exposure area per unit area may be used. When a potential sensor measures the surface potential of a photosensitive element, the potential is measured within a predetermined range of dots rather than every dot, and the potential corresponding to the average within that range is detected. Accordingly, as shown in FIG. 61, even though the same amount of exposure light is used, a halftone-image exposure potential VLh that is the exposure potential for halftone image exposure has a value (close to the charging potential Vd) higher than a solid-image exposure potential VLf that is the exposure potential for solid image exposure. In order to obtain a favorable solid image and a halftone image, the exposure power is adjusted so as to match a desirable light attenuation rate. The light attenuation rate is defined as an exposure potential ratio (Potb)/(Pota) under a condition in which a charging potential is set at a constant level, the exposure potential (Pota) is for solid image exposure, and the exposure potential (Potb) is for halftone image exposure. By setting the light attenuation ratio to a predetermined constant value, the ratio of the halftone image density to the solid image density can be set in a uniform manner. In an example of FIG. 61, the light attenuation ratio is adjusted to 0.7. Moreover, in this example, the exposure duty for a solid image is 100%, and the exposure duty for a halftone image is 50%. Although in this example, the exposure duty is changed, the exposure area per unit area may be set to 50% without changing the exposure duty.

In the correction control of this example for obtaining a favorable solid image and a halftone image, an ideal exposure power Lp is calculated based on the halftone image exposure potential VLh. First, the exposure duty is set to 50% (if an apparatus can perform 4-valued pulse adjustment, 2-valued pulse adjustment is used). Then, a potential corresponding to a light attenuation ratio of 0.7 is set to a light-amount adjusting target value Vg. That is, an exposure potential (PotG in FIG. 61) corresponding to 0.7 times the exposure potential (the maximum exposure potential PotM indicated by an arrow-headed solid line in FIG. 61) used for measuring the residual potential Vr is set to the light-amount adjusting target potential Vg. As indicated by a broken line in FIG. 61, if the exposure duty is decreased to 50%, the detection result of the halftone-image exposure potential VLh that is the exposure potential for exposure duty of 50% is not saturated unlike the case when the residual potential Vr (the solid image exposure potential VLf) is measured. Moreover, when the exposure power Lp is changed, the halftone-image exposure potential VL is also changed (which means that the photosensitive element is sensitive in this area). Therefore, the exposure power can be adjusted with high accuracy. The exposure power Lp is adjusted with the exposure duty of 50%, and an exposure power Lp is calculated so that the halftone-image exposure potential VLh becomes the light-amount adjusting target potential Vg (in FIG. 61, Lp is about 0.35 $\mu J/cm^2$). Then, the calculated exposure power Lp is used to measure the solid-image exposure potential VLf that is the exposure potential VL for a solid image (exposure duty of 100%). Then, a development potential necessary for obtaining a desirable toner adhesion amount is added to the solid image exposure potential VLf to determine a developing bias Vb. Moreover, a background potential is added to the developing bias to determine the charging potential Vd.

An appropriate exposure light amount (exposure power Lp) is determined so as to obtain an appropriate solid image and a halftone image when the charging potential Vd is set at a given value. When the solid image exposure potential VLf is calculated based on the determined exposure light amount, a relation of VLf≈Vr is obtained. If the relation VLf≈Vr holds, even when the charging potential Vd' is computed again, a relation of Vd'≈Vd is to be obtained. Accordingly, if the optimum exposure light amount calculated for Vd is set, the calculated exposure light amount is also ideal for Vd'. In a case of FIG. 59B, for example, if the residual potential Vr is detected using the exposure power of Lp=0.2 $\mu J/cm^2$, the residual potential Vr may change greatly due to the charging potential Vd. If the charging potential Vd for halftone image control is set to −600 V, and the exposure power that corresponds to the light attenuation ratio of 0.7 for the charging potential of −600 V is 0.15 $\mu J/cm^2$, the solid image exposure potential VLf becomes about −250 V as compared to the graph of FIG. 59B, and becomes larger (in an absolute value) than the residual potential Vr (about 200 V) by about 50 V in a negative polarity. Moreover, in order to obtain a desirable exposure potential in the last step, the charging potential is corrected by an amount of about 50 V, and the corrected charging potential Vd'=−650 V is obtained.

As such, when the solid image exposure potential VLf is greatly different from the residual potential Vr, the charging potential Vd calculated based on the residual potential Vr has a value greatly different from the value of the charging potential Vd' calculated in the last step based on the solid image exposure potential VLf. Accordingly, the exposure power Lp=0.2 $\mu J/cm^2$ is not an appropriate exposure light amount when detecting the residual potential Vr. Therefore, as for the photosensitive element having the light attenuation characteristics shown in FIG. 59B, a great exposure power (the charging non-dependent exposure power Lpα) of 0.45 μJ/cm$^2$ is required as described above. When such a great exposure power is used for detecting the residual potential Vr, an optimum exposure power of 0.32 μJ/cm$^2$ (the light attenuation ratio of 0.7) for the charging potential Vd of −600 V becomes an appropriate exposure light amount for detecting the residual potential Vr.

Moreover, when the exposure power is adjusted to such a potential that "exposure potential×0.7" is obtained with the exposure duty of 50%, and the exposure potential VL is measured using the adjusted exposure power and the exposure duty of 100%, the exposure potential VL for a solid image may become substantially equal to the residual potential Vr. Therefore, if the exposure power is adjusted so that the light attenuation ratio becomes 0.7 for an exposure potential when exposed with an exposure power such that a potential saturation state is created, the light attenuation ratio of the exposure duty of 50% to the exposure duty of 100% will be 0.7.

In this example, when the solid image exposure (duty 100%) is performed, a range of exposure power, that does not change a surface potential even if the exposure power is changed a little, is used for an image forming operation. For example, as for the photosensitive element of FIG. 61, the range of exposure power is from 0.35 μJ/cm$^2$ to 0.43 μJ/cm$^2$ for a charging potential of −800 V, and the surface potential of the photosensitive element changes only a little even when the exposure power changes within that range. In this case, even if the exposure power is set to 0.36 μJ/cm$^2$ and then the exposure power changes a little, such as to 0.35 μJ/cm$^2$, the surface potential of photosensitive element rarely changes as indicated by the curve of the solid image exposure potential VLf in FIG. 61. Because an image forming process can be performed in such a range of exposure power, when solid image exposure is performed using the optimum exposure power, the exposure potential will not change so much even if the exposure power is changed. That is, because the surface potential of the photosensitive element is not sensitive to the exposure power, it is difficult to adjust the exposure power for solid image exposure with high accuracy. Accordingly, the exposure power is adjusted by decreasing the exposure duty to 50% so that the surface potential of the photosensitive element is sensitive to the exposure power. This is because an exposure time is halved for the same exposure power, and the light amount is also halved, the surface potential of the photosensitive element is sensitive to the exposure power like VLh.

As above, image-forming-condition adjusting control is performed in such a way that the residual potential Vr is detected, the exposure power is adjusted based on the detection result, and the developing bias Vb and the charging potential Vd are calculated based on the adjusted exposure power. With the image-forming-condition adjusting control, a favorable solid image and a halftone image can be obtained even when latent image potential characteristics are changed relative to the exposure power applied to the photosensitive element.

As described above, the copying machine 600 of the present embodiment is an image forming apparatus that includes: the photosensitive element 20 serving as a latent image carrier; the charging unit 60 serving as a charging means that uniformly charges the surface of the photosensitive element 20 so that the surface potential reaches a target charging potential; the exposing unit 900 serving as an electrostatic latent image forming means that exposes the surface of the photosensitive element 20 charged by the charging unit 60 to form a dot latent image which is a dotted electrostatic latent image based on image data; the developing unit 61 serving as a developing means that performs developing by causing toner to electrostatically adhere to an electrostatic latent image portion or a non-electrostatic latent image portion on the surface of the photosensitive element 20 to form a toner image; the intermediate transfer belt 10 serving as a transfer means that eventually transfers the toner image, which is formed on the surface of the photosensitive element 20 through the development by the developing unit 61, to the transfer sheet 5 serving as a recording medium, and the like; and the main controller 500 serving as an image density adjusting control means. In the copying machine 600, the exposing unit 900 forms a multi-gradation patch pattern (the 10-gradation pattern) on the surface of the photosensitive element 20, the potential sensor 320 serving as a potential detecting means detects the potential of each of the latent image patches of the multi-gradation patch pattern, the density sensor 310 serving as a toner adhesion amount detecting means detects a toner adhesion amount of each of the toner patches obtained through the development by the developing unit 61, and image density adjusting control is performed by the main controller 500 based on the detection results. In the copying machine 600, one of a low-density latent image patch and a plurality of low-density latent image patches (patches of the patterns 1 to 6) belonging to a predetermined low-density range (a≤0.5) among the latent image patches that form the multi-gradation patch pattern have a configuration in which a basic dot matrix that is the minimum pixel unit of area gradation control is periodically arranged, and in which the number and arrangement of dot latent images in the basic dot matrix are determined in accordance with a corresponding density in units of a unit dot latent image (which includes two or more dot latent images in the second modification and which includes one dot latent image in another example). Moreover, the low-density latent image patches of the patches 2 to 6 are dot-dispersed latent image patches in which the arrangement of unit dot latent images in the basic dot matrix is determined so that the minimum center-to-center distance having the smallest value among the center-to-center distances of the unit dot latent images is maximized. By using such dot-dispersed latent image patches as the low-density latent image patches, it is possible to suppress a problem in which the toner adhesion amount to the low-density latent image patch is larger than the intended toner adhesion amount. As a result, even when the relation (the relation between the development potential and the toner adhesion amount) for obtaining a value of a density index (the development value γ or the developing start voltage) of image density adjusting control using a multi-gradation patch pattern with fewer patches is detected using the detection result of the toner adhesion amount of the low-density latent image patch, the detection accuracy may not decrease. Therefore, it is possible to detect the relation using the multi-gradation patch pattern formed by latent image patches that are dispersed within a wide density range including a low density portion. Accordingly, it is possible to detect the relation with high accuracy, and high-accuracy density adjusting control can be performed.

Figure 62:
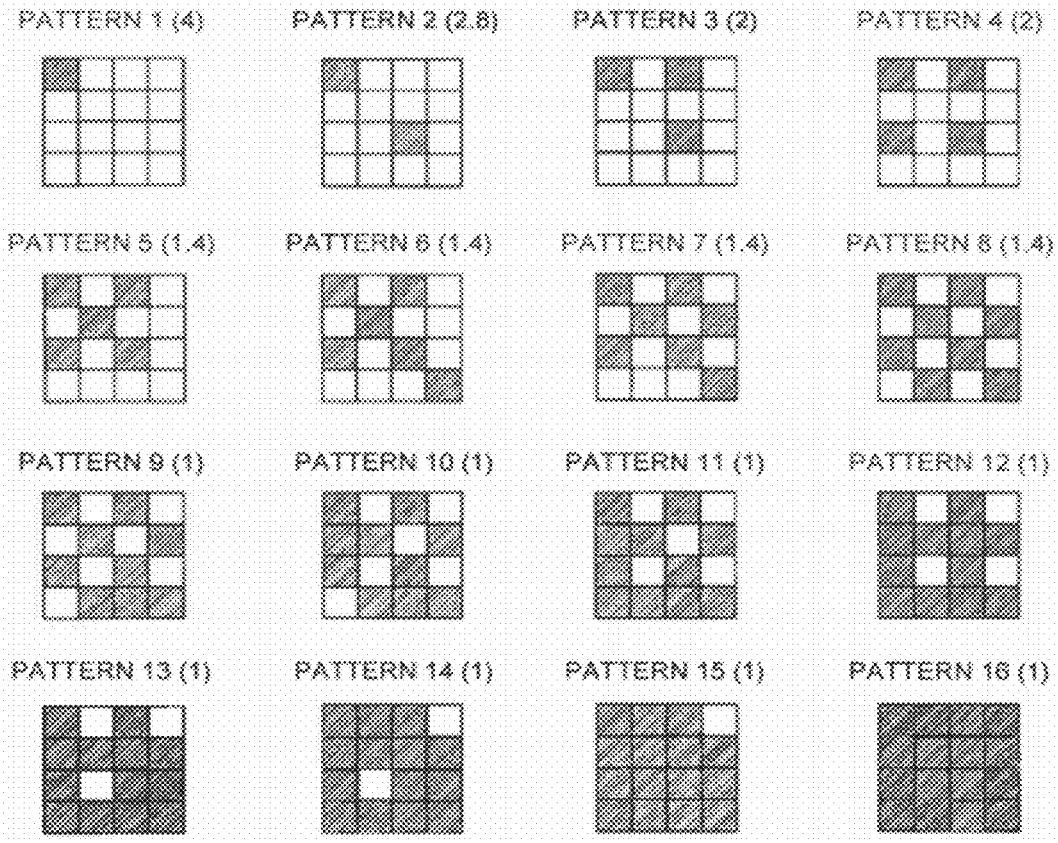
FIG. 62 is an explanatory diagram illustrating an example of creating a 16-gradation patch pattern in which the number of dot latent images in a simple basic dot matrix of 4 dots by 4 dots is sequentially changed in units of one dot.

To simplify the description of the dot-dispersed latent image patches below, a description is given, with reference to FIG. 62, of an example in which the basic dot matrix is formed by 4 dots by 4 dots and the number of dot latent images is changed in units of one dot so as to form a 16-gradation patch pattern. Each patch has a configuration in which respective basic dot matrices of the patterns 1 to 16 shown in FIG. 62 are arranged periodically. In the pattern 2 of the 16-gradation pattern, the center-to-center distance between two dot latent images (hatched portions) in the illustrated basic dot matrix is smallest among all center-to-center distances of the respective dot latent images. This smallest value is the minimum center-to-center distance and is 2.8 dots for the pattern 2. Similarly, in the pattern 3, the center-to-center distance between two dot latent images arranged in the horizontal or vertical direction in the illustrated basic dot matrix is smallest among the center-to-center distances of the respective dot latent images and is 2 dots. The minimum center-to-center distances of the patterns calculated in this way are written in the parenthesis of the respective drawings in FIG. 62.

The basic dot matrix of the pattern 2 in FIG. 62 shows that, as a position at which an additional dot latent image is arranged with respect to the dot latent image positioned at the top-left corner, 14 positions as well as the illustrated position (located at a distance of three dots from the left and at a distance of two dots from the bottom) exist. However, if the additional dot latent image is arranged at a position other than the illustrated position, the minimum center-to-center distance becomes smaller than 2.8 dots. For example, when the additional dot latent image is arranged at a position located at a distance of one dot from the left and at a distance of three dots from the bottom, the minimum center-to-center distance becomes 1 dot. Moreover, when the additional dot latent image is arranged at a position located at a distance of three dots from the left and at a distance of three dots from the bottom, the minimum center-to-center distance becomes 2.2 dots. Furthermore, when the additional dot latent image is arranged at a position located at a distance of four dots from the left and at a distance of one dot from the bottom, the minimum center-to-center distance becomes about 1.4 dots. That is, in the illustrated pattern 2, the arrangement of dot latent images in the basic dot matrix is determined so that the minimum center-to-center distance has the largest value of about 2.8. In the example of FIG. 62, in the patterns 2 to 8, that is, the low density patches in the range of a <0.5 in which two or more unit dot latent images are arranged in the basic dot matrix, the arrangement of the dot latent images is determined so that all low density patches become the dot-dispersed latent image patches.

Figure 63:
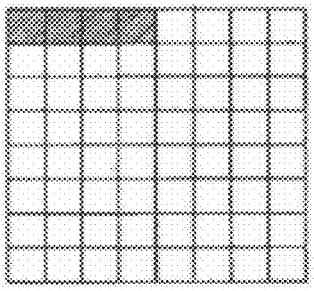
FIG. 63 is an explanatory diagram illustrating an example of four basic dot matrices of a low density patch.
Figure 63:
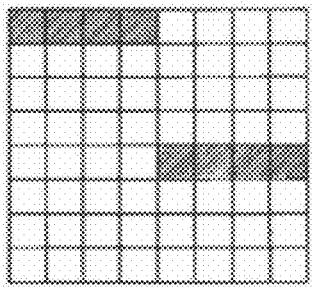
Figure 63:
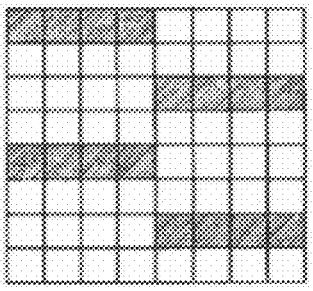
Figure 63:
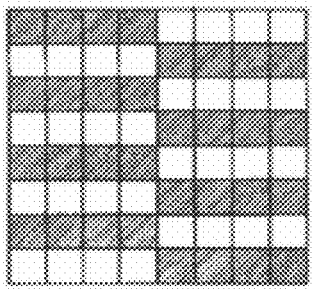

FIG. 63 is an explanatory diagram illustrating an example of a basic dot matrix of four low density patches belonging to a density range of a ≤0.5. The multi-gradation patch pattern illustrated in FIG. 63 is an example (cm=4 and cs=1) in which a basic dot matrix including 8 dots by 8 dots is used, and four dot latent images form a unit dot latent image. These low density patches are also configured as dot-dispersed latent image patches. For example, in the pattern 2, the minimum center-to-center distance having the smallest value among the center-to-center distances of the respective unit dot latent images is about 5.7 dots. In the four low density patches illustrated in FIG. 63, the arrangement of dot latent images in the basic dot matrix is determined so that the minimum center-to-center distance has the largest value (become the longest).

Figure 64:
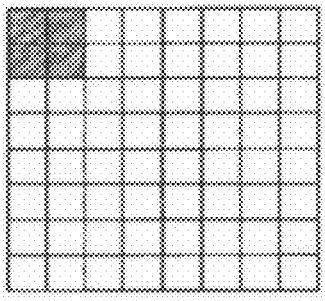
FIG. 64 is an explanatory diagram illustrating another example of four basic dot matrices of a low density patch.
Figure 64:
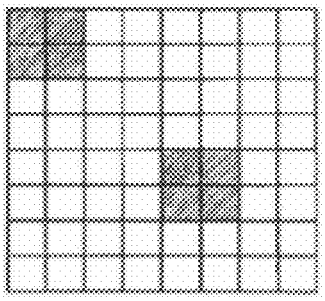
Figure 64:
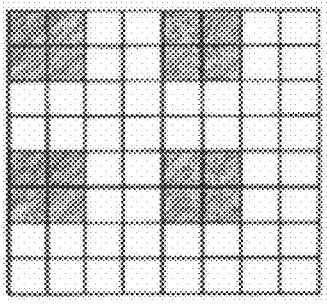
Figure 64:
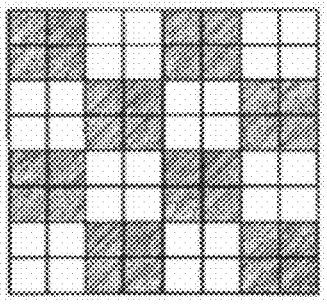
Figure 65:
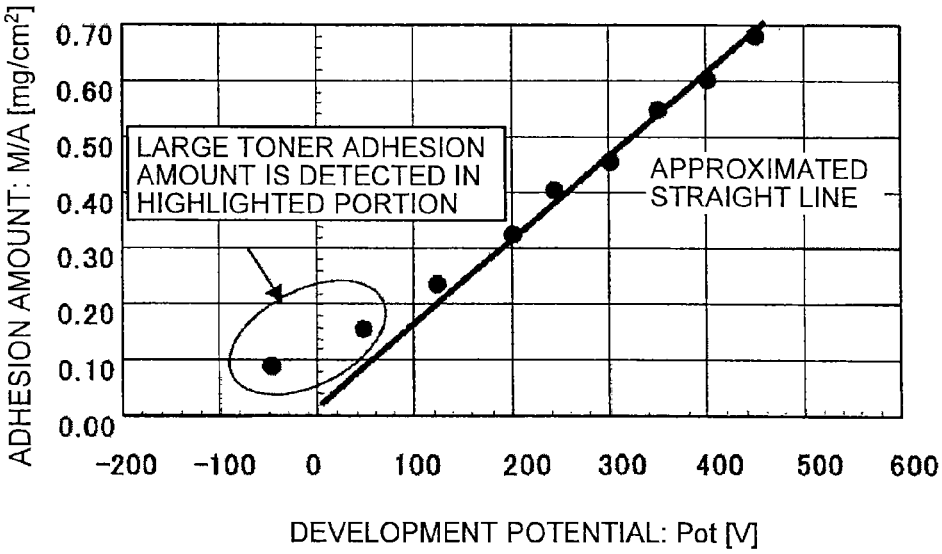
RELATED ART FIG.65
FIG. 65 is a graph plotting a number of relations between a development potential and a toner adhesion amount detected in an image forming apparatus of the related art.
Figure 66:
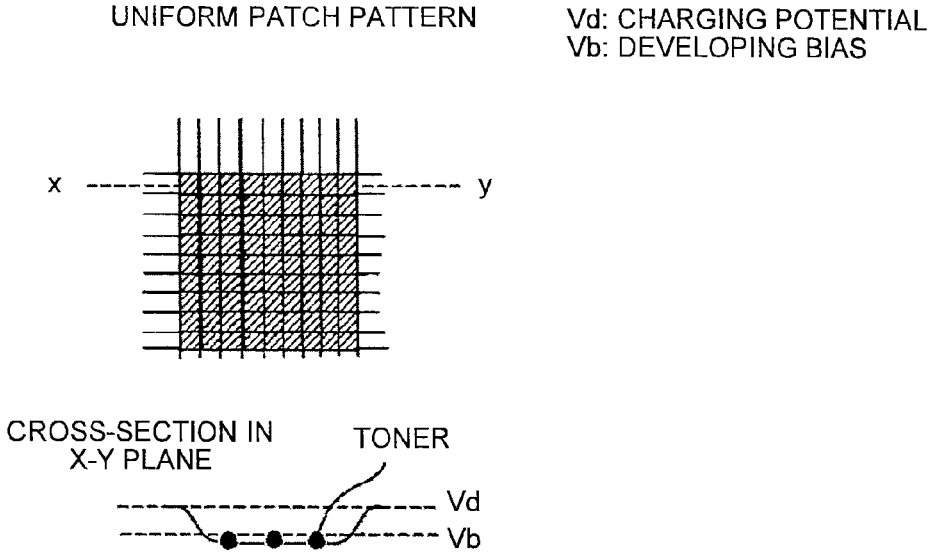
FIG. 66 is an explanatory diagram illustrating an example of creating a low-density latent image patch through density gradation control.
Figure 67:
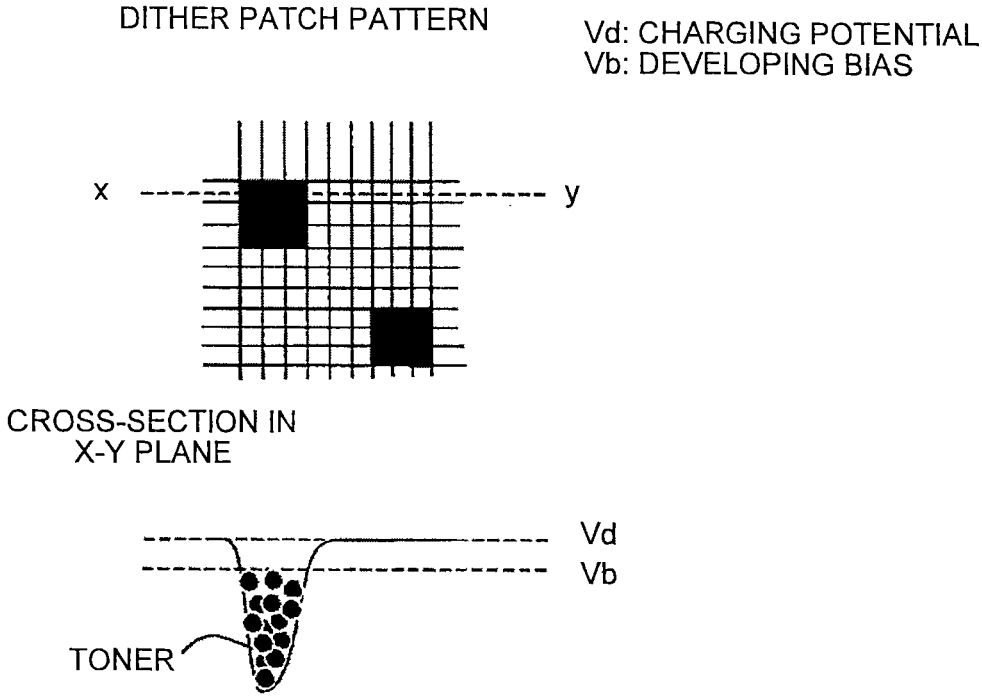
RELATED ART FIG.67
FIG. 67 is an explanatory diagram illustrating an example of creating a latent image patch in which the same latent image potential as the latent image patch illustrated in FIG. 66 is detected by an electrometer through area gradation control in an image forming apparatus of the related art.

FIG. 64 illustrates another example of a basic dot matrix of four low density patches belonging to a density range of a ≤0.5. The multi-gradation patch pattern shown in FIG. 64 is also an example in which a basic dot matrix that includes 8 dots by 8 dots is used, and four dot latent images form a unit dot latent image. However, the four dot latent images forming the unit dot latent image are arranged differently from that illustrated in FIG. 63. That is, the unit dot latent image of the multi-gradation patch pattern illustrated in FIG. 64 has a size of cm=2 and cs=2. The four low density patches illustrated in FIG. 64 are also configured as dot-dispersed latent image patches. For example, in the pattern 2, the minimum center-to-center distance having the smallest value among the center-to-center distances of the respective unit dot latent images is about 5.7 dots. In the four low density patches illustrated in FIG. 64, the arrangement of dot latent images in the basic dot matrix is determined so that the minimum center-to-center distance has the largest value (become the longest).

Moreover, in the present embodiment, the low-density latent image patches configured as the dot-dispersed latent image patches are the entire latent image patches in which two or more unit dot latent images are provided in the basic dot matrix and which have a lower density than a latent image patch corresponding to the lowest density among latent image patches having an arrangement of unit dot latent images in which the largest minimum center-to-center distance is not changed even when an additional unit dot latent image is provided at any position in the basic dot matrix. Referring to FIG. 62, in the case of all patterns 2 to 16 in which two or more unit dot latent images are arranged within the basic dot matrix, patterns 9 to 16 are the latent image patches which have an arrangement of unit dot latent images in which the largest minimum center-to-center distance is 1 dot and is not changed even when an additional unit dot latent image is provided at any position in the basic dot matrix. Moreover, the pattern 9 is a pattern that corresponds to the lowest density among the patterns 9 to 16. In the present embodiment, all latent image patches, namely the patterns 2 to 8, having a lower density than the pattern 9 are configured as dot-dispersed latent image patches.

Moreover, in the present embodiment, gradation control performed when the exposing unit 900 forms dot latent images corresponding to a density belonging to a predetermined low-density range (a≤0.5) based on the image data is preferably different from gradation control performed when the exposing unit 900 forms low-density latent image patches belonging to the predetermined low-density range in the multi-gradation patch pattern. For example, when performing the gradation control in the low density portion to form an image, dot latent images in the basic dot matrix are arranged in a concentrated manner rather than in a dispersed manner as in the case of the dot-dispersed latent image patches. As described above, when dot latent images are arranged in a dispersed manner, because the light source is frequently turned on and off, it is difficult to form stable dot latent images, and image density unevenness is likely to occur when the whole image is viewed. Therefore, in the multi-gradation patch pattern formed for performing image density adjusting control, the dot latent images in the basic dot matrix are arranged in a dispersed manner as in the case of dot-dispersed latent image patches so as to improve detection accuracy. However, when an image is formed, area gradation control is performed by forming dot latent images to be concentrated in the basic dot matrix so as to form stable dot latent images. When an image is formed, density gradation control may of course be adopted.

Moreover, the image density adjusting control performed in the present embodiment includes calculating a development potential based on the potentials of the respective latent image patches detected by the potential sensor 320 and a developing bias when the developing unit 61 develops the respective latent image patches, performing a linear approximation on the relation between the toner adhesion amounts of the respective toner patches corresponding to the respective latent image patches detected by the density sensor 310 and the development potentials corresponding to the respective latent image patches, specifying a development potential, at which a predetermined toner adhesion amount corresponding to a reference image density (for example, the density of a solid image) is obtained, from the linearly approximated relation, and controlling at least one of the image forming conditions on the target charging potential of the charging unit 60, the developing bias of the developing unit 61, and the exposure power of the exposing unit 900. According to the present embodiment, because the development potential serving as the reference of these image forming conditions can be specified with high accuracy, it is possible to adjust these image forming conditions with high accuracy.

According to the embodiment, among the latent image patches that form the multi-gradation patch pattern to be used in the density adjusting control of an image, in one low-density latent image patch or a plurality of low-density latent image patches belonging to a predetermined low-density range, a latent image patch corresponding to the density controlled by the area gradation control is formed. The one low-density latent image patch or the plurality of the low-density latent image patches have a configuration in which a basic dot matrix, serving as the minimum pixel unit of the area gradation control, is periodically arranged, and in which the number and the arrangement of dot latent images to be arranged within the basic dot matrix are determined in accordance with a corresponding density in units of a unit dot latent image. Moreover, in the embodiment, the one low-density image patch or the plurality of the low-density latent image patches are partially or entirely dot-dispersed latent image patches in which the arrangement of unit dot latent images in the basic dot matrix is determined such that the minimum center-to-center distance having the smallest value among the center-to-center distances of the unit dot latent images arranged over the entire patch is maximized. In such a dot-dispersed latent image patch, the respective unit dot latent images are arranged so as to be separated farthest from each other when a number of dot latent images are arranged that are necessary to obtain the corresponding density in the basic dot matrix in units of a unit dot latent image. Therefore, it is possible to decrease the number of dot latent images in which repeated exposure of light by the electrostatic latent image forming unit causes the latent image potential to decrease greatly from an intended potential. Moreover, it is possible to suppress the decrease in the potential of the dot latent image in which repeated exposure of light by the electrostatic latent image forming unit causes the latent image potential to decrease greatly from the intended potential value. Therefore, it is possible to suppress the problem in that a toner adhesion amount is increased in the low-density latent image patch as compared to the intended toner adhesion amount. As a result, even when the relation (for example, the relation between the development potential and the toner adhesion amount) for obtaining a value of a density index of the density adjusting control of the image using a multi-gradation patch pattern with fewer patches is detected using the detection result of the toner adhesion amount of the low-density latent image patch, the detection accuracy is not degraded. Therefore, it is possible to detect the relation using the multi-gradation patch pattern formed by latent image patches that are dispersed within a wide density range including a low density portion. Accordingly, it is possible to detect the relation with high accuracy, and high-accuracy density adjusting control can be performed.

According to the invention, high-accuracy density adjusting control can be performed with a multi-gradation patch pattern that includes fewer patches.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a charging unit that uniformly charges a surface of a latent image carrier so as to cause a surface potential of the latent image carrier to be a target charging potential;

a latent-image forming unit that exposes, based on image data, the surface of the latent image carrier having been charged by the charging unit with light so as to form a dot latent image that is a dotted electrostatic latent image;

a developing unit that performs development by causing toner to electrostatically adhere to one of an electrostatic latent image portion and a non-electrostatic latent image portion on the surface of the latent image carrier;

a transfer unit that eventually transfers a toner image formed on the surface of the latent image carrier through the development by the developing unit onto a recording medium; and an image-density adjusting unit that causes the latent-image forming unit to form a multi-gradation patch pattern on the surface of the latent image carrier, that causes a potential detecting unit to detect potentials of respective latent image patches in the multi-gradation patch pattern, that causes a toner adhesion amount detecting unit to detect a toner adhesion amount on each toner patch that is formed through the development of the respective latent images by the developing unit, and that performs control of an image density based on the detection results, wherein a low-density latent image patch or a plurality of low-density latent image patches belonging to a predetermined low-density range among the latent image patches that form the multi-gradation patch pattern has a configuration in which a basic dot matrix that is a minimum pixel unit for area gradation control is periodically arranged, and in which number and arrangement of dot latent images in the basic dot matrix are determined in accordance with a corresponding density in units of a unit dot latent image that is formed with one of a dot latent image and a plurality of groups of dot latent images, and a part or all of either the low-density latent image patch or the plurality of the low-density latent image patches is a dot-dispersed latent image patch in which the arrangement of unit dot latent images in the basic dot matrix is determined so that a minimum center-to-center distance having a smallest value among center-to-center distances of the unit dot latent images is maximized.

2. The image forming apparatus according to claim 1, wherein the low-density latent image patch or the plurality of the low-density latent image patches is an entire latent image patch that has a configuration in which a plurality of unit dot latent images are provided in the basic dot matrix, and that has a lower density than another latent image patch that corresponds to a lowest density among latent image patches having an arrangement of unit dot latent images in which a largest minimum center-to-center distance is not changed even when an additional unit dot latent image is provided at any position in the basic dot matrix.

3. The image forming apparatus according to claim 1, wherein gradation control performed when the latent-image forming unit forms a dot latent image corresponding to a density that belongs to the predetermined low-density range based on the image data is different from gradation control performed when the latent-image forming unit forms a latent image patch that belongs to the predetermined low-density range in the multi-gradation patch pattern.

4. The image forming apparatus according to claim 1, wherein the image-density adjusting unit further calculates a development potential based on the potentials of the respective latent image patches detected by the potential detecting unit and a developing bias used by the developing unit when the respective latent image patches are developed, performs linear approximation on a relation between toner adhesion amounts on the toner patches corresponding to the latent image patches detected by the toner adhesion amount detecting unit and development potentials corresponding to the respective latent image patches, specifies a development potential at which a predetermined toner adhesion amount corresponding to a reference image density can be obtained from the relation obtained by the linear approximation, and controls at least one image forming condition among a first condition on a target charging potential of the charging unit, a second condition on a developing bias of the developing unit, and a third condition on an exposure power of the latent-image forming unit.

* * * * *